US006546866B1

(12) United States Patent
Adachi et al.

(10) Patent No.: US 6,546,866 B1
(45) Date of Patent: Apr. 15, 2003

(54) INK VISCOSITY MEASURING DEVICE, INK VISCOSITY ADJUSTING METHOD AND DEVICE THEREFOR, AND A PRINTING APPARATUS

(75) Inventors: Nokihisa Adachi, Kasugai (JP); Morimasa Shoji, Nagoya (JP); Etsuro Abe, Komaki (JP)

(73) Assignee: Kabushiki Kaisha Isowa, Aichi (JP)

( * ) Notice: Subject to any disclaimer, the term of this patent is extended or adjusted under 35 U.S.C. 154(b) by 211 days.

(21) Appl. No.: 09/690,349

(22) Filed: Oct. 17, 2000

(30) Foreign Application Priority Data

Mar. 31, 2000 (JP) ..... 2000-136411
Sep. 27, 2000 (JP) ..... 2000-294934

(51) Int. Cl.[7] ..... B41F 31/02
(52) U.S. Cl. ..... 101/366; 101/367; 101/350.1
(58) Field of Search ..... 101/364, 365, 101/366, 350.1, 367

(56) References Cited

U.S. PATENT DOCUMENTS 3,712,117 A * 1/1973 Fitzgerald et al. ..... 73/54.26
4,329,923 A * 5/1982 Iida ..... 101/365
4,355,576 A * 10/1982 Ohlsson ..... 101/492
4,362,179 A * 12/1982 MacPhee et al. ..... 101/364
4,662,030 A * 5/1987 Cooper et al. ..... 73/54.13
5,533,449 A * 7/1996 Hasagawa ..... 101/350.1
6,095,040 A * 8/2000 Ashikagaya et al. ..... 101/120

FOREIGN PATENT DOCUMENTS

JP 58020456 * 2/1983

* cited by examiner

*Primary Examiner*—Eugene H. Eickholt
(74) *Attorney, Agent, or Firm*—Koda & Androlia

(57) ABSTRACT

A cardboard sheet printing apparatus including: a rotating body that freely rotates inside an ink circulation passage through which ink flows, and a rotation-imparting assembly which is magnetically coupled with the rotating body outside the ink circulation passage and imparts rotation to the rotating body. When the rotating body is caused to rotate by the rotation-imparting assembly, the variation in the load current value that occurs upon changes in the viscosity of the ink that contacts the rotating body is detected; and this variation is compared with load current values that correspond to respective changes in the ink viscosity value stored in memory beforehand and is converted into an ink viscosity value and then displayed, so that the viscosity of the ink is adjusted based upon the calculated results.

1 Claim, 22 Drawing Sheets

INK VISCOSITY MEASURING DEVICE, INK VISCOSITY ADJUSTING METHOD AND DEVICE THEREFOR, AND A PRINTING APPARATUS

BACKGROUND OF THE INVENTION

1. Field of the Invention

The present invention relates to an ink viscosity measuring device, and an ink viscosity measurement method and apparatus, for a cardboard sheet printing apparatus.

2. Prior Art

After being pasted together by a corrugator (not shown), cardboard sheets are ruled and cut to desired dimensions, and are then printed, scored and stamped out by means of a cardboard sheet boxing machine (not shown). For the most part, flexo printing using water-soluble flexo inks and printer-slotter printing using glycol type printer-slotter inks are used in the printing of cardboard sheets.

As shown in FIG. 22, the printing unit 1 of a flexo printing apparatus in a cardboard sheet boxing machine comprises: a printing cylinder 2 around which a printing plate (not shown) is wrapped, a pressing roll 3 which is installed facing the printing cylinder 2 with a paper line PL interposed between the two rolls, an ink roll 4 and a wringing roll 5 which are installed so as to face the printing cylinder 2, and an ink collecting area A which is formed between the two rolls 4 and 5, and an ink collecting area A which is formed between the two rolls 4 and 5. An anilox roll in which fine engraving is formed is usually used as the ink roll 4. The wringing roll 5 performs a wringing action that causes the formation of an appropriate ink coating film on the surface of the ink roll 4. Accordingly, a rubber roll system is which a hard rubber is wrapped around the roll surface is most commonly used as the wringing roll 5. However, a so-called chamber blade system in which wringing of the ink is performed by pressing a blade against the ink roll 4 may also be used. The supply of ink to the ink roll 4 and wringing roll 5 in the ink collecting area A is accomplished so that ink in an ink tank 8 installed inside the printing unit 1 or near the printing unit 1 is drawn upward by an ink pump 7 from an ink suction port 9, this ink passes through an ink supply passage 10 and is supplied from an ink supply port 11. Here, the ink is wrung to an appropriate amount by the ink roll 4 and wringing roll 5, and is transferred onto the printing plate wrapped around the printing cylinder 2. Furthermore, the excess ink flows out from both end of the ink roll 4 and wringing roll 5 (with respect to the axial direction of the rolls); then, this ink is received by ink pans 6 installed at the ends of the ink roll 4 and wringing roll 5 and eventually recovered in the ink tank 8 via an ink return passage 12 and ink return port 13.

Since flexo inks are quick-drying inks, it has been necessary in flexo printing apparatus to cause the constant circulation of a large amount of ink in order to reduce the effects of drying of the ink in the ink apparatus and ink passages inside the printing apparatus. Furthermore, since such inks are water-soluble, there have been instances in which the ink viscosity rises as a result of the evaporation of the water content of the ink during ink circulation. For example, there have been instances in which the water content of the ink is discharged into the air as a result of long-term circulation of the ink, so that the viscosity of the ink rises, instances in which the water content of the ink is evaporated by the heat of friction between the ink roll 4 and the wringing roll 5 when the ink is wrung by the ink roll 4 and wringing roll 5, so that the viscosity of the ink rises, and instances in which the water content of the ink is evaporated by the action of the mechanically generated heat of the ink pump 7 on the circulating ink, so that the viscosity of the ink rises.

If the viscosity of the ink rises, differences in the relative lightness and darkness of printing are generated according to the cardboard sheets when printing is performed on such sheets, so that unsatisfactory printing results. In addition, since the cardboard sheets are coated with more ink than is necessary, ink consumption is conspicuous so that ink loss results. Furthermore, if the ink viscosity rises, the fluidity of the ink drops, so that large quantities of ink remain in the ink passages when the ink is replaced, thus resulting in deterioration in the ink recovery rate. This also leads to ink loss. Moreover, since large quantities of ink remain in the ink passages, the ink cleaning efficiency also drops, so that more time is required for cleaning. Consequently, large quantities of cleaning waste liquid are discharged, and ink that cannot be cleaned away solidifies and is deposited in the ink passages, so that the subsequent flow-through of ink is hindered. Meanwhile, since flexo printing is suited for large-quantity production, such printing is used in the production of large quantities of sheets. However, in cases where flexo printing is used in such production, the viscosity of the ink varies during production so that there is sometimes a conspicuous difference in the relative lightness and darkness of printing between the printing that is performed initially and the final printing. In order to prevent the variation in the ink viscosity that causes such unsatisfactory printing, the operator periodically measures the viscosity of the ink and controls the ink viscosity.

For example, a measuring instrument 53 known as a Zahn cup No. 4 such as that shown in FIG. 21 is generally used in ink viscosity control. As shown in FIG. 21A, this Zahn cup 53 is placed in the ink tank 8, and after the interior of the Zahn cup 53 is filled with ink, the operator grasps the handle 53*b* of the Zahn cup 53, and quickly draws the Zahn cup 53 upward out of the ink tank 8 as shown in FIG. 21B. An ink escape hole 53*a* is formed in the bottom of the Zahn cup 53, and when the Zahn cup 53 is drawn upward out of the ink tank 8, ink continuously drops from this escape hole 53*a*. When the ink inside the Zahn cup 53 is eventually exhausted, then ink no longer drops from the Zahn cup 53, as shown in FIG. 21C. Since the volume of the Zahn cup 53 and the size of the escape hole 53*a* are known, the rate at which the ink drops is a fixed rate that corresponds to the viscosity of the ink. Accordingly, the viscosity of the ink can be ascertained from the time that is required for the ink to drop. Specifically, in the case of a lower ink viscosity, the dropping of the ink is completed more quickly, while a higher ink viscosity requires a longer time for completion of the dropping of the ink. Accordingly, the ink viscosity is measured by the time required for the dropping of the ink from the Zahn cup 53 to cease after the Zahn cup 53 is drawn upward out of the ink tank 8, i.e., the dropping time of the ink when there is a change from the state shown in FIG. 21B to the state shown in FIG. 21C. As one example, assuming that an ink dropping time (according to the Zahn cup 53) of 10 seconds represents the most suitable ink viscosity for the printing of a certain order, it is judged that the ink viscosity is higher than the optimal value of the ink viscosity for the printing of the order in cases where the ink dropping time is longer than 10 seconds. Conversely, in cases where the ink dropping time is shorter than 10 seconds, it is judged that the ink viscosity is lower than the above-described optimal value. Then, the operator ascertains the viscosity of the ink on the basis of the measurement results. In cases where the viscosity of the ink is too high, the operator supplies an appropriate amount of a diluent liquid such as water, etc. to the ink tank 8 on the basis of past experience. In cases where the viscosity of the ink is too low, the operator supplies the ink stock liquid to the ink tank 8. The viscosity of the ink is adjusted by repeating this process.

However, in cases where the viscosity of the ink is measured by means of a Zahn cup 53 as described above, the measurement is performed visually by the operator, and thus depends greatly on the skill of the operator, so that the measured values of the ink viscosity often differ from measurement to measurement. Furthermore, in order to obtain an accurate grasp of the ink viscosity, measurements must be repeated a number of times, and the correct viscosity must be calculated from the mean value of the measurement results. Since the viscosity of the ink cannot be accurately measured unless a number of measurements are performed as described above, measurement of the ink viscosity takes time, and the measurement work is bothersome. Furthermore, the Zahn cup 53 must be washed for each type of ink used, so that the operator is burdened by the work that is required. Moreover, since the standards of judgment used in measurement vary depending upon the operator, the measured viscosity of the ink varies according to the operator that performs the measurement, so that even in cases where printing of the same order is performed, it is difficult to obtain the same ink viscosity if the ink viscosity is measured by a different operator, so that printing in which the shade is different may be performed even in the case of printed matter of the same order.

Furthermore, measurement of the ink viscosity by means of a Zahn cup 53 is performed arbitrarily by the operator with an irregular timing according to breaks in the work. Accordingly, for example, accurate viscosity control cannot be achieved even in the same order, and in cases where the operator is busy during production, or in cases where the operator simply forgets to perform measurements, differences in the relative lightness and darkness of printing may result in unsatisfactory printing. Moreover, the supply of a diluent liquid or ink stock liquid for the purpose of adjusting the ink viscosity after the ink viscosity measurement results have been received depends greatly on the experience and intuition of the operator, so that the work is difficult for inexperienced operators.

In regard to ink viscosity measurements that do not use a Zahn cup 53 of the type described above, there are methods that perform ink viscosity measurements using special ink viscosity measuring devices. For example, such methods are described in Japanese Patent Application Laid-Open (Kokai) Nos. H10-264358, H6-213794, H8-230160, etc. However, the ink viscosity measuring devices disclosed in these patents are large and expensive. Furthermore, the ink viscosity cannot be measured in the ink circulation passages, so that direct measurement of the ink viscosity during printing is impossible. Furthermore, there is also a method (disclosed in Japanese Patent Application Laid-Open (Kokai) No. H8-323961) in which the ink viscosity is measured using special ink viscosity measuring devices in the ink passages inside the printing apparatus. However, in the case of these ink viscosity measuring devices, a spring mechanism used to measure the rotational torque of the viscosity measuring element is installed between the viscosity measuring element and the driving part of this element. As a result, the apparatus is relatively large and complicated, and there are many restrictions on the place of installation. Moreover, ink recovery and cleaning must be performed each time that the type of ink being used is changed. However, in the case of the respective ink viscosity measuring devices disclosed above, the ink circulation passages inside the ink viscosity measuring device are complex, so that ink recovery and cleaning cannot be performed simultaneously with ink recovery and cleaning in the ink circulation passages inside the printing apparatus.

SUMMARY OF THE INVENTION

The object of the present invention is to eliminate complicated work on the part of the operator by using a compact, simple and inexpensive device to perform accurate measurements of the viscosity of the ink flowing through ink passages during printing or ink preparation, and also to eliminate unsatisfactory printing caused by errors in the measurement of the ink viscosity due to insufficient experience on the part of the operator or due to the operator forgetting to measure the ink viscosity as a result of being pressed by work or by human errors in the adjustment of the ink viscosity.

In order to solve the above-described problems and achieve the object, the present invention provides an ink viscosity measuring device for a printing apparatus that comprises: a printing cylinder, a pressing member, an ink roll, a wringing member which faces the ink roll in a tightly adhering manner and forms an ink collecting area between the wringing member and the ink roll, an ink circulation passage which supplies ink to the ink collecting area and recovers the ink, and an ink tank which communicates with the ink circulation passage and functions as a supply source and recovery source for the ink; and in the printing apparatus, ink in the ink collecting area is transferred to the printing cylinder via the ink roll and printed on sheets that pass between the printing cylinder and the pressing member; wherein the ink viscosity measuring device comprises:

- a rotating body which is disposed inside the ink circulation passage so that the rotating body can freely rotate;
- electrical rotation-imparting means which are disposed outside the ink circulation passage, magnetically coupled to the rotating body, and imparts rotation to the rotating body;
- a load current value detection means which detects changes in a load current value that occurs upon changes in a viscosity of ink that contacts the rotating body when rotation is imparted to the rotating body by way of passing an electric current through the rotation-imparting means;
- a memory means which stores the load current values that correspond to respective changes in the viscosity value of the ink; and
- a calculating means which compares respective load current values stored in the memory means with the load current value detected by the load current value detection means and calculates an ink viscosity value at a current point in time.

Furthermore, the present invention provides an ink viscosity measuring device for a printing apparatus that comprises: a printing cylinder, a pressing member, an ink roll, a wringing member which faces the ink roll in a tightly adhering manner and forms an ink collecting area between the wringing member and the ink roll, an ink circulation passage which supplies ink to the ink collecting area and recovers the ink, and an ink tank which communicates with the ink circulation passage and functions as a supply source and recovery source for the ink; and in the printing apparatus, ink in the ink collecting area is transferred to the printing cylinder via the ink roll and printed on sheets that pass between the printing cylinder and the pressing member; and the ink viscosity measuring device comprises:

a first rotating body which is disposed inside the ink circulation passage so that the rotating body can freely rotate;

a second rotating body which is disposed outside the ink circulation passage and magnetically coupled to the first rotating body;

an electrical driving means which causes the second rotating body to rotate, and imparts rotation to the first rotating body that is magnetically coupled with the second rotating body;

a load current value detection means which detects changes in a load current value that occurs upon changes in a viscosity of ink that contacts the first rotating body when rotation is imparted to the first rotating body by way of passing an electric current through the electrical driving means;

a memory means which stores the load current values that correspond to respective changes in the viscosity value of the ink; and a calculating means which compares respective load current values stored in the memory means with the load current value detected by the load current value detection means, and calculates an ink viscosity value at the current point in time.

The present invention further provides an ink viscosity measuring device for a printing apparatus that comprises: a printing cylinder, a pressing member, an ink roll, a wringing member which faces the ink roll in a tightly adhering manner and forms an ink collecting area between the wringing member and the ink roll, an ink circulation passage which supplies ink to the ink collecting area and recovers the ink, and an ink tank which communicates with the ink circulation passage and functions as a supply source and recovery source for the ink; and in the printing apparatus, ink in the ink collecting area is transferred to the printing cylinder via the ink roll and printed on sheets that pass between the printing cylinder and the pressing member; and the ink viscosity measuring device comprises:

a rotating body which is disposed inside the ink circulation passage so that the rotating body can freely rotate;

a magnetic field switching means which is disposed outside the ink circulation passage, magnetically coupled with the rotating body when an electric current passes through the switching means, and imparts rotation to the rotating body by way of switching of magnetic fields;

a load current value detection means which detects changes in a load current value that occurs upon changes in a viscosity of ink that contacts the rotating body when rotation is imparted to the rotating body by way of passing an electric current through the magnetic field switching means;

a memory means which stores the load current values that correspond to respective changes in the viscosity value of the ink; and a calculating means which compares respective load current values stored in the memory means with the load current value detected by the load current value detection means and calculates an ink viscosity value at a current point in time.

The present invention further provides an ink viscosity measuring device used in a printing apparatus that comprises: a printing cylinder, a pressing member, an ink roll, a wringing member which faces the ink roll in a tightly adhering manner and forms an ink collecting area between the wringing member and the ink roll, an ink circulation passage which supplies ink to the ink collecting area and recovers the ink, and an ink tank which communicates with the ink circulation passage and functions as a supply source and recovery source for the ink; and in the printing apparatus, ink in the ink collecting area is transferred to the printing cylinder via the ink roll and printed on sheets that pass between the printing cylinder and the pressing member; and the viscosity measuring device comprises:

a rotating body which is disposed inside the ink circulation passage so that the rotating body can freely rotate;

an electric current direction switching means which is disposed outside the ink circulation passage, magnetically coupled with the rotating body when an electric current passes through the switching means, and imparts rotation to the rotating body by periodically switching a direction of the electric current;

a load current value detection means which detects changes in a load current value that occurs upon changes in a viscosity of ink that contacts the rotating body when rotation is imparted to the rotating body by way of passing an electric current through the electric current direction switching means;

a memory means which stores the load current values that correspond to respective changes in the viscosity value of the ink, and a calculating means which compares respective load current values stored in the memory means with the load current value detected by the load current value detection means and calculates an ink viscosity value at a current point in time.

In addition, the present invention provides an ink viscosity measuring device for a printing apparatus that comprises: a printing cylinder, a pressing member, an ink roll, a wringing member which faces the ink roll in a tightly adhering manner and forms an ink collecting area between the wringing member and the ink roll, an ink circulation passage which supplies ink to the ink collecting area and recovers the ink, and an ink tank which communicates with the ink circulation passage and functions as a supply source and recovery source for the ink; and in the printing apparatus, ink in the ink collecting area is transferred to the printing cylinder via the ink roll and printed on sheets that pass between the printing cylinder and the pressing member, wherein the ink viscosity measuring device comprises:

a rotating body made of an electrical conductor and disposed inside the ink circulation passage so that the rotating body can freely rotate;

an induced current generating circuit which is disposed outside the ink circulation passage, generates a rotating magnetic field when an electric current passes through the induced current generating circuit, and imparts rotation to the rotating body by generating an induced current in the rotating body by means of the rotating magnetic field;

a load current value detection means which detects changes in a load current value that occurs upon changes in a viscosity of ink that contacts the rotating body when rotation is imparted to the rotating body by passing an electric current through the induced current generating circuit;

a memory means which stores the load current values that correspond to respective changes in the viscosity value of the ink, and a calculating means which compares respective load current values stored in the memory means with the load current value detected by the load current value detection means and calculates an ink viscosity value at a current point in time.

The present invention further provides a printing apparatus that comprises: a printing cylinder, a pressing member, an ink roll, a wringing member which faces the ink roll in a tightly adhering manner and forms an ink collecting area between the wringing member and the ink roll, an ink circulation passage which supplies ink to the ink collecting area and recovers the ink, and an ink tank which communicates with the ink circulation passage and functions as a supply source and recovery source for the ink; and in the printing apparatus, ink in the ink collecting area is transferred to the printing cylinder via the ink roll and printed on sheets that pass between the printing cylinder and the pressing member; and the printing apparatus includes:

a rotating body which is disposed inside the ink circulation passage so that the rotating body can freely rotate;

an electric current direction switching means which is disposed outside the ink circulation passage, magnetically coupled with the rotating body when an electric current passes through the switching means, and imparts rotation to the rotating body by periodically switching a direction of the electric current;

a load current value detection means which detects changes in a load current value that occurs upon changes in a viscosity of ink that contacts the rotating body when rotation is imparted to the rotating body by way of passing an electric current through the electric current direction switching means;

a memory means which stores the load current values that correspond to respective changes in the viscosity value of the ink, and a calculating means which compares respective load current values stored in the memory means with the load current value detected by the load current value detection means and calculates an ink viscosity value at a current point in time.

In addition, the present invention provides a printing apparatus that comprises: a printing cylinder, a pressing member, an ink roll, a wringing member which faces the ink roll in a tightly adhering manner and forms an ink collecting area between the wringing member and the ink roll, an ink circulation passage which supplies ink to the ink collecting area and recovers the ink, and an ink tank which communicates with the ink circulation passage and functions as a supply source and recovery source for the ink; and in the printing apparatus, ink in the ink collecting area is transferred to the printing cylinder via the ink roll and printed on sheets that pass between the printing cylinder and the pressing member, wherein the printing apparatus includes:

a rotating body made of an electrical conductor and disposed inside the ink circulation passage so that the rotating body can freely rotate;

an induced current generating circuit which is disposed outside the ink circulation passage, generates a rotating magnetic field when an electric current passes through the induced current generating circuit, and imparts rotation to the rotating body by generating an induced current in the rotating body by means of the rotating magnetic field;

a load current value detection means which detects changes in a load current value that occurs upon changes in a viscosity of ink that contacts the rotating body when rotation is imparted to the rotating body by passing an electric current through the induced current generating circuit;

a memory means which stores the load current values that correspond to respective changes in the viscosity value of the ink; and a calculating means which compares respective load current values stored in the memory means with the load current value detected by the load current value detection means and calculates an ink viscosity value at a current point in time.

In order to solve the above-described problems and achieve the object, the present invention provides an ink viscosity adjusting method for a printing apparatus an ink viscosity adjusting method used in a printing apparatus that comprises: a printing cylinder, a pressing member, an ink roll, a wringing member which faces the ink roll in a tightly adhering manner and forms an ink collecting area between the wringing member and the ink roll, an ink circulation passage which supplies ink to the ink collecting area and recovers the ink, and an ink tank which communicates with the ink circulation passage and functions as a supply source and recovery source for the ink; and in the printing apparatus, ink in the ink collecting area is transferred to the printing cylinder via the ink roll and printed on sheets that pass between the printing cylinder and the pressing member, wherein the ink viscosity adjusting method comprises the steps of:

calculating a total amount of ink is by determining respective amounts of ink currently present in the ink collecting area, ink circulation passage and ink tank;

measuring a viscosity value of the ink flowing through the ink circulation passage;

comparing a measured ink viscosity value with previously prepared ink viscosity variation curves obtained for respective viscosity values, thus selecting a most appropriate ink viscosity variation curve;

calculating a proportion of an amount of added liquid that is necessary in order to obtain a target viscosity value from a selected ink viscosity variation curve; and adjusting the ink viscosity value to the target value by supplying a calculated amount of added liquid to the ink.

Furthermore, the present invention provides an ink viscosity adjusting method used in a printing apparatus that comprises: a printing cylinder, a pressing member, an ink roll, a wringing member which faces the ink roll in a tightly adhering manner and forms an ink collecting area between the wringing member and the ink roll, an ink circulation passage which supplies ink to the ink collecting area and recovers the ink, and an ink tank which communicates with the ink circulation passage and functions as a supply source and recovery source for the ink; and in the printing apparatus, ink in the ink collecting area is transferred to the printing cylinder via the ink roll and printed on sheets that pass between the printing cylinder and the pressing member; and the ink viscosity adjusting method comprises the steps of:

comparing a measured viscosity value of ink flowing through the ink circulation passage with previously prepared ink viscosity variation curves obtained for respective viscosity values, thus selecting a most appropriate ink viscosity variation curve;

experimentally varying a viscosity value of the ink by way of supplying a known amount of added liquid to ink after the selection of the ink viscosity variation curve;

measuring again the experimentally varied ink viscosity value, then calculating a supply ratio of the known amount of added liquid from the selected ink viscosity variation curve;

calculating a total amount of ink with respect to the calculated supply ratio of the known amount of added liquid;

re-calculating the supply ratio of the added liquid with respect to the total amount of ink required in order to obtain a target viscosity value from the selected ink viscosity variation curve; and adjusting the viscosity value of the ink to the target value by way of supplying the calculated amount of added liquid to the ink.

In order to solve the above-described problems and achieve the object, the present invention further provides a printing apparatus that comprises: a printing cylinder, a pressing member, an ink roll, a wringing member which faces the ink roll in a tightly adhering manner and forms an ink collecting area between the wringing member and the ink roll, an ink circulation passage which supplies ink to the ink collecting area and recovers the ink, and an ink tank which communicates with the ink circulation passage and functions as a supply source and recovery source for the ink; and in the printing apparatus, ink in the ink collecting area is transferred to the printing cylinder via the ink roll and printed on sheets that pass between the printing cylinder and the pressing member, wherein the printing apparatus includes:

rotating bodies which are disposed inside the ink circulation passage so that the rotating bodies can freely rotate;

electrical rotation-imparting means which are disposed outside the ink circulation passage, magnetically coupled to the rotating bodies, and impart rotation to the rotating bodies;

a load current value detection means which detects changes in a load current value that occurs upon changes in a viscosity of ink that contacts the rotating bodies when rotation is imparted to the rotating bodies by passing an electric current through the rotation-imparting means;

a memory means which stores:

the load current values that correspond to respective changes in the ink viscosity value, information concerning ink viscosity variation curves obtained for respective ink viscosity values, and standard viscosity values concerning an upper-limit value and a lower-limit value for the ink;

a calculating means which compares respective load current values stored in the memory means with the load current value detected by the load current value detection means and calculates an ink viscosity value at a current point in time, the calculating means further performing a calculation comparing the ink viscosity value thus obtained with the upper-limit value and lower-limit value for the ink stored in the memory means and then outputting a command to supply the added liquid;

ink amount detection means which detect respective amounts of ink present in the ink collecting area, ink circulation passage and ink tank and calculate a total amount of ink based upon detection results; and an ink viscosity control means that:

receives an added liquid supply command from the calculating means, selects a specified ink viscosity variation curve by way of comparing, by the calculating means, information concerning ink viscosity variation curves obtained for respective viscosity values that is stored in the memory means with a current ink viscosity value, calculates a supply ratio of the added liquid that is necessary to obtain a target viscosity value from the selected viscosity variation curve, and sends a command to added-liquid supply sections to supply necessary amount of added liquid to the ink in accordance with results of the calculation.

Furthermore, the present invention provides a printing apparatus that comprises: a printing cylinder, a pressing member, an ink roll, a wringing member which faces the ink roll in a tightly adhering manner and forms an ink collecting area between the wringing member and the ink roll, an ink circulation passage which supplies ink to the ink collecting area and recovers the ink, and an ink tank which communicates with the ink circulation passage and functions as a supply source and recovery source for the ink; and in the printing apparatus, ink in the ink collecting area is transferred to the printing cylinder via the ink roll and printed on sheets that pass between the printing cylinder and the pressing member; and the printing apparatus includes:

rotating bodies which are disposed inside the ink circulation passage so that the rotating bodies can freely rotate;

electrical rotation-imparting means which are disposed outside the ink circulation passage, magnetically coupled to the rotating bodies, and impart rotation to the rotating bodies;

a load current value detection means which detects changes in a load current value that occurs upon changes in a viscosity of ink that contacts the rotating bodies when rotation is imparted to the rotating bodies by way of passing an electric current through the rotation imparting means;

a memory means which stores:

the load current values that correspond to respective changes in an ink viscosity value, and information concerning ink viscosity variation curves obtained for respective viscosity values;

a calculating means which compares respective load current values stored in the memory means with a load current value detected by the load current value detection means and calculates the ink viscosity value at a current point in time, compares ink viscosity value thus obtained with information concerning ink viscosity variation curves that is stored in the memory means, and selects a most appropriate ink viscosity variation curve from the curves; and an ink viscosity control means which receives an added liquid supply command from the calculating means, sends a command to added-liquid supply sections to supply a known amount of an added liquid to ink so that a viscosity of the ink is experimentally varied, then causes a supply ratio of the known amount of added liquid to be calculated by the calculating means from the selected ink viscosity variation curve by remeasuring the ink viscosity value, causes a total amount of ink to be calculated with respect to a calculated supply ratio of the known amount of added liquid, and sends a command to the added-liquid supply sections to supply necessary amount of added liquid to the ink in accordance with results of the calculation;

wherein the supply ratio of the added liquid relative to the total amount of ink that is required in order to obtain the a target viscosity value is re-calculated by the calculating means from the selected ink viscosity variation curve, and a viscosity value of the ink is adjusted to the target value by supplying the calculated amount of added liquid to the ink via the added liquid supply sections.

In order to solve the above-described problems and achieve the object, the present invention provides a printing apparatus comprising a printing plate drum and a pressing drum that is disposed so as to face the printing plate drum, wherein cardboard sheets are passed between the printing plate drum and pressing drum which rotate in mutually opposite directions, thus causing specified printing to be performed on the sheets; and the printing apparatus further comprises:

an ink transfer roll which rotates in contact with a printing plate of the printing plate roll at a time of printing;

an adjustment means which makes contact with the ink transfer roll during printing and adjusts an amount of ink by wringing;

a pair of regulating members which are disposed at both ends of the ink transfer roll and adjustment means with respect to an axial direction thereof and are used to demarcate an ink collecting area between the ink transfer roll and the adjustment means;

an ink supply source which is disposed near an upper end of the ink collecting area, a specified amount of ink being stored in the ink supply source;

a first tubular body and second tubular body, opening part of one of the first tubular body and second tubular body is inserted into the ink supply source, and an opening part of another of the first tubular body and second tubular body is caused to face the ink collecting area, an ink feeding pumps being respectively connected to the first tubular body and second tubular body, and an ink viscosity measuring instrument installed in the first tubular body so as to measure a viscosity variation of ink that is supplied to the ink collecting area that is demarcated between the ink transfer roll and adjustment means, the ink viscosity measuring instrument being comprised of:

a rotating body which is disposed inside the first tubular body so that the rotating body can freely rotate;

an electrical rotation-imparting means which is disposed outside the first tubular body, magnetically coupled to the rotating body, and imparts rotation to the rotating body;

a load current value detection means which detects changes in a load current value that accompany changes in a viscosity of ink that contacts the rotating body when rotation is imparted to the rotating body by passing an electric current through the rotation-imparting means;

a memory means which stores the load current values that correspond to respective changes in a viscosity value of the ink; and a calculating means which compares respective load current values stored in the memory means with the load current value detected by the load current value detection means and calculates an ink viscosity value at a current point in time.

The measurement of ink viscosity by the present invention is accomplished in the manner described below. More specifically, ink drawn up from the ink tank by means of an ink pump in the ink passages enters an ink viscosity measuring instrument via the ink supply passage. A driving device installed in the ink viscosity measuring instrument is driven by a command from a driving device control section, so that a first rotating body and second rotating body installed inside the ink viscosity measuring instrument are caused to rotate synchronously at a constant rotational speed. Then, the rotational driving load current value of the driving device that causes the first rotating body (which directly contacts the ink that is flowing through) to rotate is detected by a driving device control section 23. The result of this detection is converted into an ink viscosity value by a converter 24, and the value thus obtained is displayed by an ink viscosity display device, or a warning is issued by a warning device, etc.

Likewise, in a different measurement of ink viscosity, ink drawn up from the ink tank by means of an ink pump in the ink passages enters an ink viscosity measuring instrument via the ink supply passage. Furthermore, a rotating field circuit installed in the ink viscosity measuring instrument is started by a command from a field control device, so that a rotating body installed inside the ink viscosity measuring instrument is caused to rotate at a constant rotational speed. Then, the rotational driving load current value of the rotating field circuit that causes the rotating body (which directly contacts the ink that is flowing through) to rotate is detected by the driving device control section 23. The result of this detection is converted into an ink viscosity value by a converter 24, and the value thus obtained is displayed by an ink viscosity display device, or a warning is issued by a warning device, etc.

Furthermore, in cases where the results obtained from the ink viscosity measuring device indicate that the ink viscosity has changed, the addition or supply (hereafter referred to uniformly as "addition") of water (or another diluent liquid) or the ink stock liquid is performed by the operator in accordance with an ink viscosity automatic control device, or is performed by an automatic addition device using a device that adds water (or another diluent liquid) or the ink stock liquid, etc.

DETAILED DESCRIPTION OF THE INVENTION

Figure 1:
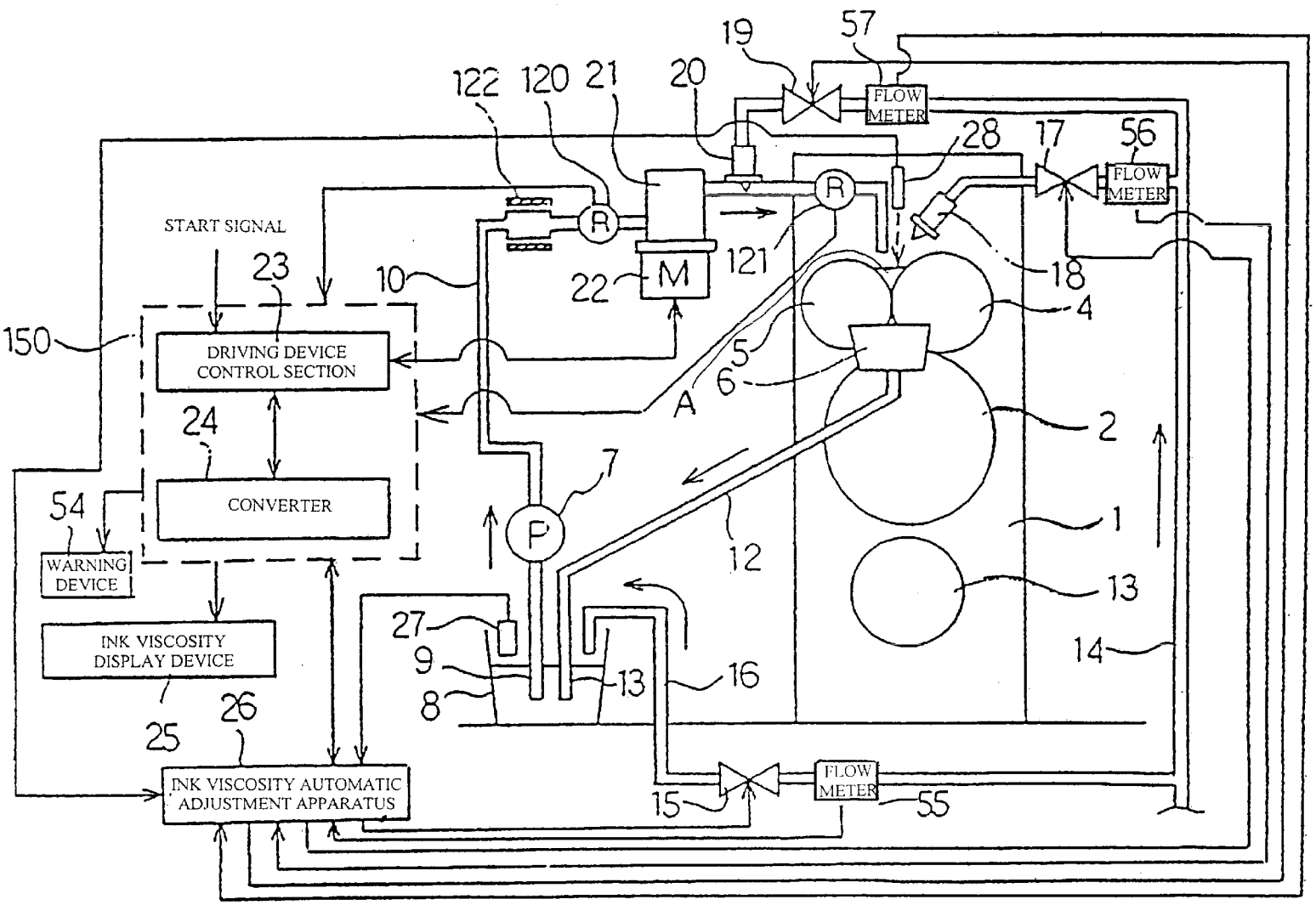
FIG. 1 is a schematic diagram of an apparatus which the ink viscosity measuring device and ink viscosity adjusting device of the present inventions are depicted.

The ink viscosity measuring device and ink viscosity adjusting device of the present invention will be described in terms of preferred embodiments with reference to the attached figures. FIG. 1 illustrates the overall construction and concept of the present invention. In the printing unit 1, the printing cylinder 2 around which a desired printing plate is wrapped, the pressing roll 3, the ink roll 4, the wringing roll 5, the ink collecting area A formed between the two rolls 4 and 5, the ink supply passage 10, the ink recovery passage 12 (including the ink pans 6), the ink pump 7 and the ink tank 8 are the same as in a conventional construction. Accordingly, a detailed description of these components is omitted. An ink viscosity measuring instrument 21 is installed in the ink supply passage 10 so as to be between the ink pump 7 and the ink collecting area A that is formed between the ink roll 4 and the wringing roll 5.

Figure 2A:
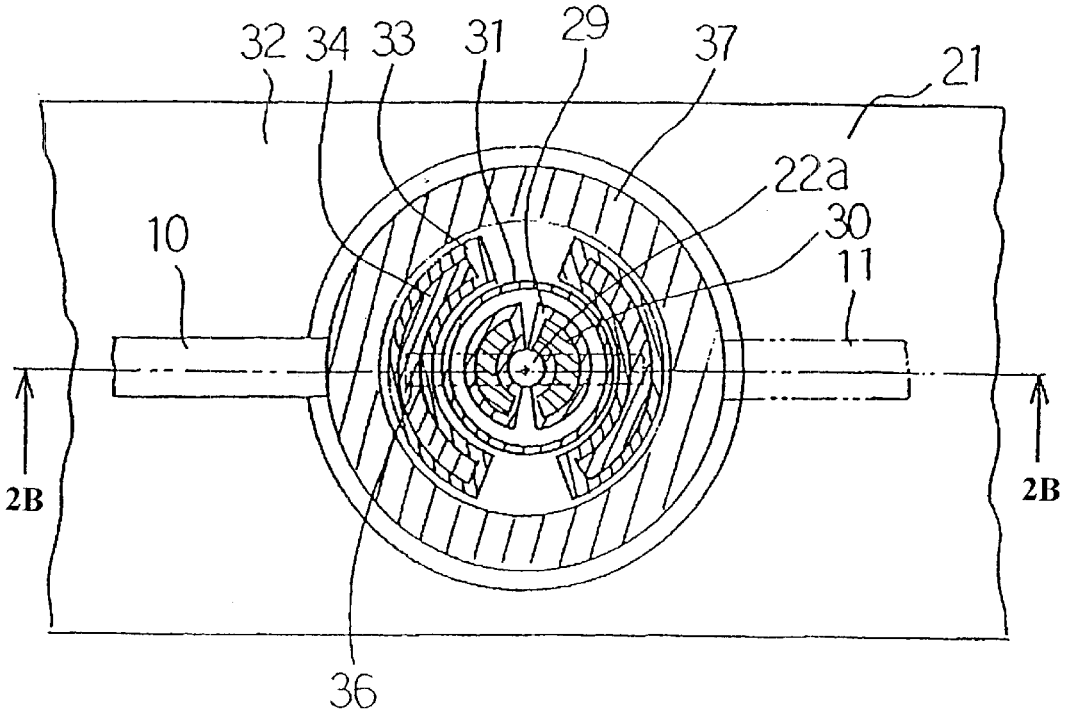
FIG. 2A is a horizontal cross-sectional view of the ink viscosity measuring instrument taken along the line A—A in FIG. 2B.
Figure 2B:
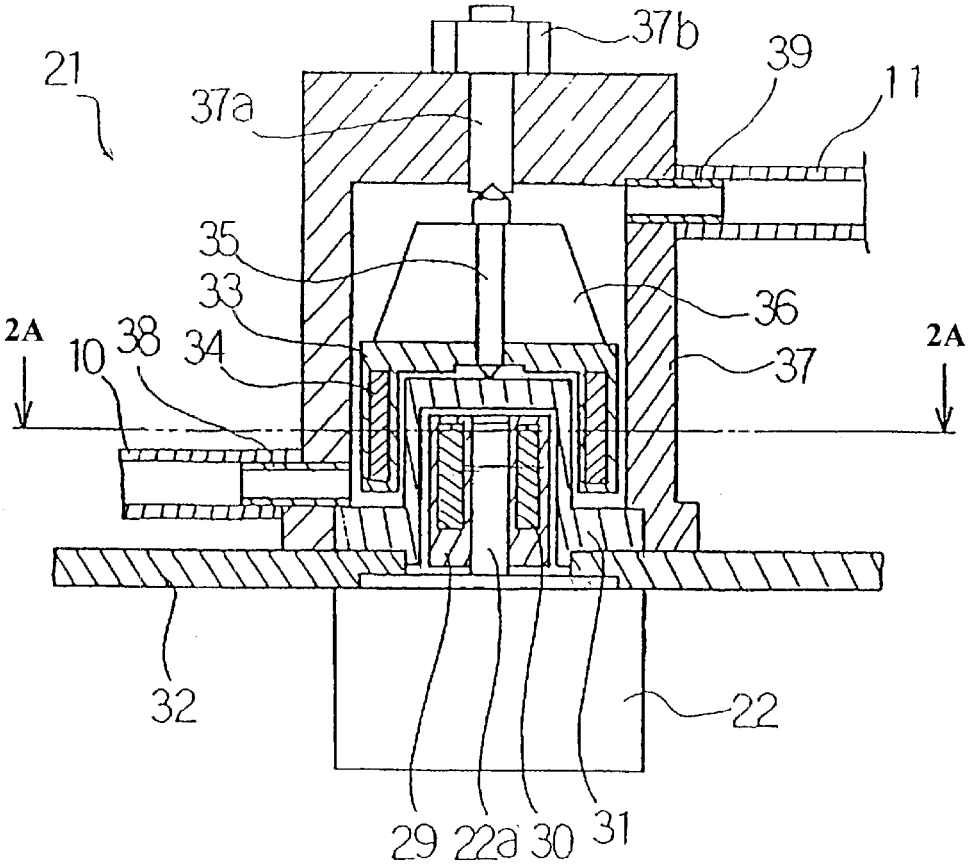
FIG. 2B is a vertical cross-section view of the ink viscosity measuring instrument taken along the line B—B in FIG. 2A.

FIG. 2 illustrates the ink viscosity measuring instrument 21. FIG. 2A is a sectional view of the ink viscosity measuring instrument 21 in the vertical direction (i.e., a sectional view taken along the line 2A in FIG. 2B), while FIG. 2B is a sectional view taken along the line 2B in FIG. 2A. The ink viscosity measuring instrument 21 comprises a first rotating body 33 which is disposed so that it is free to rotate inside the passage through which the ink flows, a second rotating body 29 which is installed outside the ink passage 10 and is disposed facing the first rotating body 33, and a driving device 22 which causes the second rotating body 29 to rotate so that the first rotating body 33 is caused to rotate at a desired rotational speed and is attached to a bracket 32. A small direct-current or alternating-current motor is generally used as the driving device 22. The second rotating body 29 in which second magnetic bodies 30 are embedded is attached to the drive shaft 22*a* of the driving device 22 so that the second rotating body 29 is free to rotate. Furthermore, an inner covering body 31 is attached to the bracket 32 between the facing first rotating body 33 and second rotating body 29 so that the inner covering body 31 covers the second rotating body 29. The first rotating body 33 in which first magnetic bodies 34 are embedded is disposed so that it is free to rotate on a vertical axial line that is concentric with the second rotating body 29 inside the inner covering body 31 in a position facing the second rotating body 29 with the inner covering body 31 interposed between the first rotating body 33 and second rotating body 29. The details of the first magnetic bodies 34 and second magnetic bodies 30 will be described later. Further, an outer covering body 37 is attached to the bracket 32 so that this outer covering body 37 covers the first rotating body 33. The first rotating body 33 is attached to a freely rotating shaft 35 which is installed in the outer covering body 37 on a vertical axial line that is concentric with the drive shaft 22*a* of the driving device 22, and which is shaft-supported so that the shaft 35 is rotatable between the inner covering body 31 and a fixed shaft 37*a* that is fastened in place by means of a fastening element 37*b*. An ink injection port 38 into which ink that is drawn up from the ink tank 8 by the ink pump 7 via the ink supply passage 10 is fed is formed in the lower part of the outer covering body 37, and an ink discharge port 39 which communicates with ink supply port 11 that feeds ink out into the space between the ink roll 4 and the wringing roll 5 is formed in the upper part of the outer covering body 37. Specifically, in the ink viscosity measuring instrument 21 that is installed at an intermediate point in the ink passage, the ink is supplied from the bottom and discharged from the top. Accordingly, the first rotating body 33 which is installed between the inner covering body 31 and outer covering body 37 contacts the ink directly. However, the second rotating body 29 does not contact the ink, since this rotating body 29 is installed outside the inner covering body 31. Furthermore, the ink viscosity measuring instrument 21 can be detached at the positions of the ink injection port 38 of the ink supply passage 10 and the ink discharge port 39 of the ink supply port 11, so that this ink viscosity measuring instrument 21 can be removed for maintenance or in the case of trouble.

It is desirable that the outer covering body 37 be a transparent body so that the state of cleanness of the ink between the outer covering body 37 and inner covering body 31 and the rotation of the first rotating body 33 can be checked. Furthermore, resin type members consisting of a material with a smooth surface such as a nylon type material or epoxy type material, etc. are used for the second rotating body 29 and first rotating body 33. In particular, since the first rotating body 33 contacts the ink directly, it is desirable to use a material that is unaffected by the chemical action of the ink for this rotating body 33. Furthermore, in order to allow confirmation of the rotation of the first rotating body 33, this rotating body 33 may be colored with a color that is unaffected by the chemical action of the ink flowing through. Moreover, it is also advisable to form cut-out portions, etc. in the first rotating body 33 and second rotating body 29 so that the rotation of the respective rotating bodies can be confirmed. The first magnetic bodies 34 are coupled with the second magnetic bodies 30 by the action of magnetism in a non-contact state, with the inner covering body 31 interposed between the first magnetic bodies 34 and second magnetic bodies 30. Here, the term "coupling by the action of magnetism" refers to coupling based on, for instance, magnetic repulsion by like poles (like-pole repulsion) or magnetic attraction by unlike poles (unlike-pole attraction). In the present invention, either type of magnetic coupling may be used. In concrete terms, the first magnetic bodies 34 and second magnetic bodies 30 both generally consist of magnets. However, in cases where one set of magnetic bodies consists of magnets, the other set of magnetic bodies may also consist of a metal material that is magnetized by magnets, such as an alloy containing iron, nickel or cobalt, etc. A material that allows magnetism to pass through but is not magnetized itself is selected as the material of the inner covering body 31. Accordingly, the following relationship is established: namely, the second rotating body 29 which has the second magnetic bodies 30 is caused to rotate by the rotation of the drive shaft 22*a* of the driving device 22, and when the second magnetic bodies 30 rotate, the first rotating body 33 which has the first magnetic bodies 34 that are magnetically coupled with the second magnetic bodies 30 rotates in synchronization with the second rotating body 29. Furthermore, the first rotating body 33 and second rotating body 29 are magnetically coupled so that these rotating bodies rotate in synchronization with each other. This is not a system in which the magnetic coupling of the first rotating body 33 and second rotating body 29 is disengaged as a result of the first rotating body 33 being subjected to resistance from the ink in contact with the rotating body 33 that occurs upon changes in the viscosity of the ink (described later), so that synchronous rotation becomes impossible. Specifically, during the measurement of ink viscosity, the first rotating body 33 and second rotating body 29 must always be magnetically coupled and rotating in synchronization with each other (details of this will be described later). Furthermore, as long as a positional relationship which is such that the first rotating body 33 rotates in synchronization with the second rotating body 29 is established as a result of the first magnetic bodies 34 and second magnetic bodies 30 being magnetically coupled, it is not absolutely necessary that the rotational axes of the first rotating body 33 and second rotating body 29 coincide.

Furthermore, in the present embodiment, the respective magnetic bodies 30 and 34 are disposed inside the respective rotating bodies 29 and 33. However, it is also possible to use a construction in which the second magnetic bodies 30 are attached directly to the drive shaft 22*a* of the driving device 22 and caused to rotate. Furthermore, if the first magnetic bodies 34 themselves are bodies that are not affected by the chemical action of the ink flowing through, it is also possible to use a construction in which the first magnetic bodies 34 are attached directly to the freely rotating shaft 35. Moreover, it is sufficient if the first rotating body 33 has a shape which is such that the first rotating body 33 is subjected to viscosity resistance of the ink when the first rotating body 33 itself comes into direct contact with the ink during the rotation of the first rotating body 33.

The flow-regulating vanes 36 disclosed in FIG. 2 perform an action which maintains the eddy currents of the ink (that are generated when the first rotating body 33 is caused to rotate at a fixed speed or greater) in a stable shape even if the viscosity changes. These vanes 36 are attached to the upper part of the first rotating body 33. The shape of the flow-regulating vanes 36 is not limited to the flat-plate shape shown in FIG. 2. These vanes may have any shape that stabilizes the ink eddy currents against changes in viscosity.

Next, the construction that controls the rotation of the driving device 22 of the ink viscosity measuring instrument 21 and the device and construction that perform operational processing of the measured values measured by the ink viscosity measuring instrument 21 will be described. As shown in FIG. 1, the main control section of the ink viscosity measuring device of the present invention consists of a control section 150 that includes a driving device control section 23 and a converter 24. The converter 24 comprises a memory section 151 and a calculating section 152. The memory section 151 stores various types of data and control sections. The calculating section 152 compares required data extracted from the memory section 151 with rotational driving load current values from the driving device control section 23 and detection data from the flow meters 120 and 121, etc. and converts the data into ink viscosity values. Furthermore, the converter 24 also sends commands to the ink viscosity display device 25, warning device 54 and ink viscosity automatic control device 26 on the basis of the operationally processed information. Furthermore, a selective information input section (not shown) for information such as identification of ink makers, ink colors and meteorological conditions such as air temperature and humidity, etc. is installed in the control section 150. In accordance with direct input or selective commands from the operator, or input based on communications from a control room, etc., the control section 150 causes ink to flow through the ink viscosity measuring instrument 21, and inputs and processes the various types of detected information described above after previously obtaining the characteristics of the ink whose viscosity is to be detected, and external factors, as advance information.

The driving device control section 23 positioned inside the control section 150 powers the driving device 22 and thus causes the second rotating body 29 of the ink viscosity measuring instrument 21 to rotate. The driving device 22 is controlled by commands from the driving device control section 23 so that the second rotating body 29 constantly rotates at a predetermined rotational speed. Specifically, a command from the driving device control section 23 is sent to the driving device 22 so that the second rotating body 29 is caused to rotate, and the second magnetic bodies 30 installed inside the second rotating body 29 rotate so that the first magnetic bodies 34 that are magnetically coupled with the second magnetic bodies 30, and therefore the first rotating body 33, rotate in synchronization with the second rotating body 29. Meanwhile, ink is caused to flow through the space formed between the outer covering body 37 and inner covering body 31 so that the ink and first rotating body 33 come into direct contact with each other. Then, in this case, the first rotating body 33 rotates while contacting the ink. However, the driving device control section 23 sends a command to the driving device 22 so that the first rotating body 33 is caused to rotate in synchronization as a result of magnetic coupling with the second rotating body 29, and the driving device load current value that is received by the driving device control section 23 in this case is obtained. As described above, the rotational speed of the driving device 22 is controlled by the driving device control section 23. The rotational speed is controlled so that this rotational speed is always a constant value. In this case, the rotational speed of the first rotating body 33 is not varied according to changes in the ink viscosity. Instead, the driving device control section 23 performs a control action so that the rotational speed is always maintained at a constant value (details will be described later). Furthermore, the rotational speed may be a single rotational speed, or the rotational speed may be selected in accordance with the characteristics of the ink or mechanical deterioration (described later). However, once rotation at the selected rotational speed has begun and the measurement of the ink viscosity has been initiated, the system is controlled so that this rotational speed is constantly maintained during the measurement of the ink viscosity. Furthermore, the units of the rotational driving load current value obtained here may be amperes (A), milliamperes (mA) or microamperes ($\mu$A), etc.

Figure 3:
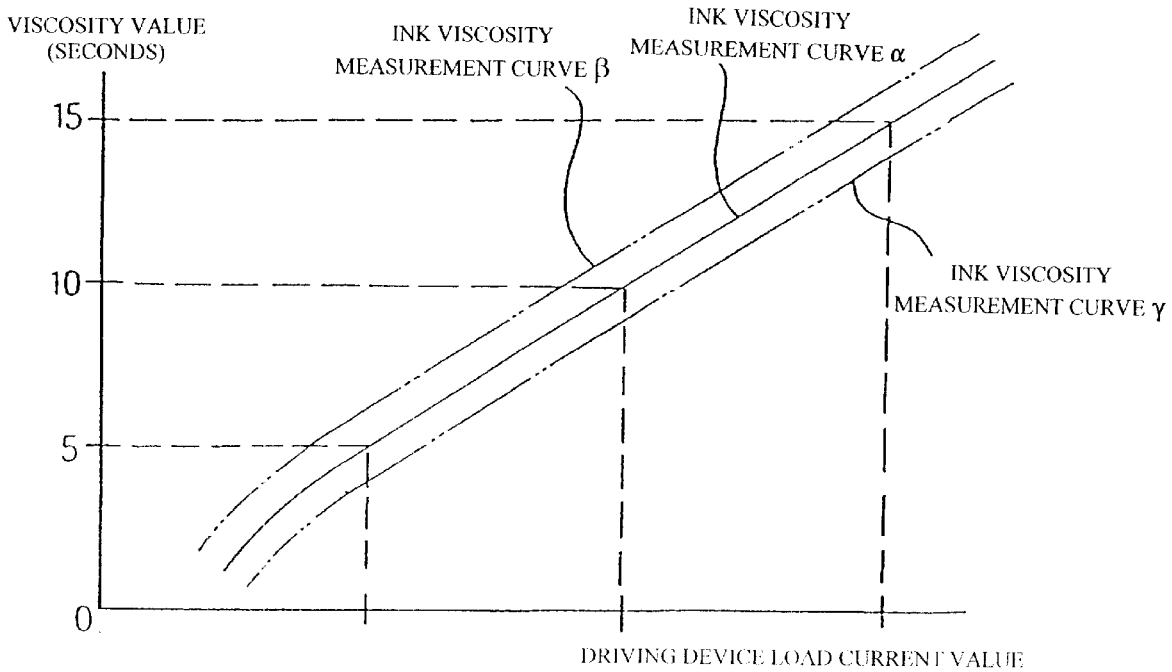
FIG. 3 is a conversion diagram for converting the rotational driving load current value obtained by the ink viscosity measuring instrument into an ink viscosity value.

The driving device control section 23 sends the detected rotational driving load current value to the calculating section 152 of the converter 24 which converts the current value into an ink viscosity value. Ink viscosity values used for the conversion of the rotational driving load current values obtained by the driving device control section 23 into ink viscosity values, as well as standard ink viscosity values for the characteristics of the ink involved, and upper-limit and lower-limit values for these standard ink viscosity values, are preset in the memory section 151 of the converter 24. In concrete terms, the rotational driving load current values and ink viscosity values are in a fixed relationship as shown in FIG. 3. In FIG. 3, the rotational driving load current value detected by the driving device control section 23 is shown on the horizontal axis, and actual ink viscosity values measured by means of a Zahn cup 53 are shown on the vertical axis. The ink viscosity characteristic curves shown in this FIG. 3 are stored in the memory section 151. For example, respective ink viscosity measurement curves $\alpha$, $\beta$ and $\gamma$, etc. that correspond to ink characteristics are shown in FIG. 3. After a curve is selected from the ink viscosity measurement curves $\alpha$, $\beta$, and $\gamma$, etc. that correspond to the respective ink characteristics, the rotational driving load current value detected by the driving device control section 23 is placed on the horizontal axis of FIG. 3, and is converted to the ink viscosity value on the vertical axis where this measured value coincides with the selected ink viscosity measurement curve $\alpha$, $\beta$, or $\gamma$, etc. Since the ink viscosity values in this case are ink dropping times empirically measured for ink samples by means of a Zahn cup, the ink viscosity measured by the ink viscosity measuring instrument 21 can be ascertained from the rotational driving load current value detected by the driving device control section 23. Specifically, the rotational driving load applied to the driving device 22 that causes synchronous rotation of the first rotating body 33 that is magnetically coupled with the second rotating body 29 is detected by the driving device control section 23 as a rotational driving load current value, and the rotational driving load current value obtained by the driving device control section 23 is sent to the calculating section 152 of the converter 24, which converts this value into an ink viscosity value. Since the first rotating body 33 contacts the ink directly, the surface of the first rotating body 33 constantly rotates while being subjected to resistance from the viscosity of the ink. Accordingly, the driving device control section 23 detects the rotational driving load current value, which contains a load component attributable to the viscosity load of the ink received by the first rotating body 33, and a mechanical load component. These loads are converted into an ink viscosity value by the converter 24. In the use of the ink viscosity measuring device of the present invention, the ink viscosity measurement curves $\alpha$, $\beta$ and $\gamma$, etc. which have been corrected beforehand for the measured mechanical load component of the ink viscosity measuring instrument 21 (described later) are selected in the memory of the converter 24, and the selected ink viscosity measurement curve $\alpha$, $\beta$ or $\gamma$, etc. that is required in order to make a conversion to an ink viscosity value is extracted from the memory section 151 and compared by the calculating section 152 with the rotational driving load current value obtained by the driving device control section 23, so that this load current value is converted into an ink viscosity value. By thus causing the first rotating body 33 to rotate in a state in which the mechanical load component has been measured beforehand, and in which a correction has been made for this component prior to the measurement of the ink viscosity, it is possible to insure that the rotational driving load current value detected by the driving device control section 23 consists only of the viscosity load of the ink flowing through the ink viscosity measuring instrument 21, so that this value is obtained as the ink viscosity value by the calculating section 152 in the converter 24. Furthermore, the mechanical load will be described in greater detail later. In concrete terms, the measurement results for the measured ink viscosity are that if the viscosity of the ink rises, the rotational load of the first rotating body 33 increases, so that the load current value of the driving device 22 also increases. On the other hand, if the viscosity of the ink drops, the rotational load of the first rotating body 33 decreases, so that the load current value of the driving device 22 also decreases.

Furthermore, standard ink viscosity values that correspond to the characteristics of respective inks, and the upper-limit and lower-limit values for these standard values, are preset in the memory section 151, and comparative calculations are also performed by the calculating section 152 in order to ascertain whether or not the ink viscosity values obtained with the conversion into ink viscosity values are within the ranges of the standard ink viscosity values for respective ink characteristics and upper-limit and lower-limit values for the standard ink viscosity values. In cases where the measured values converted into ink viscosity values are within the ranges of these standard ink viscosity values for the ink characteristics and upper-limit and lower-limit values for the standard ink viscosity values, the measured ink viscosity values are judged to be normal ink viscosity values. However, in cases where the measured values converted into ink viscosity values are outside the ranges of these standard ink viscosity values for the ink characteristics and upper-limit and lower-limit values for the standard ink viscosity values, these measured ink viscosity values are judged to be abnormal ink viscosity value. Furthermore, in cases where the ink viscosity values obtained the calculation and conversion into ink viscosity values performed by the calculating section 152 are judged to be abnormal ink viscosity values, the calculating section 152 sends a command to, for instance, the warning device 54, and the warning device 54 informs the operator of the abnormality by means of a sound, musical tone or light, etc. Alternatively, the measured ink viscosity value itself is displayed by the ink viscosity display device 25 (such as a liquid crystal display, etc.), or "abnormality" is displayed by the ink viscosity display device 25.

As described above, the rotational driving load current value detected by the driving device control section 23 is converted into an ink viscosity value by calculations performed by the converter 24. Then, the value obtained by this conversion into an ink viscosity value is sent to the ink viscosity display device 25, and the ink viscosity measuring instrument 21 displays the ink viscosity value. The operator can confirm the ink viscosity from his seat by means of this ink viscosity display device 25. Furthermore, in cases where the measured ink viscosity value is abnormal, the operator is informed of this by the warning device 54 as described above. Then, the operator may adjust the ink viscosity as necessary in accordance with the value shown by the ink viscosity display device 25, or may further adjust the viscosity of the ink by means of an ink viscosity adjusting device (described later)

Next, the flow rate of the ink flowing through the ink viscosity measuring instrument 21 will be described. It is desirable that the amount of ink flowing through the ink viscosity measuring instrument 21 always be a fixed amount of ink based on an optimal flow-through amount that has an upper limit and lower limit. Accordingly, as shown in FIG. 1, flow meters 120 and 121 are installed on the upstream side and downstream side of the ink viscosity measuring instrument 21, and the optimal flow-through amount for the ink flowing through the ink viscosity measuring instrument 21, and the upper-limit and lower-limit values for this optimal flow-through amount, are set in the memory section 151 inside the converter 24 of the control section 150. It is desirable that flow meters be installed on both the upstream and downstream sides of the ink viscosity measuring instrument 21, or that a single flow meter be installed on either the upstream or downstream side of the ink viscosity measuring instrument 21. Specifically, if a constant amount of ink is always flowing through the interior of the ink viscosity measuring instrument 21, the ink contacts the first rotating body 33 overall, and the first rotating body 33 is subjected to rotational resistance caused by the viscosity of the ink. In order to perform a stable measurement of the ink viscosity, it is necessary that ink be caused to flow through the ink viscosity measuring instrument 21 so that the interior of the ink viscosity measuring instrument 21 is more or less completely filled with ink, thus creating a state in which the first rotating body 33 overall is constantly in contact with the ink. More specifically, in a state in which the interior of the ink viscosity measuring instrument 21 is not completely filled with ink, the first rotating body 33 cannot properly receive the resistance of the ink. In such cases, the rotational driving load current value that causes the first rotating body 33 to rotate decreases, and as a result, the measured value of the ink viscosity is the same as that obtained in a state in which the viscosity of the ink has dropped. However, the accurate ink viscosity is not measured in this case. Conversely, if ink is fed into the interior of the ink viscosity measuring instrument at a flow rate that is greater than the fixed flow rate, the first rotating body 33 will be subjected to a stress that cannot be ignored as a result of this increased ink flow rate. In such cases, the rotational driving load current value that causes the first rotating body 33 to rotate will be larger or smaller than the normal value, so that the measured value of the ink viscosity is not the correct ink viscosity value.

In order to prevent ink viscosity measurements in the abnormal states, flow meters 120 and 121 are installed on the upstream side and downstream side of the ink viscosity measuring instrument 21, or a single flow meter is installed on either the upstream side or downstream side of the ink viscosity measuring instrument 21. The amount of ink flowing through the ink viscosity measuring instrument 21 is measured by the flow meters 120 and 121, and the measurement results are sent to the calculating section 152 inside the converter 24 of the control section 150. The optimal flow rate for the ink flowing through the ink viscosity measuring instrument 21 is set in the memory section 151 inside the converter 24 of the control section 150 along with the upper-limit and lower-limit values for this optimal flow rate. The flow meters 120 and 121 continuously measure the flow rate of the ink flowing through the ink viscosity measuring instrument 21, and transmit the measurement results to the calculating section 152. The calculating section 152 extracts the optimal flow rate data including the upper-limit value and lower-limit value for the ink flowing through the ink viscosity measuring instrument 21 from the memory section 151, and continuously compares this data with the measurement results transmitted from the flow meters 120 and 121. In cases where the measurement results continuously transmitted from the flow meters 120 and 120 exceed the upper-limit value or fall below the lower-limit value for the set optimal flow rate, the measurement results are judged to be abnormal, and the operator is informed by the warning device 54. In order to indicate that the ink viscosity value obtained in this case is invalid, the display of the ink viscosity display device 25 that displays the ink viscosity value is stopped, or a display indicating an abnormality is displayed by the ink viscosity display device 25. In this case, the operator may be informed of measurement results exceeding the upper-limit value or falling below the lower-limit value for the set optimal flow rate by the warning device 54 using a discriminating means such as a sound, musical tone or light, etc. Alternatively, the ink flow rate may be directly displayed by the ink viscosity display device 25 (such as a liquid crystal display, etc.). In this way, the operator can confirm the abnormality of the flow rate of the ink flowing through the ink viscosity measuring instrument 21, and can take steps to avoid this abnormal state.

Furthermore, in addition to the above-described optimal flow rate values including the upper-limit and lower-limit values for the flow rate of the ink flowing through the ink viscosity measuring instrument 21 (used in order to allow the ink viscosity measuring instrument 21 to perform stable ink viscosity measurements) being set in the memory section 151, and in addition to comparative calculations and various types of displays or warnings being performed by the calculating section 152, the flow meters 120 and 121 detect the lower-limit value of the ink flow rate that indicates whether or not ink is flowing through the ink passage 10 in absolute terms. Specifically, the lower-limit value of the flow rate of the ink that flows through the ink passage 10 is set in the memory section 151 of the converter 24 of the control section 150, and the flow meters 120 and 121 constantly measure the flow rate of the ink through the ink passage 10 and send the measurement results to the calculating section 152 of the converter 24 of the control section 150. In the control section 150, the calculating section 152 of the converter 24 extracts the lower-limit value of the ink flow rate from the memory section 151, and compares this lower-limit value with the measurement results sent from the flow meters 120 and 121. In cases where the measurement results continuously transmitted from the flow meters 120 and 121 fall below the set lower-limit value of the ink flow rate, it is judged that the ink inside the ink tank has been exhausted or is about to be exhausted, or that an abnormality such as clogging of the ink caused by foreign matter inside the ink passage 10 or trouble with the ink pump 7, etc. has occurred. Accordingly, the operator is informed of this by the warning device 54. Alternatively, in order to indicate that the ink viscosity value obtained in this case is invalid, the display of the ink viscosity display device 25 that displays the ink viscosity value may be stopped, or a display indicating an abnormality may be displayed by the ink viscosity display device 25. In this case, the operator may be informed of measurement results falling below the set lower-limit value of the ink flow rate by the warning device 54 using a discriminating means such as a sound, musical tone, light, etc., or the ink flow rate may be directly displayed by the ink viscosity display device 25. In this way, the operator can confirm the abnormality of the flow rate of the ink flowing through the ink viscosity measuring instrument 21, and can take steps to avoid this abnormal state.

Furthermore, in the above descriptions, the measurement results obtained by the flow meters 120 and 121 is processed by the control section 150, and a warning or display is performed on the basis of these measurement results. However, it is also possible simply to use a display performed by meters on the flow meters 120 and 121 themselves. In such a case, for example, the operator would periodically check the meters of the flow meters.

Next, the removal of foreign matter admixed with the ink will be described. Various types of foreign matter may become admixed with the ink that circulates through the interior of the printing apparatus 1. For example, powdered paper adhering to the cardboard sheets may become admixed with the ink from the ink roll 4 via the printing plate, and foreign matter such as powdered paper, dirt, etc. suspended in the air may become admixed with the ink via the ink tank 8 or via the ink collecting area between the ink roll 4 and the wringing roll 5. Furthermore, the ink roll 4 and wringing roll 5 contact each other with a considerable pressing force in order to transfer a fixed amount of ink to the printing plate via the ink roll 4. Accordingly, a frictional force is generated between the ink roll 4 and wringing roll 5. The surfaces of the ink roll 4 and wringing roll 5 are worn by the effect of this frictional force, although by only a slight amount. Since the ink roll 4 is generally a metal roll and the wringing roll 5 is usually a hard rubber roll, powdered metal and scraps of rubber are admixed with the ink as foreign matter in cases where the respective rolls are worn. Such foreign matter is generally removed by means of filters, etc. (not shown), which are installed in respective locations in the ink tank 8, ink pump 7 or ink passage 10. However, the complete removal of such foreign matter by means of filters is difficult, so that this foreign matter circulates through the printing apparatus 1 together with the circulating ink. Generally, such foreign matter has little effect on the operation of the printing apparatus or on the production of printing, etc. and can be virtually ignored. However, in the ink viscosity measuring device of the present invention, since magnetic bodies 34 consisting of magnets, etc. are installed in the ink viscosity measuring instrument 21 that is disposed in the ink passage 10, the powdered metal that cannot be removed by means of the filters, etc. and that is therefore admixed in the ink so that the powdered metal circulates together with the ink, may adhere to the surfaces of the first rotating body 33. Since the first rotating body 33 has magnetic bodies 34 consisting of magnets, etc., this first rotating body 33 tends to cause the magnetic adhesion of powdered metal that is admixed in the ink, and if such powdered metal adheres to the surfaces of the first rotating body 33, this powdered metal will not separate from the first rotating body 33.

If powdered metal thus adheres to the surfaces of the first rotating body 33, this powdered metal itself will constitute an excess rotation resistance load on the first rotating body 33. Under such conditions, the first rotating body 33 is not properly subjected to the resistance caused by the viscosity of the ink that is flowing through, so that the driving device control section 23 cannot correctly detect the rotational driving load current value of the driving device 22 which causes the rotation of the second rotating body 29 that causes the first rotating body 33 to rotate by magnetic coupling. Accordingly, if powdered metal adheres to the surfaces of the first rotating body 33, the operator must stop the operation of the printing apparatus, temporarily recover the ink in the ink tank 8, clean the interior of the ink circulation passage of the printing apparatus 1 including the ink viscosity measuring instrument 21, remove the ink viscosity measuring instrument 21 from the ink supply passage 10, remove the first rotating body 33 from the ink viscosity measuring instrument 21, and remove the powdered metal adhering to the first rotating body 33. Such work requires time, and is fatiguing and burdensome to the operator. Furthermore, since such work is performed after stopping the operation of the printing apparatus 1, recovering the ink and cleaning the apparatus, the work involves ink loss and the generation of an excessive amount of cleaning waste liquid, thus leading to a drop in productivity.

Figure 20:
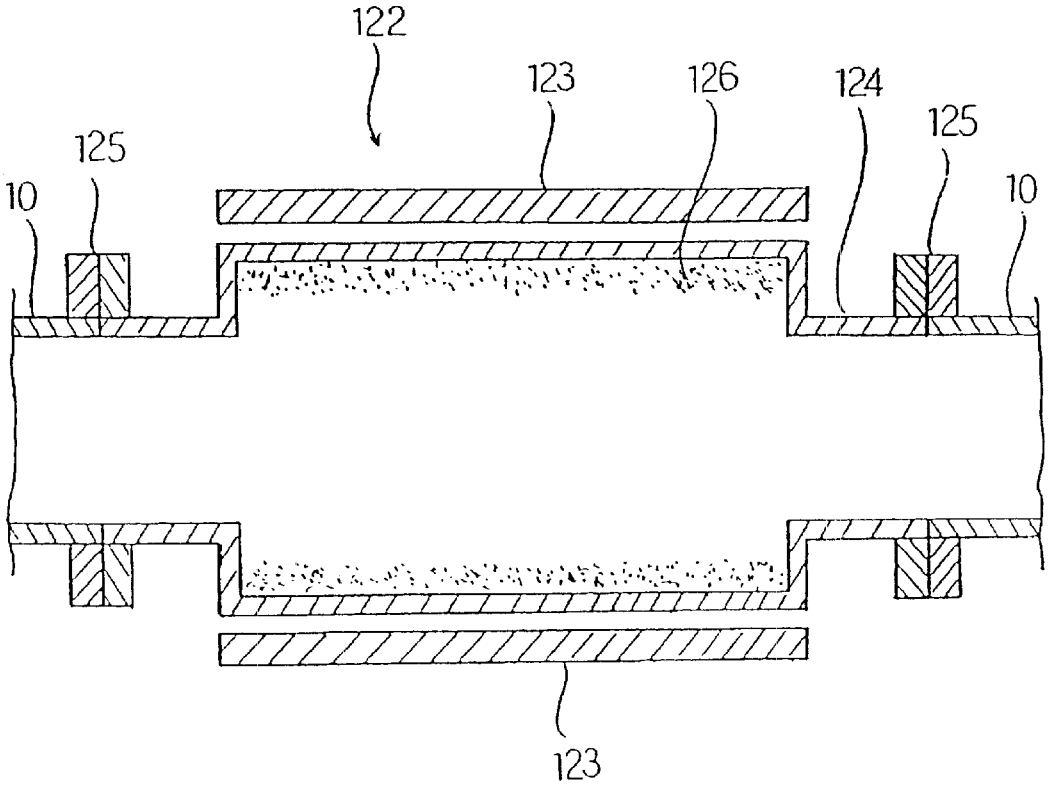
FIG. 20 is a sectional view of a foreign matter removal device.
Figure 21C:
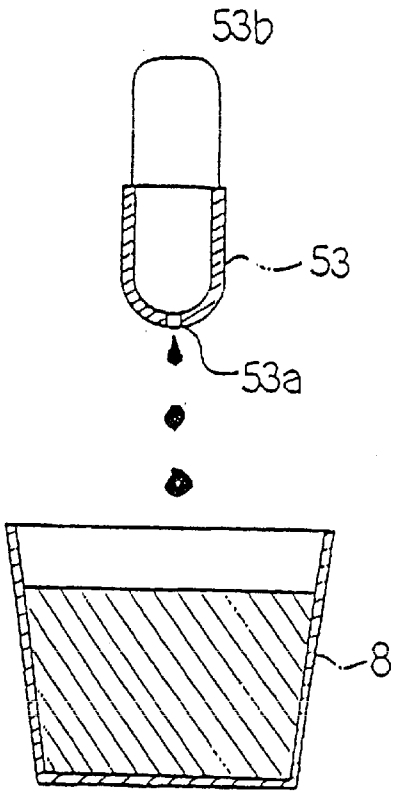
FIG. 21C PRIOR ART
FIGS. 21A, 21B and 21C are operating diagrams of the measurement of ink viscosity using a Zahn cup.
Figure 21B:
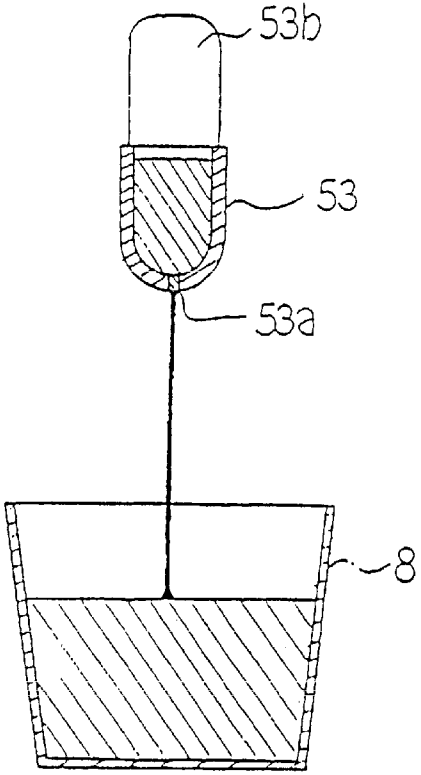
FIG. 21B PRIOR ART
Figure 21A:
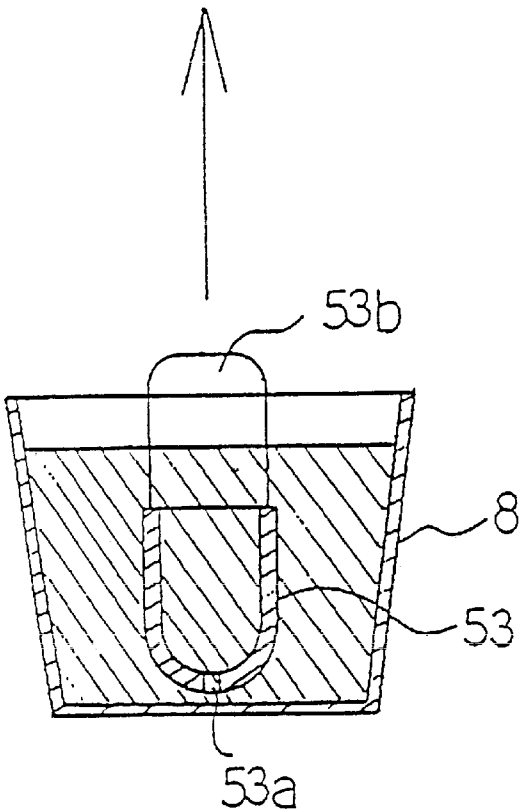
FIG. 21A PRIOR ART
Figure 22:
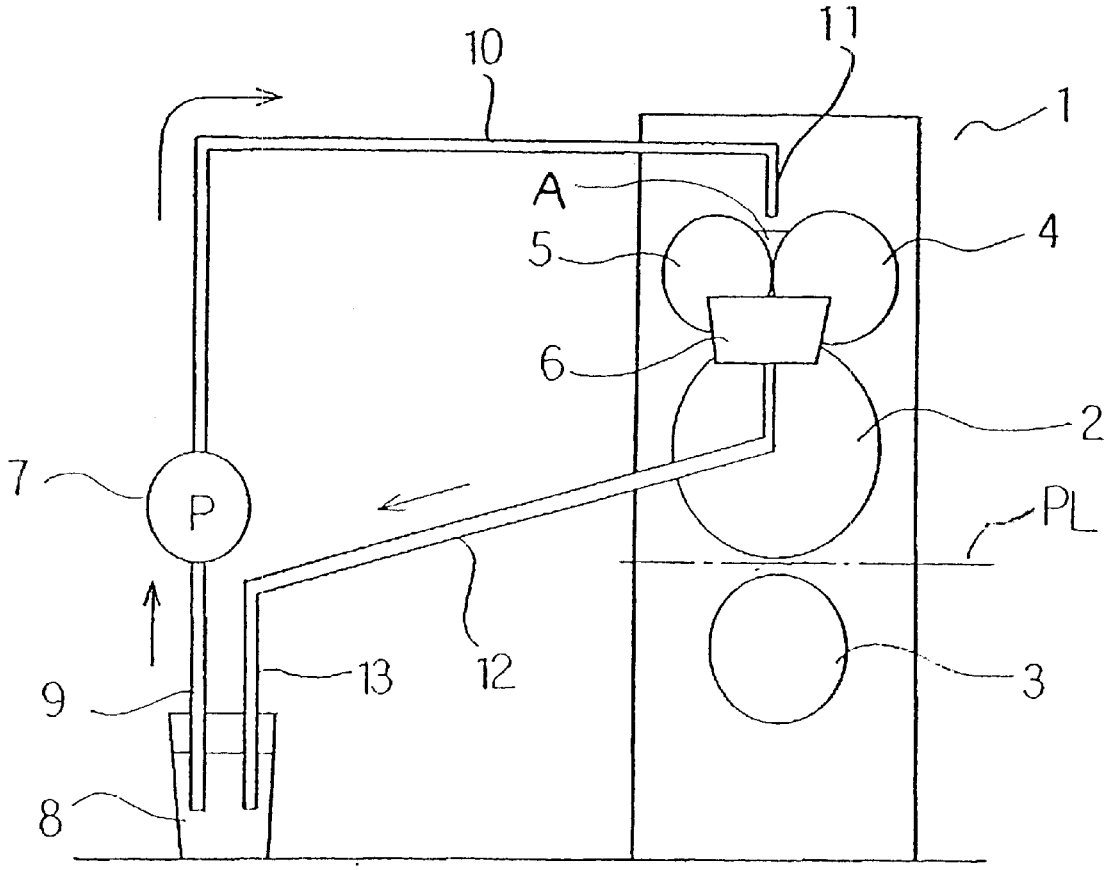
FIG. 22 PRIOR ART
FIG. 22 is a schematic diagram which illustrates a common flexo printing apparatus.

In the ink viscosity measuring device and ink viscosity measuring instrument of the present invention, as shown in FIG. 1, a foreign matter removal device 122 is installed on the upstream side of the ink viscosity measuring instrument 21 inside the ink supply passage 10 in order to solve the above-described problems. The foreign matter removal device 122 is basically a device that removes powdered metal admixed in the ink. In other words, a cylindrical magnet 123 is installed so that it envelops the ink supply passage 10 as shown in FIG. 20. Preferably, in order to prevent any check of the flow of the circulating ink or effect on this flow when the powdered metal admixed in the ink is caused to adhere magnetically to the inside wall of the ink supply passage 10 by the magnetic force of the magnet installed outside the ink supply passage 10, a foreign matter collection section 124 is provided which is formed with a slightly larger internal diameter than the internal diameter of the ink supply passage 10. If a foreign matter collection section 124 is thus provided, the powdered metal 126 admixed in the ink will be subjected to the magnetic force of the magnet 123 installed outside the ink supply passage 10, so that this powdered metal 126 adheres magnetically to the inside wall of the foreign matter collection section 124 of the ink supply passage 10 as shown in FIG. 20, thus preventing the flow of the powdered metal 126 into the ink viscosity measuring instrument 21 positioned on the downstream side of the foreign matter removal device 122. Accordingly, the unsatisfactory ink viscosity measurements that result from the adhesion of powdered metal to the surfaces of the first rotating body 33 are completely eliminated, so that stable ink viscosity measurements can be performed. Furthermore, since the foreign matter removal device 122 is connected to the ink supply passage 10 by means of coupling members 125 and 125, the operator can remove the foreign matter removal device 122 from the ink supply passage 10 either periodically or as desired, and can easily clean the interior of the foreign matter removal device 122. Furthermore, it is also possible to wrap an electromagnetic coil, etc. around the outside of the ink supply passage 10 instead of installing a magnet, and to use the action of the magnetism generated by this electromagnetic coil to cause the powdered metal admixed in the ink to adhere magnetically to the foreign matter collection section.

Figure 4:
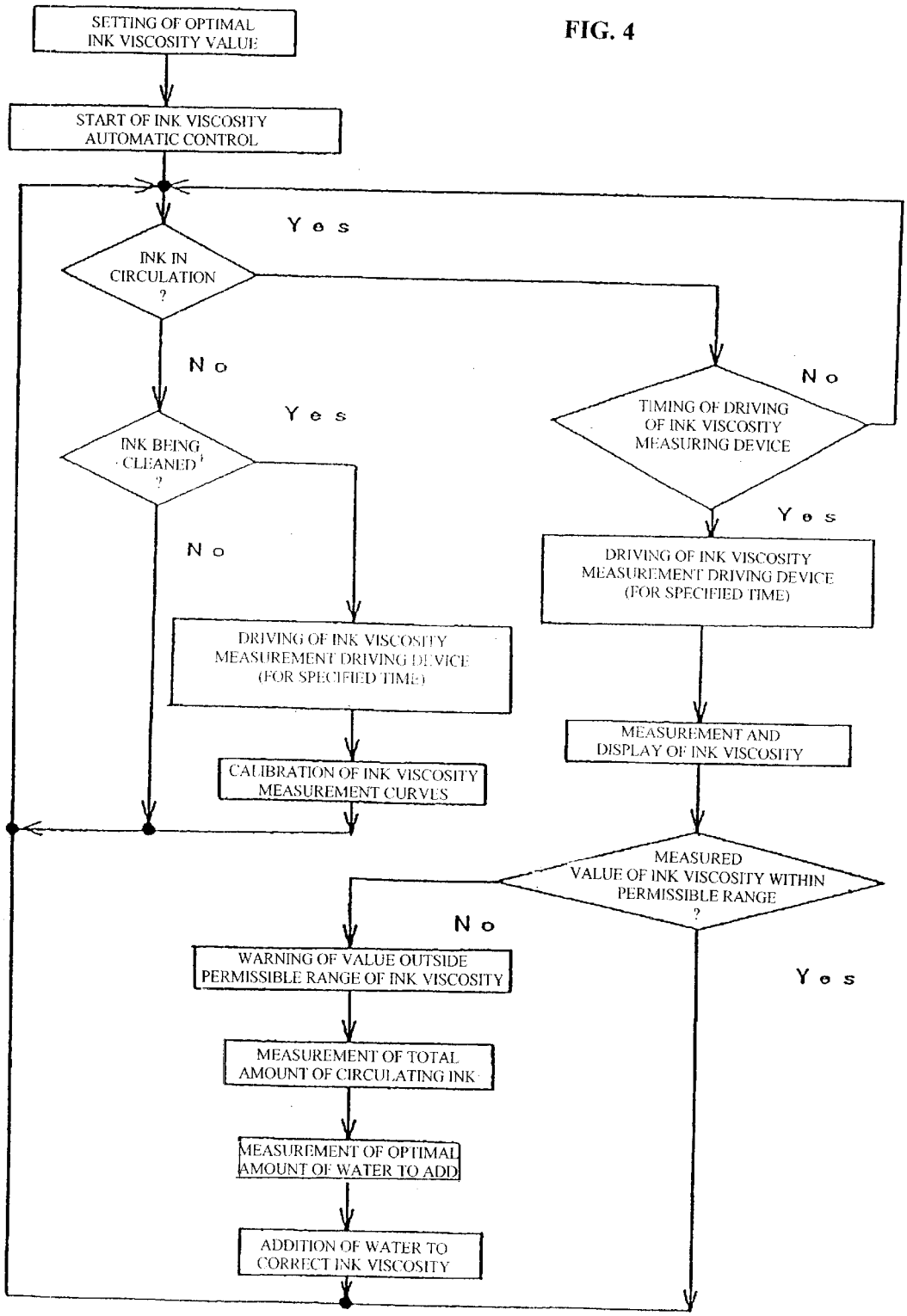
FIG. 4 is a first flow chart of ink viscosity measurement and ink viscosity adjustment.

Next, a concrete means for performing the above-described automatic measurement and automatic adjustment of the ink viscosity in a flexo printing apparatus will be described. Prior to the initiation of production, setting is performed by the operator, or pre-stored data is sent from a computer (not shown), so that various types of data are input into the memory section 151 inside the converter 24 of the control section 150. In concrete terms, data such as the maker of the ink used, the color of the ink, the optimal ink viscosity value of the ink used and the upper-limit and lower-limit values of this optimal ink viscosity value, the characteristics of the ink, environmental information such as air temperature and humidity, etc. the optimal flow rate of the ink flowing through the ink viscosity measuring instrument 21, and the upper-limit and lower-limit values for this optimal flow rate, etc. are set. First, as shown in FIG. 4, the first ink viscosity adjustment means starts the supply of ink. Then, automatic control of the ink viscosity is started after the interior of the ink viscosity measuring apparatus 21 is filled with ink. The measurement of the viscosity of the ink is ordinarily performed during the circulation of the ink. During ink cleaning, ink is not flowing through the interior of the ink viscosity measuring instrument 21. Accordingly, the viscosity of the ink is not measured. Since the object of the ink viscosity measuring device of the present invention is to measure the viscosity of the ink accurately, the flow of, for instance, a cleaning liquid, etc. through the ink viscosity measuring instrument 21 acts to correct the ink viscosity measuring device including the ink viscosity measuring instrument 21. This correction of the ink viscosity measuring device will be described later. When the ink is in circulation, a start signal is sent to the driving device control section 23 from the control section 150, so that the driving device control section 23 starts the driving device 22. In cases where it is not necessary to start the ink viscosity measuring device, the processing returns to ink viscosity automatic control "start". The system may be arranged so that the driving device 22 is continuously driven and the viscosity of the ink is constantly measured. However, in order to save on power consumption and reduce wear on the freely rotating shaft 35 that supports the first rotating body 33, and also in consideration of the ink viscosity adjustment time, the ink viscosity measuring instrument 21 is operated by driving the driving device 22 for a specified period of time at predetermined time intervals. In this case, the rotational driving load current value of the first rotating body 33, which is magnetically coupled with the second rotating body 29 and is caused to rotate at a fixed speed while being subjected to the resistance caused by the viscosity of the ink, is received by the driving device control section 23; the rotational driving load current value received by the driving device control section 23 is sent to the calculating section 152 of the converter 24; and the calculating section 152 of the converter 24 extracts the data required for conversion into an ink viscosity value from the memory section 151 and performs comparative calculations so that the rotational driving load current value is converted into an ink viscosity value, which is then displayed by the ink viscosity display device 25. In cases where the ink viscosity is within the permissible range of set values, the apparatus continues to operate normally. In cases where the ink viscosity is outside the above-described permissible range of the optimal ink viscosity, the operator is warned of this by the warning device 54, etc., and the ink viscosity is adjusted by adding a diluent liquid such as water, etc. or the ink stock liquid. The method used to add a diluent liquid such as water, etc. or the ink stock liquid will be described later.

Furthermore, the measurement of the ink viscosity by the ink viscosity measuring instrument 21 may be arranged so that the driving device 22 is continuously driven and the ink viscosity is constantly measured, or the ink viscosity measuring instrument 21 may be operated by driving the driving device 22 only for a predetermined period of time at desired time intervals. In this way, the ink viscosity can be constantly ascertained while the ink is circulating. Furthermore, as described above, the operator is informed by the warning device 54 or ink viscosity display device 25 in cases where there are abnormalities in the flow rate of the circulating ink.

Next, a concrete example of the method used for automatic adjustment of the ink viscosity in cases where the measured ink viscosity is outside the permissible range will be described with reference to FIG. 4. Here, an instance in which the ink viscosity has risen so that a diluent liquid is added will be described. The ink viscosity automatic adjustment apparatus 26 receives calculated and processed information along with ink viscosity measurement results from the calculating section 152 inside the converter 24 of the control section 150. Liquid level sensors 27 and 28 that detect the liquid level of the ink are installed in the ink tank 8 of the ink passage shown in FIG. 1 and in the ink collecting area A formed between the ink roll 4 and wringing roll 5; the respective liquid levels are measured by these sensors, and the measurement results are sent to the ink viscosity automatic adjustment apparatus 26. First, the shape of the ink tank 8 is known in advance, so that the amount of ink inside the ink tank can be calculated if the liquid level is measured by the liquid level sensor 27. Furthermore, the shape of the ink collecting area A formed between the ink roll 4 and the wringing roll 5 is known in advance, so that the amount of ink inside the ink collecting area A formed between the ink roll 4 and the wringing roll 5 can be calculated if the liquid level is measured by the liquid level sensor 28. Furthermore, the diameter and length of the ink passage are also known in advance. Accordingly, the amount of ink flowing through the ink passage can also easily be calculated. After the total amount of ink in circulation has been calculated from the above, the ink viscosity automatic control apparatus 26 sends the measurement results for the calculated total amount of ink to the calculating section 152 inside the converter 24 of the control section 150, and the optimal amount of diluent liquid such as water, etc. that is to be supplied in order to adjust the ink viscosity to the target value is calculated by the control section 150 from the water or diluent liquid supply amount calculation curves (shown in FIG. 7) that are set beforehand and stored in the memory section 151. In the water or diluent liquid supply amount calculation curves shown in FIG. 7, actual measured values of the ink viscosity measured by means of a Zahn cup 53 are shown on the vertical axis, and proportion of water or a diluent liquid that is added relative to the total amount of ink is shown on the horizontal axis. For example, in a case where the target ink viscosity value is 10 seconds, and the upper-limit permissible value is 11 seconds, if the value of the ink viscosity measured by the ink viscosity measuring instrument 21 is twelve seconds, the calculating section 152 of the converter 24 of the control section 150 sends a command so that the warning section 54 issues a warning to the effect that the measured ink viscosity value is outside the permissible range for the ink viscosity value. Then, the calculating section 152 of the converter 24 of the control section 150 selects the ink viscosity variation curve for the ink that is flowing through from the ink viscosity variation curves X, Y and Z stored in the memory section 151; and from this selected ink viscosity variation curve, the calculating section 152 finds the place where the ink viscosity curve (here, curve Y) for an ink viscosity value of twelve seconds intersects with an ink viscosity value of 10 seconds on the vertical axis, and reads the amount of water or diluent liquid that is to be added relative to the total amount of ink in this case. Then, the calculating section 152 sends this amount of diluent liquid to the ink viscosity automatic adjustment apparatus 26. The ink viscosity automatic adjustment apparatus 26 receives this result, and sends a command to add the desired diluent liquid to respective locations. Then, the ink viscosity is adjusted by adding the desired diluent liquid from these respective locations. In this embodiment, a value indicating the addition of 1.5% water or diluent liquid relative to the total amount of ink is determined at the time of ink viscosity measurement. Then, assuming that the measurements performed by the liquid level sensors 27 and 28 indicate that the calculated total amount of ink in circulation is 8000 cc, the amount of water or diluent liquid that is to be added is 1.5% of 8000 cc, or 120 cc. Then, the ink viscosity automatic control apparatus 26 adds the calculated amount of water or diluent liquid that is required in order to correct the ink viscosity to the appropriate viscosity to the ink tank 8, etc. The added water or diluent liquid dissolves in the ink and circulates through the ink passage inside the printing apparatus; after a fixed period of time, this water or diluent liquid diffuses uniformly throughout the ink as a whole, so that the viscosity of the ink reaches the target value of 10 seconds. In this way, automatic adjustment of the ink viscosity is accomplished.

The system is constructed so that the water or diluent liquid is supplied from the water pipe 14 shown in FIG. 1 or a diluent liquid supply pipe (not shown) via the valves 15, 17 and 19. The first supply location is the ink tank 8, the second supply location is the ink collecting area A between the ink roll 4 and wringing roll 5, and the third supply location is located on the downstream side of the ink viscosity measuring instrument 21 between the ink viscosity measuring instrument 21 and the ink supply port 11. Water or a diluent liquid can also be added in other respective locations. Furthermore, flow meters 55, 56 and 57 are installed for the respective valves 15, 17 and 19, and the respective amounts of water flowing through are output from these flow meters as electrical pulses. Furthermore, water or a diluent liquid is added via nozzles 16, 18 and 20 after passing through the valves 15, 17 and 19. For example, this addition may be performed simultaneously at the three locations shown in FIG. 1, or may be performed at two locations or a single location. Furthermore, the required amount may also be added in a number of separate additions. Furthermore, a control action that maintains the amounts of ink in the ink tank and ink collecting area at optimal values may also be performed using the liquid level values detected by the ink level sensors 27 and 28.

Furthermore, in the above embodiment, only an addition system in which water or a diluent liquid is added in order to lower the ink viscosity in cases where the ink viscosity has risen is described. However, in cases where the ink viscosity has dropped below the lower-limit value of the ink viscosity, the ink stock liquid is added. Generally, the ink viscosity may be caused to drop by the excessive supply of the diluent liquid in the addition of the diluent liquid, by the supply of diluent liquid from diluent liquid supply devices (not shown) installed at both ends of the ink collecting area A formed between the ink roll 4 and wringing roll 5, or by the supply of diluent liquid from a spray device, etc. (not shown), which sprays the diluent liquid toward the ink roll 4 or wringing roll 5, and which is installed in order to maintain the interior of the printing apparatus at a constant humidity. In such cases, the ink viscosity is measured by the same means as in the case of the above-described ink viscosity measurement, and the measurement results obtained by the ink viscosity measuring device are subjected to calculations by the calculating section 152 inside the converter 24 of the control section 150 as described above. Then, the calculating section 152 sends a command to the ink viscosity automatic adjustment apparatus 26 indicating the amount of ink stock liquid to be added, and the ink stock liquid is added by the ink viscosity automatic adjustment apparatus 26 so that the viscosity of the ink is adjusted. The ink stock liquid addition system also operates by a system similar to the water or diluent liquid addition system. However, this system differs from the addition of the diluent liquid as follows: namely, while a diluent liquid such as water, etc. is added from the water pipe 14, etc., in the case of the diluent liquid, the ink stock liquid is similarly added via an ink stock liquid addition pump (not shown) from an ink stock liquid tank (not shown) that is installed inside the printing apparatus 1. However, the addition system including the setting of the amount added and the means of addition, etc. are basically the same as in the addition of the diluent liquid. Accordingly, a description is omitted.

Figure 5:
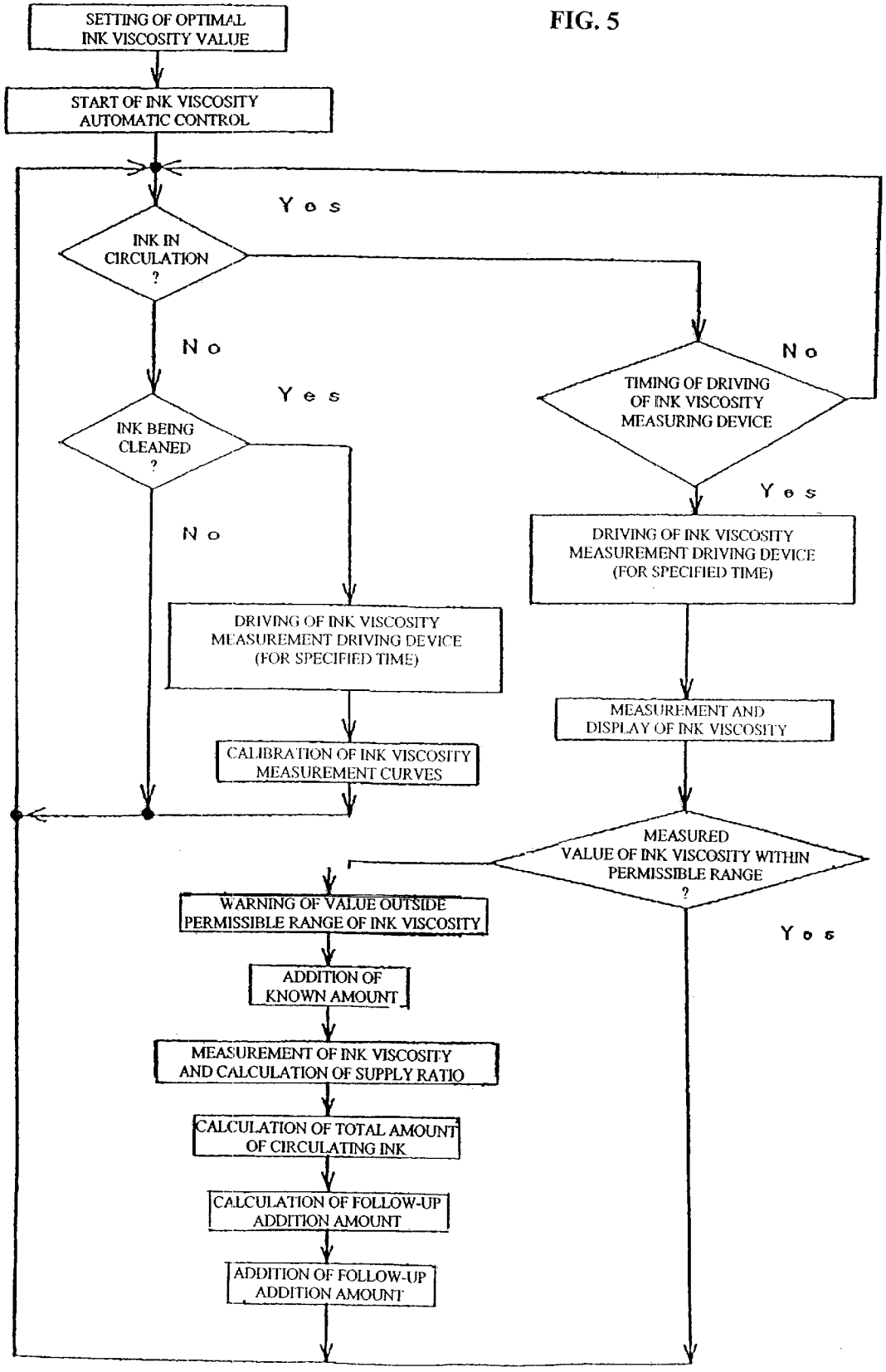
FIG. 5 is a second flow chart of ink viscosity measurement and ink viscosity adjustment.

Next, a second ink viscosity adjustment means which is separate from the first ink viscosity adjustment means described above will be described with reference to the flow chart shown in FIG. 5. Since the starting of the ink viscosity measuring device, the measurement of the ink viscosity and the process up to the point of the display or warning are similar to those in the first ink viscosity adjustment means, a detailed description of these processes will be omitted here. Furthermore, in the second ink viscosity adjustment means, the correction of the ink viscosity measuring instrument 21 and ink viscosity measuring device when the ink is not in circulation, e. g., during cleaning, is also similar to that in the case of the first ink viscosity adjustment means. Accordingly, this correction of the ink viscosity measuring instrument 21 and ink viscosity measuring device will be described later.

Figure 7:
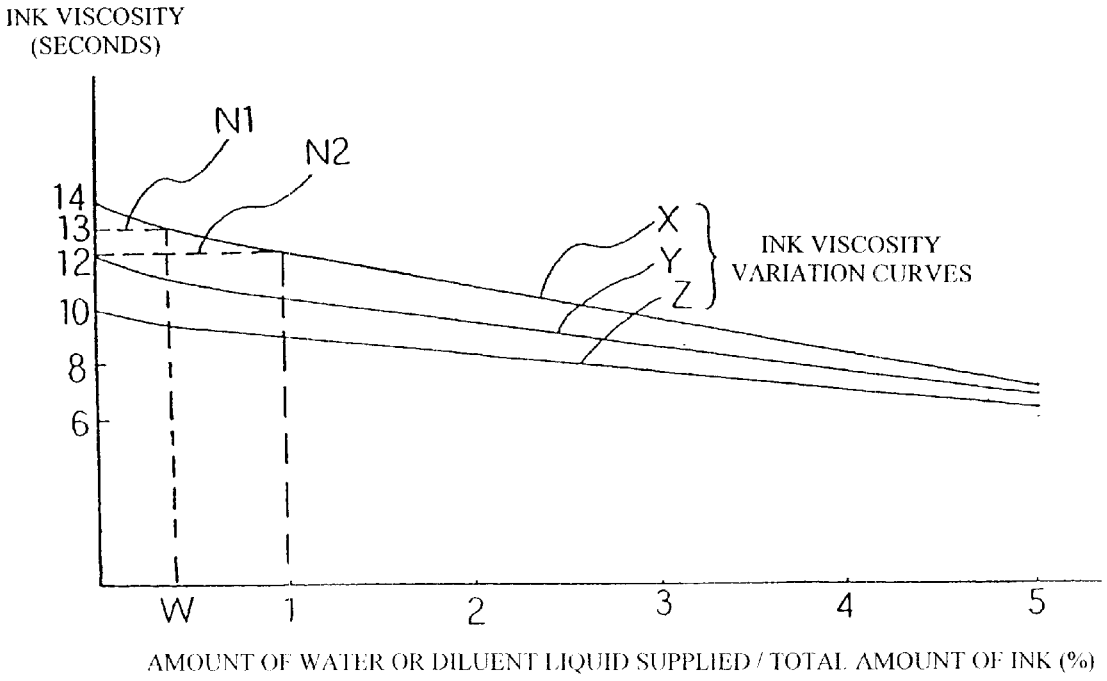
FIG. 7 is a calculation diagram which shows the water or diluent liquid supply amount calculation curves for the ink viscosity.

Here, an instance in which the measurement result obtained by the ink viscosity measuring instrument 21 and ink viscosity measuring device is 14 seconds, and this is to be adjusted to an ink viscosity of twelve seconds, will be described using the ink viscosity variation curves shown in FIG. 7. First, it is confirmed by the calculating section 152 inside the converter 24 of the control section 150 that the measured value of the ink viscosity is 14 seconds. Then, the fact that the ink viscosity variation curve in this case is the ink viscosity variation curve X is extracted from the ink viscosity variation curves shown in FIG. 7, which are set beforehand in the memory section 151 inside the converter 24 of the control section 150. Here, the calculating section 152 inside the converter 24 of the control section 150 sends a command to the ink viscosity automatic adjustment apparatus 26 to add a certain known quantity of the diluent liquid to the ink, and the ink viscosity automatic adjustment apparatus 26 adds this known quantity of the diluent liquid via the various nozzles 16, 18, 20, etc. Then, for example, when the ink viscosity is again measured by the ink viscosity measuring instrument 21, it is found that the ink viscosity value has changed to 13 seconds. This results in a relationship that corresponds to the broken line N1 in FIG. 7. Accordingly, the calculating section 152 inside the converter 24 of the control section 150 can calculated the supply ratio W % of the known amount of diluent liquid that is added relative to the total amount of ink (which is an unknown quantity) from the ink viscosity curves in FIG. 7, which are stored in the memory section 151. Thus, since the unknown total amount of ink is the percentage of the diluent liquid ratio W % relative to the total amount of ink obtained here, the calculating section 152 inside the converter 24 of the control section 150 can ascertain from FIG. 7 that the amount of diluent liquid that is to be added next in order to adjust the ink viscosity that is the final target to twelve seconds is represented by the broken line indicated by N2, and the calculating section 152 can calculate that this amount is 1% of the total amount of ink. In regard to the amount of diluent liquid that is added, since the amount of the previously added diluent liquid is known in advance, the follow-up addition amount obtained by subtracting the known diluent liquid addition amount of W % relative to the previously obtained total amount of ink from the diluent liquid addition amount of 1% relative to the total amount of ink is calculated by the calculating section 152 inside the converter 24 of the control section 150; then, the calculating section 152 inside the converter 24 of the control section 150 sends a command to the ink viscosity automatic adjustment apparatus 26 to add the diluent liquid, and the ink viscosity automatic adjustment apparatus 26 that has received this command adds the follow-up addition amount of the diluent liquid via the various nozzles 16, 18, 20, etc. By using this procedure, it is possible to calculate the amount of diluent liquid to be added and adjust the ink viscosity even under conditions in which the total amount of ink cannot be ascertained. Furthermore, in regard to the method used to add the diluent liquid, it is sufficient to use a means which adds the diluent liquid from the water pipe 15 via respective addition means, and the amount of diluent liquid added can be controlled by the flow meters 55, 56, 57, etc.

Furthermore, in the above embodiment, only the supply system for supplying water or a diluent liquid in order to lower the ink viscosity in cases where the ink viscosity has risen is described. However, in cases where the ink viscosity has dropped below the lower-limit value of the ink viscosity, the ink stock liquid is added. Generally, the ink viscosity may be caused to drop by the excessive supply of the diluent liquid in the addition of the diluent liquid, by the supply of diluent liquid from diluent liquid supply devices (not shown) installed at both ends of the ink collecting area A formed between the ink roll 4 and wringing roll 5, or by the supply of diluent liquid from a spray device, etc. (not shown), which sprays the diluent liquid toward the ink roll 4 or wringing roll 5, and which is installed in order to maintain the interior of the printing apparatus at a constant humidity. In such cases, the ink viscosity is measured by the same means as in the case of the ink viscosity measurement, the measurement results obtained by the ink viscosity measuring device are subjected to calculations by the calculating section 152 inside the converter 24 of the control section 150 as described above, and the ink stock liquid is added by the ink viscosity automatic adjustment apparatus 26 so that the viscosity of the ink is adjusted. The ink stock liquid addition system also operates by a system similar to the water or diluent liquid addition system. However, this system differs from the above-described addition of the diluent liquid as follows: namely, while a diluent liquid such as water, etc. is added from the water pipe 14, etc. in the case of the diluent liquid, the ink stock liquid is similarly supplied via an ink stock liquid addition pump (not shown) from an ink stock liquid tank (not shown) that is installed inside the printing apparatus 1. However, the addition system including the setting of the amount added and the means of addition, etc. are basically the same as in the addition of the diluent liquid. Accordingly, a description is omitted.

Figure 6:
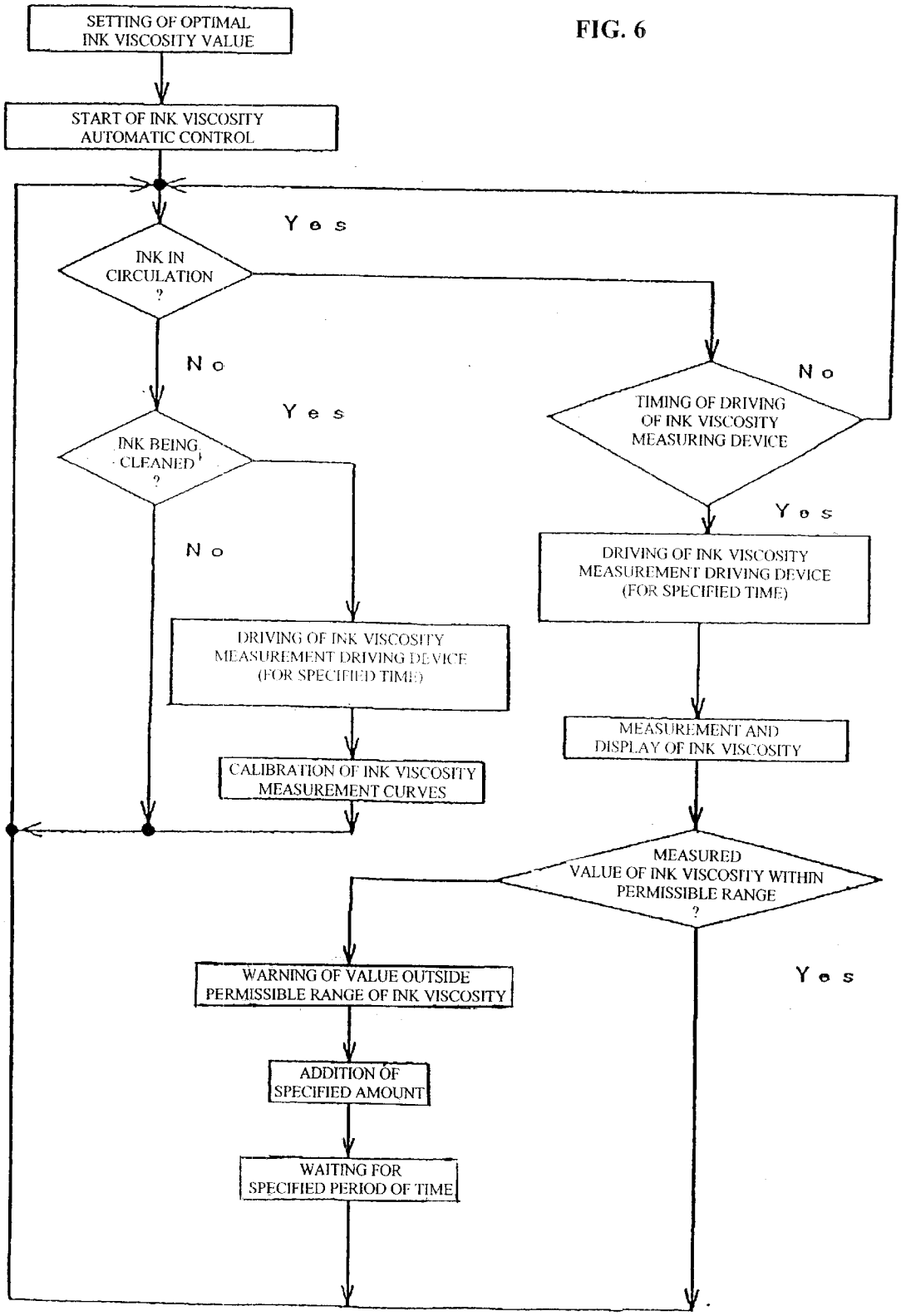
FIG. 6 is a third flow chart of ink viscosity measurement and ink viscosity adjustment.

Next, a third ink viscosity adjustment means will be described with reference to the flow chart shown in FIG. 6. Since the starting of the ink viscosity measuring device, the measurement of the ink viscosity and the process up to the point of the display or warning are similar to those in aforementioned first and second ink viscosity adjustment means, a detailed description of these processes will be omitted here. Furthermore, in the second ink viscosity adjustment means, the correction of the ink viscosity measuring instrument 21 an d ink viscosity measuring device when the ink is not in circulation, e. g., during cleaning, is also similar to that in the case of the first ink viscosity adjustment means. Accordingly, this correction of the ink viscosity measuring instrument 21 and ink viscosity measuring device will be described later.

Here, the means used to add the diluent liquid in cases where the ink viscosity has risen to a point where the ink viscosity measurement results exceed the upper-limit value of the preset standard ink viscosity value will be described. In this third ink viscosity adjustment means, when the measurement results obtained by the ink viscosity measuring instrument 21 and ink viscosity measuring device are outside the range of the standard ink viscosity value, the operator is warned of this by the warning device 54, etc., and the calculating section 152 inside the converter 24 of the control section 150 issues command to the ink viscosity automatic adjustment apparatus 26 to add a preset specified amount of the diluent liquid. The ink viscosity automatic adjustment apparatus 26 adds this preset specified amount of the diluent liquid to the ink tank 8, ink passage 10 or ink collecting area A via the nozzles 16, 18 and 20 disclosed in FIG. 1. Then, a timer (not shown) that is installed inside the control section 150 is actuated, and the count of a preset fixed time period that is required for the diluent liquid added at various positions to fill the interior of the ink circulation passage is initiated. Then, after this preset fixed time period has elapsed, the ink viscosity measuring device is started and the ink viscosity value following the addition of the above-described specified amount of diluent liquid is measured as shown in the flow chart in FIG. 6. Since the ink viscosity value that is measured in this case is an ink viscosity value that is measured after a fixed period of time has elapsed according to the timer (not shown), the previously added specified amount of diluent liquid has filled the ink circulation passage at this time, so that the ink viscosity value has dropped by an amount that corresponds to the previously added specified amount of diluent liquid. Then, if the ink viscosity value measured at this time is still outside the range of the standard ink viscosity value, an additional amount of the diluent liquid is added in the same manner as in the addition of the above-described specified amount of diluent liquid, and the ink viscosity value is again measured after a fixed period of time has elapsed. The ink viscosity value is adjusted by repeating this operation in this way until the ink viscosity value is within the range of the standard value.

Furthermore, in the above embodiment, only an addition system in which water or a diluent liquid is added in order to lower the ink viscosity in cases where the ink viscosity has risen is described. However, in cases where the ink viscosity has dropped below the lower-limit value of the ink viscosity, the ink stock liquid is added. Generally, the ink viscosity may be caused to drop by the excessive supply of the diluent liquid in the above-described addition of the diluent liquid, by the supply of diluent liquid from diluent liquid supply devices (not shown) installed at both ends of the ink collecting area A formed between the ink roll 4 and wringing roll 5, or by the supply of diluent liquid from a spray device, etc. (not shown), which sprays the diluent liquid toward the ink roll 4 or wringing roll 5, and which is installed in order to maintain the interior of the printing apparatus at a constant humidity. In such cases, the ink viscosity is measured by the same means as in the case of the above-described ink viscosity measurement, the measurement results obtained by the ink viscosity measuring device are subjected to calculations by the calculating section 152 inside the converter 24 of the control section 150 as described above, and the ink stock liquid is added by the ink viscosity automatic adjustment apparatus 26 so that the viscosity of the ink is adjusted. The ink stock liquid addition system also operates by a system similar to the water or diluent liquid addition system. However, this system differs from the addition of the diluent liquid as follows: namely, while a diluent liquid such as water, etc. is added from the water pipe 14, etc. in the case of the diluent liquid, the ink stock liquid is similarly added via an ink stock liquid addition pump (not shown) from an ink stock liquid tank (not shown) that is installed inside the printing apparatus 1. However, the addition system including the setting of the amount added and the means of addition, etc. are basically the same as in the addition of the diluent liquid. Accordingly, a description is omitted.

Next, the means used for recovery and cleaning of the ink inside the ink viscosity measuring apparatus 21 in cases where the printing of a certain order is completed and there is a shift to the printing of the next order will be described. The ink that has accumulated in the ink collecting area between the ink roll 4 and the wringing roll 5, as well as the ink on the downstream side of this ink collecting area, is recovered in the ink tank 8 via the ink recovery passage 12. The ink in the ink supply passage 10 including the ink viscosity measuring instrument 21 can be caused to flow backward so that this ink is recovered in the ink tank if a reversible pump is used as the ink pump 7. Furthermore, in the ink viscosity measuring instrument 21, since an ink injection port 38 into which the ink drawn up from the ink tank 8 via the ink pump 7 and ink supply passage 10 is fed is disposed in the lower part of the outer covering body 37, and since an ink discharge port 39 which communicates with the ink supply port 11 that feeds ink out into the space between the ink roll 4 and wringing roll 5 is disposed in the upper part of the outer covering body 37, the ink inside the ink viscosity measuring instrument 21 is drawn out from the ink injection port 38 formed in the lower part of the ink viscosity measuring instrument 21 simultaneously with the recovery of the ink inside the ink passage, so that almost no ink remains inside the ink viscosity measuring instrument 21. Furthermore, during the cleaning of the ink from the inside of the ink passage, the interior of the ink viscosity measuring instrument 21 can be cleaned by supplying the same cleaning water or cleaning liquid to the interior of the ink viscosity measuring instrument 21. Accordingly, there is no printing contamination even when the production of the next order involves a different color of ink. Moreover, if the first rotating body 33 is rotated during the cleaning of the ink as well, then the ink and cleaning waste water adhering to the surfaces of the first rotating body 33, the inside surfaces of the inner covering body 31 and the inside surfaces of the outer covering body 37 can be quickly recovered or cleaned away.

Furthermore, in the ink viscosity measuring device and ink viscosity adjusting device of the present invention, the converter 24 of the control section 150 has the function of calibrating the ink viscosity measurement curves that act as a standard for the conversion of the values measured by the ink viscosity measuring instrument 21 into ink viscosity values as shown in FIG. 3. Specifically, the ink viscosity measuring instrument 21 is constructed as shown in FIG. 2 and described above, and has a structure in which the freely rotating shaft 35 that supports the first magnetic bodies 34 or first rotating body 33 so that these components are free to rotate is shaft-supported between the outer covering body 37 and inner covering body 31. Here, the structure is such that the application of a load to the rotation of the first magnetic bodies 34 or first rotating body 33 is avoided as far as possible. However, as use of the ink viscosity measuring instrument 21 is continued, the occurrence of mechanical wear in the locations where the freely rotating shaft 35 is shaft-supported is unavoidable. When the shaft-support locations of the freely rotating shaft 35 thus become worn, the rotational resistance load varies at the shaft-support locations so that there is an effect on the rotation of the first magnetic bodies 34 or first rotating body 33. Under such conditions, the driving device control section 23 which controls the driving of the driving device 22 that rotationally drives the first magnetic bodies 34 or first rotating body 33 measures the driving device load current value while being subjected to the effects of the mechanical load. In the state prior to the generation of a mechanical load caused by the mechanical wear, etc., the so-called initial mechanical load is corrected for by the memory section 151 inside the converter 24 of the control section 150 as described above. However, as use of the ink viscosity measuring instrument 21 continues, a mechanical load caused by the mechanical wear, etc. is generated, so that error occurs in the initially set mechanical load correction value. Then, since the driving device control section 23 performs measurements with a mechanical load component generated by mechanical wear, etc. added to the ink viscosity load component, the rotational driving load current value measured here becomes a measured value in which such a mechanical load component generated by mechanical wear, etc. is added to the initially set ink viscosity measurement curve. As a result, the measured ink viscosity value is an ink viscosity value that deviates from the actual ink viscosity value, so that an accurate ink viscosity value cannot be obtained.

In the ink viscosity measuring device and ink viscosity adjusting device of the present invention, in order to correct such an ink viscosity value that contains measurement error caused by mechanical wear of the freely rotating shaft 35, etc. to an accurate ink viscosity value, the calculating section 152 inside the converter 24 of the control section 150 calculates whether or not there is a mechanical measurement error caused by wear of the freely rotating shaft 35 when water or ink that is close to water in terms of viscosity is flowing through the ink viscosity measuring instrument 21. Specifically, in the case of such a liquid, there is generally no variation in the viscosity of water over a broad temperature range extending from the vicinity of the freezing point to the vicinity of the boiling point. Utilizing this characteristic, the rotational driving load current value in a case where water or an ink that is close to water in terms of viscosity is caused to flow through the ink viscosity measuring instrument 21, i.e., the so-called viscosity of water, is measured. Then, the rotational driving load current value obtained in this case is converted as the viscosity of water by the converter 24. The viscosity value of water measured in a state in which the respective components of the ink viscosity measuring instrument 21 are not mechanically worn, i.e., the viscosity value of water measured in the so-called initial state, is stored in the memory section 151 as the initial viscosity value, and in subsequent use, e.g., during cleaning, etc., this viscosity value of water is measured, and the viscosity value of water is compared with the initially set viscosity value of water. In this way, a check is made by the calculating section 152 as to whether or not this value is a proper value or a value that falls within the range of permissible values. More concretely, the rotational driving load current value in a case where water is flowing through the ink viscosity measuring instrument 21 is measured using the ink viscosity measuring instrument 21 in a state in which the freely rotating shaft 35 of the ink viscosity measuring instrument 21 has undergone almost no mechanical wear, and using this measured value as a standard, the ink viscosity measurement curve a shown in FIG. 3, for example, is initially set in the memory section 151. Then, the ink is caused to flow, and when water is caused to flow through the ink viscosity measuring instrument 21 in order to clean away the ink following the use of the ink viscosity measuring instrument 21, the rotational driving load current value during this flow of water through the ink viscosity measuring apparatus 21 is measured using the ink viscosity measuring apparatus 21. In this case, furthermore, the calculating section 152 inside the converter 24 of the control section 150 calls up the initially set standard ink viscosity measurement curve a from the memory section 151, and the calculating section 152 inside the converter 24 of the control section 150 compares this with the value measured by the ink viscosity measuring instrument 21, and thus makes a check in order to ascertain whether or not this measured value is a proper value or a value that falls within the range of permissible values. In cases where this value is a proper value or a value that falls within the range of permissible values, the ink viscosity measurement curve a shown in FIG. 3, which is stored in the memory section 151, continues to be used without being altered. However, in cases where this value is not a proper value or a value that falls within the range of permissible values, it is judged that mechanical wear, etc. has occurred in the freely rotating shaft 35, and subsequent ink viscosity measurements are performed after the ink viscosity measurement curve $\alpha$ shown in FIG. 3, which is stored in the memory section 151, is changed to the ink viscosity measurement curve $\beta$ or ink viscosity measurement curve $\gamma$ on the basis of the measurement results. As a result of the use of this procedure, measurement error in the ink viscosity values caused by mechanical wear of the freely rotating shaft 35 inside the ink viscosity measuring instrument 21 is eliminated, so that the viscosity of the ink passing through the ink viscosity measuring instrument 21 can always be accurately measured, and the ink viscosity can be adjusted on the basis of these measurement results.

Furthermore, mechanical wear, etc. inside the ink viscosity measuring instrument 21 may also conceivably occur in other areas, and is therefore not limited to the freely rotating shaft 35 alone. Furthermore, it is generally desirable that the timing of viscosity measurements be such that measurements are performed in the latter half of the cleaning process in which the ink has been washed away, when water or an ink that is close to water in terms of viscosity is flowing through the ink viscosity measuring instrument 21. Furthermore, the above-described measurements may be performed continuously when water is flowing through the ink viscosity measuring instrument 21, or may be performed with a periodic or irregular timing. Moreover, water is generally desirable for the above-described measurements. However, the liquid used is not limited to water, a cleaning liquid such as the diluent liquid, etc. may be passed through the ink viscosity measuring instrument 21, as long as this liquid is a liquid that shows little variation in viscosity.

Furthermore, in the above description, the ink viscosity measuring instrument is installed in the ink supply passage 10. However, it is also possible to install the ink viscosity measuring instrument 21 in the ink recovery passage 12.

Figure 8:
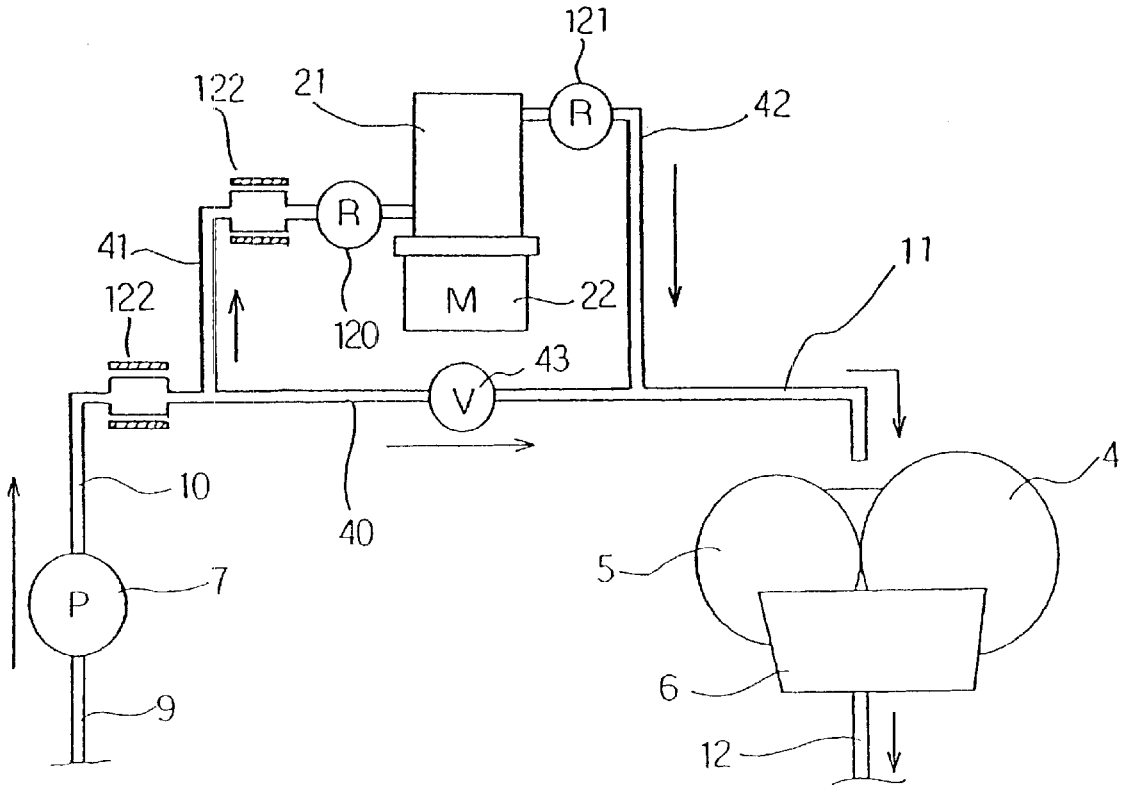
FIG. 8 is a schematic diagram illustrating an embodiment in which the ink viscosity is measured using a bypass passage.

Next, another embodiment using the ink viscosity measuring instrument of the present invention will be described. In the above-described embodiment, the ink viscosity is measured with the ink viscosity measuring instrument 21 installed in the ink supply passage 10. However, the ink viscosity can also be measured using the ink viscosity measuring instrument 21 of the present invention in locations other than the main passage of the ink supply passage 10. FIG. 8 illustrates an embodiment of this. Here, the ink supply passage 10 branches into an ink supply main passage 40 and a bypass supply passage 41. Furthermore, the ink viscosity measuring instrument 21 is installed on the downstream side of the bypass supply passage 41, and the ink passage from the ink viscosity measuring instrument 21 joins the ink supply main passage 40 via a bypass return passage 42. Specifically, a means that measures the viscosity of the ink is constructed by installing the ink viscosity measuring instrument 21 in the bypass passages 41 and 42. Furthermore, the flow meters 120 and 121 are installed in the bypass supply passage 41 and bypass return passage 42 (or such a flow meter may be installed in only one of these passages), and the flow rate of the ink flowing through the ink viscosity measuring instrument 21 is measured. The action of the flow meters 120 and 121 is the same as the action described in the above-described embodiment. Accordingly, a detailed description will be omitted here. Furthermore, foreign matter removal devices 122 are installed in both the ink supply passage 10 and bypass supply passage 41, or such a device is installed only in the bypass supply passage 41, so that powdered metal in the circulating ink is removed on the upstream side before entering the ink viscosity measuring instrument 21. The action of these foreign matter removal devices 122 is the same as the action described in the above-described embodiment. Accordingly, a detailed description will be omitted here.

The present embodiment is an effective means mainly in cases where the ink flow rate is large or the ink supply passage 10 has an extremely large diameter, or in cases where ink viscosity measurements are performed with the ink viscosity measuring instrument 21 attached afterward to an existing ink supply device. Specifically, in cases where there is a danger that the measurements will be affected by the rotational torque received by the first rotating body 33 inside the ink viscosity measuring instrument 21 as a result of the flow rate of the ink, a bypass supply passage 41 is caused to branch from the ink supply passage 10, and the ink viscosity is measured in the bypass passage 41 or 42. Such a procedure is advantageous in that the measuring device can easily be attached as a modification to existing ink supply devices without the measurements being affected by the ink flow rate or size of the ink supply passage, etc. Furthermore, if a valve 43 is installed in the ink supply main passage 40, then the amount of ink flowing through the ink supply main passage 40 and the amount of ink flowing through the bypass supply passage 41 can be controlled. The measurement of the ink viscosity and the adjustment of the ink viscosity are performed in the same manner as in the above-described system.

Furthermore, in addition to setting the optimal flow rate value including the upper-limit and lower-limit values of the flow rate of the ink flowing through the ink viscosity measuring instrument 21 in order to allow the ink viscosity measuring instrument 21 to perform stable ink viscosity measurements, the flow meters 120 and 121 detect the lower-limit value of the ink flow rate that indicates whether or not ink is flowing through the bypass passage 41 in absolute terms. Specifically, in the present embodiment, a bypass passage 41 is installed for the ink supply main passage 40, and the amount of ink that flows through this bypass passage 41 is set by the setting of the valve 43 installed in the ink supply main passage 40. Accordingly, the flow rate through the bypass passage 41 relative to the ink flow rate through the ink passage 10 from the ink tank 8 via the ink pump 7 can be ascertained from the setting of the valve 43. Consequently, in cases where this ink flow rate falls below the lower-limit value for the flow rate of the ink flowing through the bypass passage 41, this may indicate that the ink inside the ink tank has been exhausted or is about to become exhausted, that the ink has become clogged with foreign matter inside the ink passage 10 and bypass passage 41, or that there is trouble with the ink pump 7, etc. Accordingly, such problems must be prevented in advance before troubles occur.

In concrete terms, the lower-limit value of the ink flow rate for the ink flowing through the ink passage 10 is set in the memory section 151 inside the converter 24 of the control section 150, and the flow meters 120 and 121 constantly measure the flow rate of the ink through the ink passage 10, and send the measurement results to the control section 150. The calculating section 152 inside the converter 24 of the control section 150 calls up the lower-limit value of the ink flow rate from the memory section 151, and compares the measurement results sent from the flow meter 120 with this lower-limit value of the ink flow rate. In cases where the measurement results continuously transmitted from the flow meters 120 and 121 fall below the set lower-limit value of the ink flow rate, the measurement results are judged to be abnormal, and the operator is warned by the warning device 54. Furthermore, the display of the ink viscosity display device 25 that displays the ink viscosity value is stopped in order to indicate that the ink viscosity value obtained in this case is invalid, or else the ink viscosity display device 25 shows a display that indicates an abnormality. In this case, the operator may be informed of the measurement results falling below the lower-limit value of the set ink flow rate by the warning device 54 using a means of discrimination such as a sound or musical tone, etc., or the ink flow rate can be directly displayed by the ink viscosity display device 25. As a result of this arrangement, the operator can check for abnormalities in the flow rate of the ink flowing through the ink viscosity measuring instrument 21, and can take steps to avoid such abnormal conditions.

Figure 9:
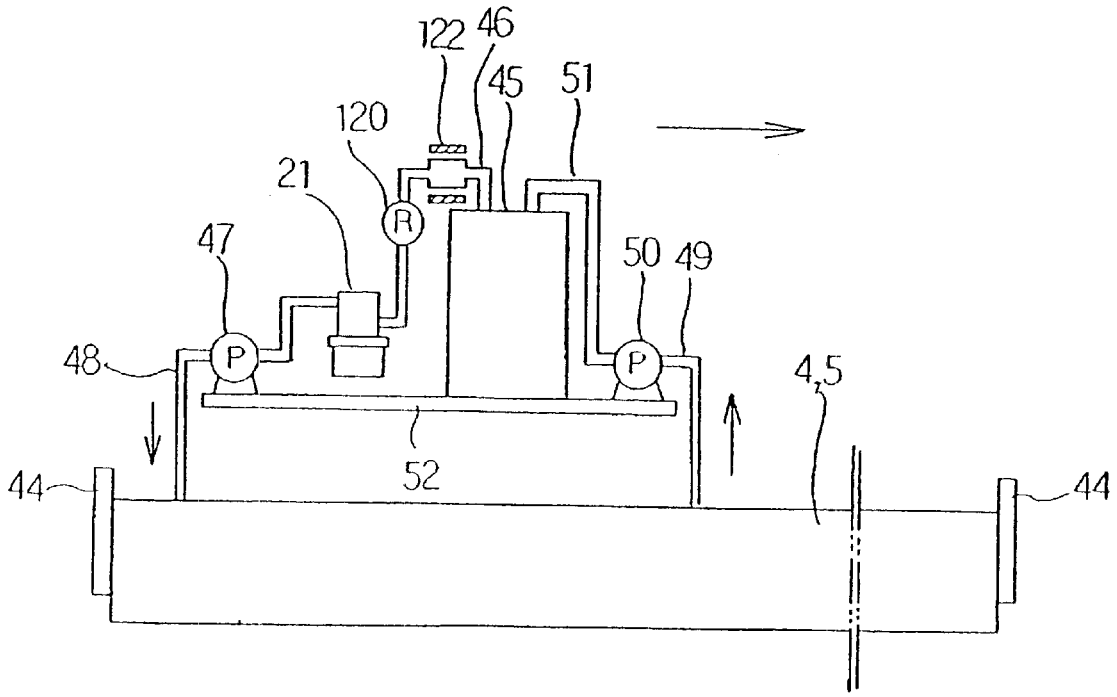
FIG. 9 is a schematic diagram illustrating an embodiment in which the ink viscosity measuring instrument of the present invention is used in a special flexo printing apparatus.

Next, an embodiment in which the ink viscosity measuring instrument 21 of the present invention is used in a flexo printing apparatus in which an ink tank and ink pumps are mounted in the vicinity of the ink roll 4 and wringing roll 5, or above these rolls, and ink is supplied and recovered while these components move in the axial direction of the ink roll 4 and wringing roll 5 will be described. The present applicant filed applications for the above-described printing apparatus in Japanese Patent Application No. H10-108000, etc.; and the ink viscosity measuring instrument 21 and ink viscosity measuring system of the present invention can be used in this flexo printing apparatus. As shown in FIG. 9, the ink supply and recovery device has the following construction: an ink tank 45 and two ink pumps 47 and 50 are mounted on a base 52 near or above an ink collecting area which is formed by damming both ends of the ink roll 4 and wringing roll 5 with damming members 44, 44, and ink passages 46 and 51 are respectively attached to these components. Furthermore, the ink collecting area may also use a chamber blade system in which a blade, etc. (not shown), is installed facing the ink roll 4. Moreover, as long as the ink pumps 47 and 50 are of a type that can alternately accomplish the supply and recovery of ink, these pumps are not limited to tubing pumps. Pumps of a type utilizing an increase and decrease in air pressure can be used.

Furthermore, the above-described ink supply and recovery device can be moved together with the base 52 in the axial direction of the ink roll 4 and wringing roll 5 using a moving mechanism (not shown). Moreover, the ink pumps 47 and 50 are both ink pumps whose rotation is reversible, so that these ink pumps can supply ink to the ink collecting area A formed by damming both ends of the ink roll 4 and wringing roll 5 and the space between the rolls, and can recover ink from this ink collecting area A. For example, when ink is initially supplied, the ink pumps 47 and 50 are operated so that ink flows toward the ink collecting area A from the ink tank 45, thus causing ink to be supplied via the ink supply and discharge ports 48 and 49. When the ink is recovered, the ink pumps 47 and 50 are operated so that ink flows toward the ink tank 45 from the ink collecting area A, thus causing the ink to be recovered via the ink supply and discharge ports 48 and 49. When ink is circulated via the ink pumps 47 and 50 between the ink tank 45 and the ink collecting area A formed between ink roll 4 and wringing roll 5, one of the ink pumps is operated so that ink is supplied to the ink collecting area A form the ink tank 45, while the other ink pump is operated so that the ink is recovered into the ink tank 45 from the ink collecting area A. Generally, when the ink supply and recovery device moves in the axial direction of the ink roll 4 and wringing roll 5, the ink pump in the direction of advance is mainly on the ink recovery side, while the other side is the ink supply side. Then, when the ink supply and recovery device returns, the ink supply side and ink recovery side are switched. In FIG. 9, an operation is illustrated in which the ink supply and recovery device moves from the left side to the right side as the viewer faces the page. In this case, the ink pump 47 supplies ink to the ink collecting area A from the ink tank 45, and the ink pump 50 recovers ink into the ink tank 45 from the ink collecting area A.

In a printing apparatus which has such an ink supply and recovery mechanism, the ink is caused to circulate between the ink tank 45 and the ink collecting area A formed between the ink roll 4 and the wringing roll 5 by the action of the ink pumps 47 and 50. However, as the ink is circulated for a long period of time, the viscosity of the ink may rise as a result of the moisture in the ink being emitted into the air. Furthermore, the moisture in the ink may evaporate as a result of the effects of frictional heat caused by the ink wringing action of the ink roll 4 and wringing roll 5 or the effects of mechanical heat generated by the action of the ink pumps 47 and 50, etc. as described above, so that the viscosity of the ink rises. In particular, the amount of ink carried in such an ink supply and recovery device is approximately ⅓ to ¼ the amount carried in a general printing apparatus, so that the absolute amount of ink circulating through the ink supply and recovery device including the ink collecting area A is not large. Accordingly, the heat generated by the above-described mechanical causes has a large effect on the ink, and the occurrence of unsatisfactory printing due to a rise in the viscosity of the ink must be prevented. In a case where an ink viscosity measuring instrument 21 and ink viscosity measuring device are installed in such an ink supply and recovery device, this ink viscosity measuring instrument 21 is installed in the ink passages 46, 51 that perform the supply and recovery of ink from the ink tank 45 to the ink collecting area A formed between the ink roll 4 and wringing roll 5, and from the ink collecting area A formed between the ink roll 4 and wringing roll 5 to the ink tank 45. Such an ink viscosity measuring instrument 21 may be installed in both of the ink passages 46 and 51, or may be installed in only one of these ink passages. In FIG. 9, such an ink viscosity measuring instrument 21 is installed between the ink pump 47 and the ink tank 45 in the ink passage 56 that runs from the ink tank 45 toward the ink collecting area A. Furthermore, the ink viscosity is measured by operating the ink viscosity measuring instrument 21 when ink is supplied by the ink pump 47 to the ink collecting area A formed between the ink roll 4 and wringing roll 5. The measurement of the ink viscosity is performed in the same manner as in the above-described system, and the ink viscosity is adjusted in accordance with variations in the ink viscosity. Furthermore, the measured ink viscosity value is displayed by an ink viscosity display device 25. Moreover, in cases where the ink viscosity value exceeds the upper-limit value or falls below the lower-limit value of the standard ink viscosity value, an error message is displayed by the ink viscosity display device 25, or the operator is informed of this abnormality by a warning device 54. Furthermore, in cases where abnormalities occur in the flow rate of the ink flowing through the ink viscosity measuring instrument 21 and ink passages 46 and 51, or in cases where other abnormalities occur, the abnormalities are displayed by the ink viscosity display device 25, or the operator is informed by the warning device 54.

Figure 10:
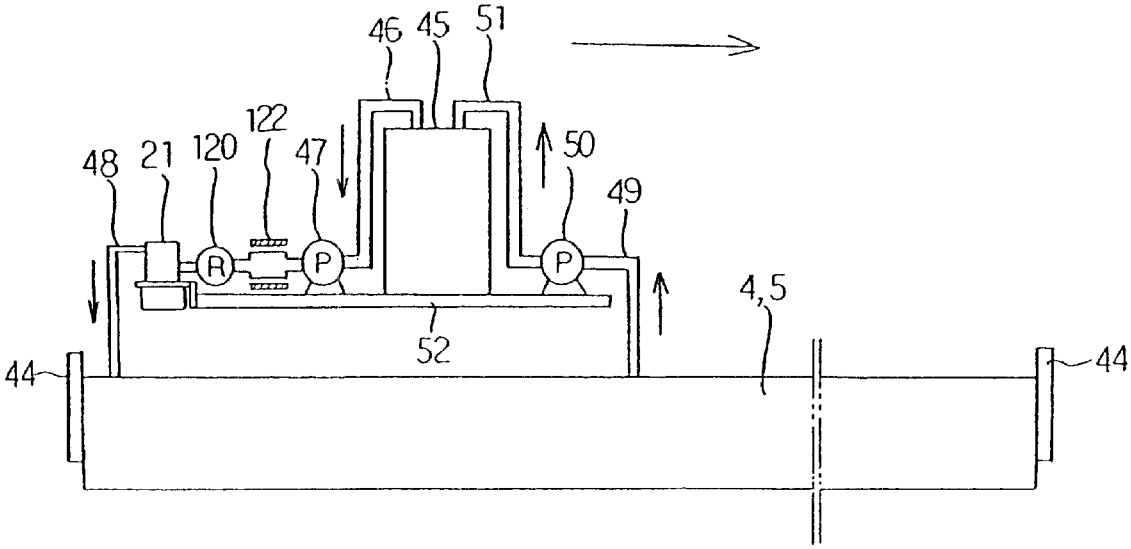
FIG. 10 is a schematic diagram illustrating an embodiment in which the ink viscosity measuring instrument of the present invention is used in a special flexo printing apparatus.

FIG. 10 illustrates a case in which the ink viscosity measuring instrument 21 is installed between the ink pump 47 and the ink collecting area A formed between the ink roll 4 and the wringing roll 5 in the ink passage 46 that runs from the ink tank 45 toward the ink collecting area A in an ink supply and recovery device similar to that shown in FIG. 9. Here, the ink viscosity measuring instrument 21 is operated so that the ink viscosity is measured when the ink pump 47 supplies ink to the ink collecting area A between the ink roll 4 and wringing roll 5. The measurement of the ink viscosity is performed in the same manner as in the above-described system, and the ink viscosity is adjusted according to variations in the ink viscosity. In FIG. 8, an embodiment is disclosed in which the ink viscosity measuring instrument 21 is installed on the side of the ink passage 46. However, it is also possible to install the ink viscosity measuring instrument 21 on the side of the other ink passage 51, or to install such an ink viscosity measuring instrument 21 in both ink passages 46 and 51.

In the automatic adjustment of the ink viscosity, the diluent liquid is added in cases where the ink viscosity has risen so that this viscosity exceeds the upper-limit value of the ink viscosity (according to the ink viscosity measurement results obtained by the above-described ink viscosity measuring device). The ink viscosity is measured by the ink viscosity measuring device, and the measurement results obtained by the ink viscosity measuring device are subjected to operational processing by the calculating section 152 inside the converter 24 of the control section 150, and sent to the ink viscosity automatic adjustment apparatus 26; then the diluent liquid is added by the ink viscosity automatic adjustment apparatus 26 so that the ink viscosity is adjusted. In regard to the means used to add the diluent liquid, this addition is performed by means of a system that is similar to the diluent liquid addition system used in the above-described embodiment. Accordingly, since the basic addition system including the setting of the amount added and the means of addition, etc. is the same as in the addition of the diluent liquid, a description is omitted here. However, since the ink supply and recovery device disclosed in FIGS. 9 and 10 is an ink supply and recovery device that has a construction in which the ink tank supplies and recovers ink and moves through an area near or above the ink roll 4 and wringing roll 5 while the ink is circulated, a diluent liquid tank (not shown) containing the diluent liquid is installed beside the ink tank 45, and a diluent liquid addition pump (not shown) similar to the ink pumps disclosed in FIGS. 9 and 10 is operated so that the diluent liquid is added from this point to the ink tank 45 or to the ink collecting area A that is formed between the ink roll 4 and wringing roll 5. Furthermore, a printing apparatus of this type may also have a means (not shown) for supplying the diluent liquid to both end parts of the ink collecting area A formed between the ink roll 4 and wringing roll 5, separately from the ink supply and recovery device, and the system may be arranged so that the diluent liquid is directly added to the ink collecting area A utilizing this diluent liquid supply means.

In the description above, only the diluent liquid addition system used to add the diluent liquid in order to lower the ink viscosity in cases where the ink viscosity had risen is described. In cases where the ink viscosity falls below the lower-limit value of the ink viscosity, however, the ink stock liquid is added. Generally, the ink viscosity may be caused to drop by the excessive supply of the diluent liquid in the addition of the diluent liquid, by the supply of diluent liquid from diluent liquid supply devices (not shown) installed at both ends of the ink collecting area A formed between the ink roll 4 and wringing roll 5, or by the supply of diluent liquid from a spray device, etc. (not shown), which sprays the diluent liquid toward the ink roll 4 or wringing roll 5, and which is installed in order to maintain the interior of the printing apparatus at a constant humidity. In such cases, the ink viscosity is measured by the same means as in the case of the ink viscosity measurement, and the measurement results obtained by the ink viscosity measuring device are subjected to calculations by the calculating section 152 inside the converter 24 of the control section 150 and sent to the ink viscosity automatic adjustment apparatus 26. Then, the ink stock liquid is added by the ink viscosity automatic adjustment apparatus 26 so that the viscosity of the ink is adjusted. The ink stock liquid addition system also operates by a system similar to the water or diluent liquid addition system. The ink stock liquid is added via an ink stock liquid addition pump (not shown) from an ink stock liquid tank (not shown). Since the addition system including the setting of the amount added and the means of addition, etc. are basically the same as in the addition of the diluent liquid, a description is omitted here. However, the ink supply and recovery device disclosed in FIGS. 9 and 10 is constructed so that the ink tank supplies and recovers the ink, and moves through an area near or above the ink roll 4 and wringing roll 5 while causing the ink to circulate. Accordingly, the system may also be constructed so that a small ink stock liquid tank (not shown) containing the ink stock liquid is installed beside the ink tank 45, and so that an ink stock liquid addition pump (not shown) similar to the ink pumps disclosed in FIGS. 9 and 10 is operated, thus causing the ink stock liquid to be added from this point to the ink tank 45 or the ink collecting area A formed between the ink roll 4 and wringing roll 5, etc.

Furthermore, in order to obtain accurate ink viscosity measurement results in the ink viscosity measuring instrument 21 installed in such an ink supply and recovery device, a flow meter 120 and a foreign matter removal device 122 may be installed in the ink passages 46 and 51, so that the accuracy of the ink viscosity measurements is increased by obtaining the above-described effects of the flow meter 120 and foreign matter removal device 122. It is desirable that the positions where the flow meter 120 and foreign matter removal device 122 are installed be on the downstream side of the ink tank 45 between the ink tank 45 and the ink viscosity measuring instrument 21. However, since the object of the flow meter 120 can be achieved as long as the flow of ink through the ink viscosity measuring instrument 21 can be measured by the flow meter 120, it is also possible to install the flow meter 120 on the downstream side of the ink viscosity measuring instrument 21, i.e., on the side of the ink collecting area A formed between the ink roll 4 and wringing roll 5.

Figure 11:
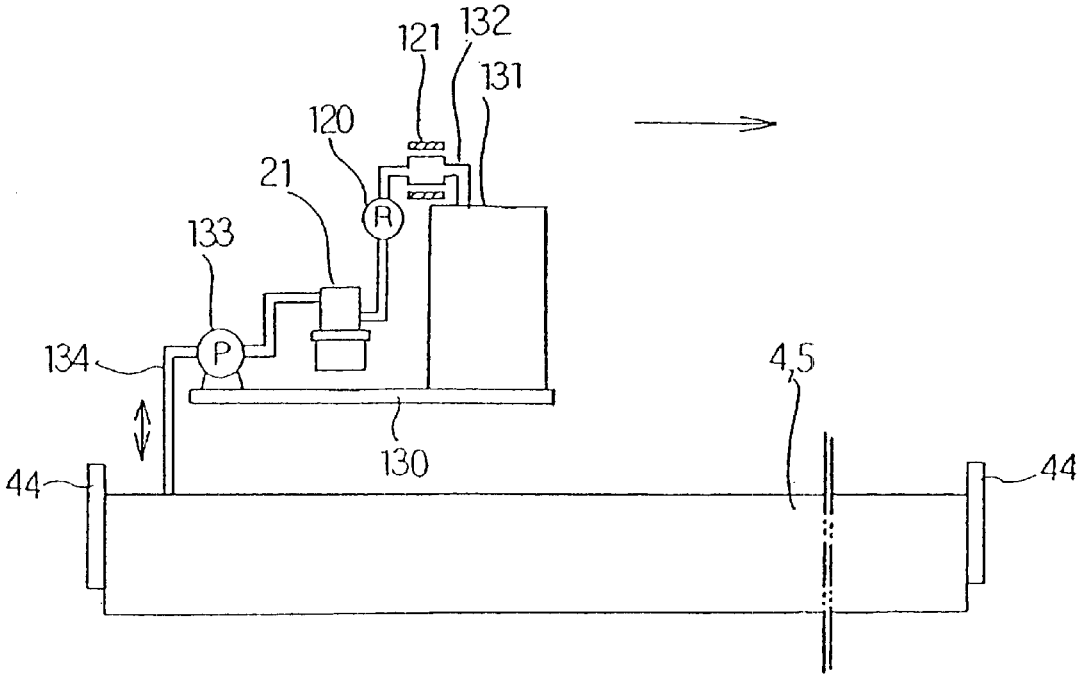
FIG. 11 is a schematic diagram illustrating an embodiment in which the ink viscosity measuring instrument of the present invention is used in a special flexo printing apparatus.

Next, an embodiment in which the ink viscosity measuring instrument 21 of the present invention is used in a printing apparatus in which an ink tank and an ink pump are mounted in the vicinity of the ink roll 4 and wringing roll 5, or above these rolls, and ink is supplied while these components move in the axial direction of the ink roll 4 and wringing roll 5 will be described. The applicants of the present application filed applications for the above-described printing apparatus in Japanese Patent Application Nos. H3-92953, H4-27236, etc. By using the printing mechanism disclosed in these applications to perform the supply and recovery of ink whenever required, it is possible to circulate ink between the ink tank 131 and the ink collecting area A formed between the ink roll 4 and wringing roll 5. In this case, the ink viscosity measuring instrument 21 and ink viscosity measurement system of the present invention can be used in such a printing apparatus. As shown in FIG. 11, the ink supply and recovery device has a construction in which the ink tank 131 and a single ink pump 133 are mounted on a base 130 near or above the ink collecting area A, which is formed by damming both ends of the ink roll 4 and wringing roll 5 with damming members 44, 44, and ink passages 132 are attached. Furthermore, the ink collecting area A may also use a chamber blade system in which a blade, etc. (not shown), is installed facing the ink roll 4. Moreover, as long as the ink pump 133 is of a type that can alternately accomplish the supply and recovery of ink, this pump is not limited to a tubing pump; a pump of a type that utilizes an increase and decrease in air pressure may also be used.

Furthermore, the above-described ink supply and recovery device can be moved together with the base 130 in the axial direction of the ink roll 4 and wringing roll 5 using a moving mechanism (not shown). Moreover, the ink pump 133 is reversible in its rotation, so that this ink pump can supply ink to the ink collecting area A formed by damming both ends of the ink roll 4 and wringing roll 5 and the space between the rolls, and can recover ink from this ink collecting area A. For example, when ink is initially supplied, the ink pump 133 is operated so that ink flows toward the ink collecting area A from the ink tank 131, thus causing ink to be supplied via the ink discharge port 134. When the ink is recovered, the ink pump 133 is operated so that ink flows toward the ink tank 131 from the ink collecting area A, thus causing the ink to be recovered via the ink discharge port 134. When ink is circulated via the ink pump 133 between the ink tank 131 and the ink collecting area A formed between the ink roll 4 and wringing roll 5, the ink pump 133 operates so that ink is supplied to the ink collecting area A form the ink tank 131 while the ink supply and recovery device moves in one direction over the ink collecting area A formed between the ink roll 4 and wringing roll 5, and the ink pump 133 operates so that ink is recovered into the ink tank 131 from the ink collecting area A while the ink supply and recovery device is moved in the opposite direction. Furthermore, it is also possible to cause the system to operate in an action centered on the central portion of the machine with respect to the direction of width of the machine, so that ink is supplied when the ink supply and recovery device moves from the central portion of the machine toward the outside with respect to the direction of width of the machine, and so that ink is recovered when the ink supply and recovery device moves toward the central portion of the machine from the outside with respect to the direction of width of the machine. Alternatively, the system may be arranged so that the opposite action is performed.

In a printing apparatus which has such an ink supply and recovery mechanism, the ink is caused to circulate between the ink tank 131 and the ink collecting area A formed between the ink roll 4 and the wringing roll 5 by the action of the ink pump 133. However, as the ink is circulated for a long period of time, the viscosity of the ink may rise as a result of the moisture in the ink being emitted into the air. Furthermore, the moisture in the ink may evaporate as a result of the effects of frictional heat caused by the ink wringing action of the ink roll 4 and wringing roll 5 or the effects of mechanical heat generated by the action of the ink pump 133, etc., as described above, so that the viscosity of the ink rises. In particular, the amount of ink carried in such an ink supply and recovery device is approximately ⅓ to ¼ the amount carried in a general printing apparatus, so that the absolute amount of ink circulating through the ink supply and recovery device including the ink collecting area A is not large. Accordingly, the heat generated by the above-described mechanical causes has a large effect on the ink, and the occurrence of unsatisfactory printing due to a rise in the viscosity of the ink must be prevented. In a case where an ink viscosity measuring instrument 21 and ink viscosity measuring device are installed in such an ink supply and recovery device, this ink viscosity measuring instrument 21 is installed in the ink passages 132 that perform the supply and recovery of ink from the ink tank 131 to the ink collecting area A formed between the ink roll 4 and wringing roll 5, and from the ink collecting area A formed between the ink roll 4 and wringing roll 5 to the ink tank 131. Such an ink viscosity measuring instrument 21 may be installed in both of the ink passages 132, or may be installed in only one of these ink passages. In FIG. 11, the ink viscosity measuring instrument 21 is installed between the ink pump 133 and the ink tank 131 in the ink passage 132 that runs from the ink tank 131 toward the ink collecting area A. Furthermore, the ink viscosity is measured by operating the ink viscosity measuring instrument 21 when ink is supplied by the ink pump 133 to the ink collecting area A formed between the ink roll 4 and wringing roll 5. The measurement of the ink viscosity is performed in the same manner as in the above-described system, and the ink viscosity is adjusted in accordance with variations in the ink viscosity. Furthermore, the measured ink viscosity value is displayed by an ink viscosity display device 25. Moreover, in cases where the ink viscosity value exceeds the upper-limit value or falls below the lower-limit value of the standard ink viscosity value, an error message is displayed by the ink viscosity display device 25, or the operator is informed of this abnormality by a warning device 54. Furthermore, in cases where abnormalities occur in the flow rate of the ink flowing through the ink viscosity measuring instrument 21 and ink passages 132, or in cases where other abnormalities occur, the abnormalities are displayed by the ink viscosity display device 25, or the operator is informed by the warning device 54.

Figure 12:
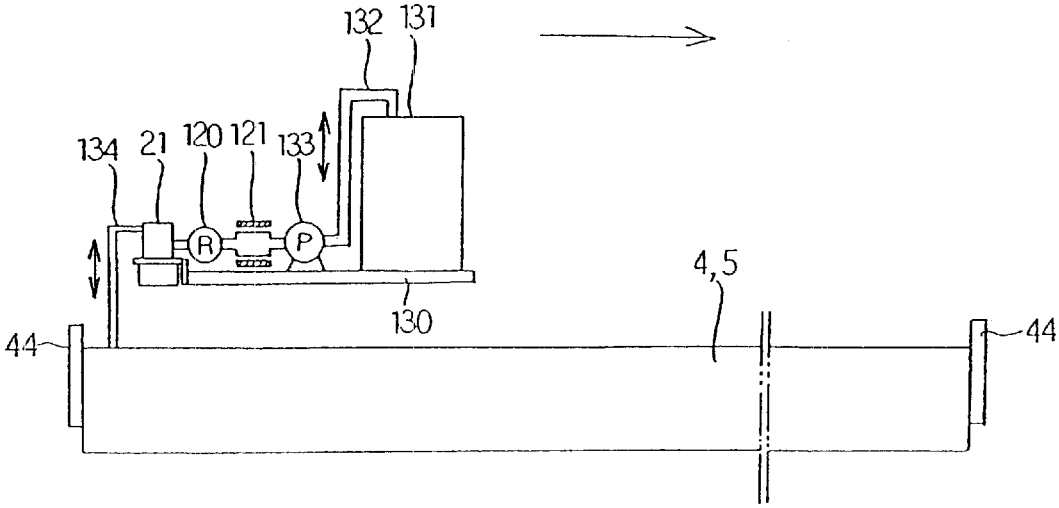
FIG. 12 is a schematic diagram illustrating an embodiment in which the ink viscosity measuring instrument of the present invention is used in a special flexo printing apparatus.

FIG. 12 illustrates a case in which the ink viscosity measuring instrument 21 is installed between the ink pump 133 and the ink collecting area A formed between the ink roll 4 and the wringing roll 5 in the ink passage 132 that runs from the ink tank 131 toward the ink collecting area A in an ink supply and recovery device similar to that shown in FIG. 11. Here, the ink viscosity measuring instrument 21 is operated so that the ink viscosity is measured when the ink pump 133 supplies ink to the ink collecting area A between the ink roll 4 and wringing roll 5. The measurement of the ink viscosity is performed in the same manner as in the above-described system, and the ink viscosity is adjusted according to variations in the ink viscosity.

In the automatic adjustment of the ink viscosity, the diluent liquid is added in cases where the ink viscosity has risen so that this viscosity exceeds the upper-limit value of the ink viscosity (according to the ink viscosity measurement results obtained by the ink viscosity measuring device). The ink viscosity is measured by the ink viscosity measuring device, and the measurement results obtained by the ink viscosity measuring device are subjected to operational processing by the calculating section 152 inside the converter 24 of the control section 150, and sent to the ink viscosity automatic adjustment apparatus 26; then the diluent liquid is added by the ink viscosity automatic adjustment apparatus 26 so that the ink viscosity is adjusted. In regard to the means used to supply the diluent liquid, this supply is performed by means of a system that is similar to the diluent liquid addition system used in the above-described embodiment. Accordingly, since the basic addition system including the setting of the amount added and the means of addition, etc. is the same as in the addition of the diluent liquid, a description is omitted here. However, since such an ink supply and recovery device, and especially the ink supply and recovery device disclosed in FIGS. 11 and 12, has a construction in which the ink tank supplies and recovers ink and moves through an area near or above the ink roll 4 and wringing roll 5 while the ink is circulated, a diluent liquid tank (not shown) containing the diluent liquid is installed beside the ink tank 131, and a diluent liquid addition pump (not shown) similar to the ink pump disclosed in FIGS. 11 and 12 is operated so that the diluent liquid is supplied from this point to the ink tank 131 or to the ink collecting area A that is formed between the ink roll 4 and wringing roll 5. Furthermore, a printing apparatus of this type may also have a means (not shown) for supplying the diluent liquid to both end parts of the ink collecting area A formed between the ink roll 4 and wringing roll 5, separately from the ink supply and recovery device, and the system may be arranged so that the diluent liquid is directly added to the ink collecting area A utilizing this diluent liquid supply means.

In the description above, only the diluent liquid addition system used to add the diluent liquid in order to lower the ink viscosity in cases where the ink viscosity had risen is described. In cases where the ink viscosity falls below the lower-limit value of the ink viscosity, however, the ink stock liquid is added. Generally, the ink viscosity may be caused to drop by the excessive supply of the diluent liquid in the addition of the diluent liquid, by the supply of diluent liquid from diluent liquid supply devices (not shown) installed at both ends of the ink collecting area A formed between the ink roll 4 and wringing roll 5, or by the supply of diluent liquid from a spray device, etc. (not shown), which sprays the diluent liquid toward the ink roll 4 or wringing roll 5, and which is installed in order to maintain the interior of the printing apparatus at a constant humidity. In such cases, the ink viscosity is measured by the same means as in the case of the ink viscosity measurement, and the measurement results obtained by the ink viscosity measuring device are subjected to calculations by the calculating section 152 inside the converter 24 of the control section 150 and sent to the ink viscosity automatic adjustment apparatus 26. Then, the ink stock liquid is added by the ink viscosity automatic adjustment apparatus 26 so that the viscosity of the ink is adjusted. The ink stock liquid addition system also operates by a system similar to the water or diluent liquid addition system. The ink stock liquid is added via an ink stock liquid addition pump (not shown) from an ink stock liquid tank (not shown). Since the addition system including the setting of the amount added and the means of addition, etc. are basically the same as in the addition of the diluent liquid, a description is omitted here. However, this ink supply device, and especially the ink supply and recovery device disclosed in FIGS. 11 and 12 is constructed so that the ink tank supplies and recovers the ink, and moves through an area near or above the ink roll 4 and wringing roll 5 while causing the ink to circulate. Accordingly, the system may also be constructed so that a small ink stock liquid tank (not shown) containing the ink stock liquid is installed beside the ink tank 131, and so that an ink stock liquid addition pump (not shown) similar to the ink pump disclosed in FIGS. 11 and 12 is operated, thus causing the ink stock liquid to be added from this point to the ink tank 131 or the ink collecting area A formed between the ink roll 4 and wringing roll 5, etc.

Furthermore, in order to obtain accurate ink viscosity measurement results in the ink viscosity measuring instrument 21 installed in such an ink supply and recovery device, a flow meter 120 and a foreign matter removal device 122 may be installed in the ink passages 132, so that the accuracy of the ink viscosity measurements is increased by obtaining the above-described effects of the flow meter 120 and foreign matter removal device 122. It is desirable that the positions where the flow meter 120 and foreign matter removal device 122 are installed be on the downstream side of the ink tank 131 between the ink tank 131 and the ink viscosity measuring instrument 21. However, since the object of the flow meter 120 can be achieved as long as the flow of ink through the ink viscosity measuring instrument 21 can be measured by the flow meter 120, it is also possible to install the flow meter 120 on the downstream side of the ink viscosity measuring instrument 21, i.e., on the side of the ink collecting area A formed between the ink roll 4 and wringing roll 5.

Figure 13:
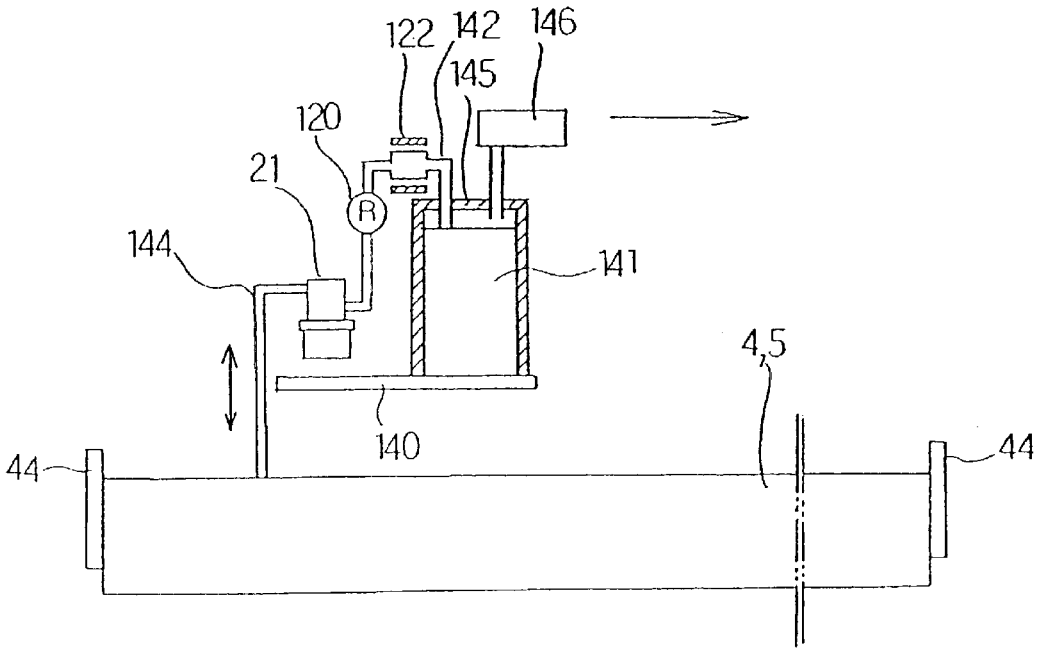
FIG. 13 is a schematic diagram illustrating an embodiment in which the ink viscosity measuring instrument of the present invention is used in a special flexo printing apparatus.

Next, an embodiment will be described in which the ink viscosity measuring instrument 21 of the present invention is used in a printing apparatus which has an ink supply and recovery device that is more or less similar to the ink supply and recovery device illustrated in FIGS. 11 and 12, and in which an ink tank is mounted near or above the ink roll 4 and wringing roll 5, and ink is supplied while this ink tank is caused to move in the axial direction of the ink roll 4 and wringing roll 5 by the action of a pressurizing-depressurizing device. Applications for the above-described printing apparatus have been field by others in Japanese Patent Application Laid-Open (Kokai) Nos. H9-216344 and H9-234852. By using the printing mechanism disclosed in these applications to perform the supply and recovery of ink whenever required, it is possible to circulate ink between the ink tank 141 and the ink collecting area A formed between the ink roll 4 and wringing roll 5. In this case, the ink viscosity measuring instrument 21 and ink viscosity measurement system of the present invention can be used in such a printing apparatus. As shown in FIG. 13, the ink supply and recovery device has a construction in which the ink tank 141, which is accommodated inside a tightly closed pressure vessel 145, and a pressurizing-depressurizing device 146 which pressurizes and depressurizes the interior of this tightly closed pressure vessel 145, are mounted on a base 140 near or above an ink collecting area which is formed by damming both ends of the ink roll 4 and wringing roll 5 with damming members 44, 44, and an ink passage 142 is attached. Furthermore, it is also possible to mount the pressurizing-depressurizing device 146 somewhere inside the printing apparatus instead of mounting this device on the base 140, and to connect the pressurizing-depressurizing device 146 and tightly closed pressure vessel 145 by means of air piping, etc. In the above construction, the ink collecting area may also use a chamber blade system in which a blade, etc. (not shown), is installed facing the ink roll 4.

Furthermore, the above-described ink supply and recovery device can be moved together with the base 140 in the axial direction of the ink roll 4 and wringing roll 5 using a moving mechanism (not shown). Moreover, the pressurizing-depressurizing device 146 is a device which can pressurize and depressurize the interior of the tightly closed pressure vessel 145 by the action of air using, for instance, a compressor, etc., so that ink inside the ink tank 141 can be supplied to the ink collecting area A formed by damming the space between the ink roll 4 and wringing roll 5 and both ends of these components, and so that ink can be recovered from this ink collecting area A, by pressurizing and depressurizing the interior of the tightly closed pressure vessel 145. For example, when ink is initially supplied, the pressurizing-depressurizing device 146 pressurizes the interior of the tightly closed pressure vessel 145 so that ink flows from the ink tank 141 toward the ink collecting area A, thus causing ink to be supplied via the ink supply and discharge port 144. When ink is recovered, the pressurizing-depressurizing device 146 depressurizes interior of the tightly closed pressure vessel 145 so that ink flows from the ink collecting area toward the ink tank 141, thus causing ink to be recovered via the ink supply and discharge port 144. When ink is circulated between the ink tank 141 and the ink collecting area A formed between the ink roll 4 and wringing roll 5, the pressurizing-depressurizing device 146 pressurizes the interior of the tightly closed pressure vessel 145 so that ink flows from the ink tank 141 toward the ink collecting area A while the ink supply and recovery device moves in one direction over the ink collecting area A formed between the ink roll 4 and wringing roll 5, thus causing ink to be supplied via the ink supply and discharge port 144, and the pressurizing-depressurizing device 146 depressurizes the interior of the tightly closed pressure vessel 145 so that ink flows from the ink collecting area A toward the ink tank 141 while the ink supply and recovery device moves in the opposite direction, thus causing ink to be recovered via the ink supply and discharge port 144. Furthermore, it is also possible to cause the system to operate in an action centered on the central portion of the machine with respect to the direction of width of the machine, so that ink is supplied when the ink supply and recovery device moves from the central portion of the machine toward the outside with respect to the direction of width of the machine, and so that ink is recovered when the ink supply and recovery device moves toward the central portion of the machine from the outside with respect to the direction of width of the machine. Alternatively, the system may be arranged so that the opposite action is performed.

In a printing apparatus which has such an ink supply and recovery mechanism, the ink is caused to circulate between the ink tank 141 and the ink collecting area A formed between the ink roll 4 and the wringing roll 5 by the action of the pressurizing-depressurizing device 146 and tightly closed pressure vessel 145. However, as the ink is circulated for a long period of time, the viscosity of the ink may rise as a result of the moisture in the ink being emitted into the air. Furthermore, the moisture in the ink may evaporate as a result of the effects of frictional heat caused by the ink wringing action of the ink roll 4 and wringing roll 5 as described above, so that the viscosity of the ink rises. In particular, the amount of ink carried in such an ink supply and recovery device is approximately ⅓ to ¼ the amount carried in a general printing apparatus, so that the absolute amount of ink circulating through the ink supply and recovery device including the ink collecting area is not large. Accordingly, the heat generated by the above-described mechanical causes has a large effect on the ink, and the occurrence of unsatisfactory printing due to a rise in the viscosity of the ink must be prevented. In a case where an ink viscosity measuring instrument 21 and ink viscosity measuring device are installed in such an ink supply and recovery device, this ink viscosity measuring instrument 21 is installed in the ink passage 142 that performs the supply and recovery of ink from the ink tank 141 to the ink collecting area A formed between the ink roll 4 and wringing roll 5, and from the ink collecting area A formed between the ink roll 4 and wringing roll 5 to the ink tank 141. In FIG. 13, the ink viscosity measuring instrument 21 is installed on the downstream side of the ink tank 141 in the ink passage 142 that runs from the ink tank 141 toward the ink collecting area A. Furthermore, the ink viscosity is measured by operating the ink viscosity measuring instrument 21 when ink is supplied to the ink collecting area A formed between the ink roll 4 and wringing roll 5. The measurement of the ink viscosity is performed in the same manner as in the above-described system, and the ink viscosity is adjusted in accordance with variations in the ink viscosity. Furthermore, the measured ink viscosity value is displayed by an ink viscosity display device 25. Moreover, in cases where the ink viscosity value exceeds the upper-limit value or falls below the lower-limit value of the standard ink viscosity value, an error message is displayed by the ink viscosity display device 25, or the operator is informed of this abnormality by a warning device 54. Furthermore, in cases where abnormalities occur in the flow rate of the ink flowing through the ink viscosity measuring instrument 21 and ink passage 142, or in cases where other abnormalities occur, the abnormalities are displayed by the ink viscosity display device 25, or the operator is informed by the warning device 54.

In the automatic adjustment of the ink viscosity, the diluent liquid is added in cases where the ink viscosity has risen so that this viscosity exceeds the upper-limit value of the ink viscosity (according to the ink viscosity measurement results obtained by the ink viscosity measuring device). The ink viscosity is measured by the ink viscosity measuring device, and the measurement results obtained by the ink viscosity measuring device are subjected to operational processing by the calculating section 152 inside the converter 24 of the control section 150, and sent to the ink viscosity automatic adjustment apparatus 26. Then, the diluent liquid is added by the ink viscosity automatic adjustment apparatus 26 so that the ink viscosity is adjusted. In regard to the means used to add the diluent liquid, this addition is performed by means of a system that is similar to the diluent liquid addition system used in the above-described embodiment. Accordingly, since the basic addition system including the setting of the amount added and the means of addition, etc. is the same as in the addition of the diluent liquid, a description is omitted here. However, since the ink supply and recovery device disclosed in FIG. 13 has a construction in which the ink is supplied and recovered by the action of the pressurizing-depressurizing device 146, and this ink supply and recovery device moves near or over the ink roll 4 and wringing roll 5 while the ink is circulated, a diluent liquid tank (not shown) which contains the diluent liquid is installed beside the ink tank 141. Furthermore, a pressurizing-depressurizing device (not shown) used for diluent liquid addition, which is similar to the pressurizing-depressurizing device disclosed in FIG. 13, is installed at this point, so that the diluent liquid is added to the ink tank 141 or ink collecting area A from here. Alternatively, a switching valve, etc. (not shown), is installed in the pressurizing-depressurizing device 146 disclosed in FIG. 13, and the system is arranged so that the action of the pressurizing-depressurizing device 146 is applied to the diluent liquid tank by switching this switching valve; then, the pressurizing-depressurizing device 146 is operated so that the diluent liquid is added to the ink tank 141 or the ink collecting area A formed between the ink roll 4 and wringing roll 5. Furthermore, a printing apparatus of this type may also have a means (not shown) for supplying the diluent liquid to both end parts of the ink collecting area A formed between the ink roll 4 and wringing roll 5, separately from the ink supply and recovery device, and the system may be arranged so that the diluent liquid is directly added to the ink collecting area A utilizing this diluent liquid supply means.

In the description above, the diluent liquid addition system used to add the diluent liquid in order to lower the ink viscosity in cases where the ink viscosity had risen is described. In cases where the ink viscosity falls below the lower-limit value of the ink viscosity, however, the ink stock liquid is added. Generally, the ink viscosity may be caused to drop by the excessive supply of the diluent liquid in the addition of the diluent liquid, by the supply of diluent liquid from diluent liquid supply devices (not shown) installed at both ends of the ink collecting area A formed between the ink roll 4 and wringing roll 5, or by the supply of diluent liquid from a spray device, etc. (not shown), which sprays the diluent liquid toward the ink roll 4 or wringing roll 5, and which is installed in order to maintain the interior of the printing apparatus at a constant humidity. In such cases, the ink viscosity is measured by the same means as in the case of the ink viscosity measurement, and the measurement results obtained by the ink viscosity measuring device are subjected to calculations by the calculating section 152 inside the converter 24 of the control section 150 and sent to the ink viscosity automatic adjustment apparatus 26. Then, the ink stock liquid is added by the ink viscosity automatic adjustment apparatus 26 so that the viscosity of the ink is adjusted. The ink stock liquid addition system also operates by a system similar to the water or diluent liquid addition system. The ink stock liquid is added via an ink stock liquid addition pump (not shown) from an ink stock liquid tank (not shown). Since the addition system including the setting of the amount added and the means of addition, etc. are basically the same as in the addition of the diluent liquid, a description is omitted here. However, this ink supply and recovery device, and especially the ink supply and recovery device disclosed in FIG. 13 is constructed so that the ink tank 141 supplies and recovers the ink, and moves through an area near or above the ink roll 4 and wringing roll 5 while causing the ink to circulate. Accordingly, the system may also be constructed so that a small ink stock liquid tank (not shown) containing the ink stock liquid is installed beside the ink tank 141, and so that a pressurizing-depressurizing device (not shown) used for ink stock liquid addition, which is similar to the pressurizing-depressurizing device 146 disclosed in FIG. 13, is operated, thus causing the ink stock liquid to be added from this point to the ink tank 141 or the ink collecting area A formed between the ink roll 4 and wringing roll 5, etc.

Furthermore, in order to obtain accurate ink viscosity measurement results in the ink viscosity measuring instrument 21 installed in such an ink supply and recovery device, a flow meter 120 and a foreign matter removal device 122 may be installed in the ink passage 142, so that the accuracy of the ink viscosity measurements is increased by obtaining the above-described effects of the flow meter 120 and foreign matter removal device 122. It is desirable that the positions where the flow meter 120 and foreign matter removal device 122 are installed be on the downstream side of the ink tank 141 between the ink tank 141 and the ink viscosity measuring instrument 21. However, since the object of the flow meter 120 can be achieved as long as the flow of ink through the ink viscosity measuring instrument 21 can be measured by the flow meter 120, it is also possible to install the flow meter 120 on the downstream side of the ink viscosity measuring instrument 21, i.e., on the side of the ink collecting area A formed between the ink roll 4 and wringing roll 5.

Next, another embodiment of the ink viscosity measurement shown in FIG. 14 will be described. In order for the ink viscosity measuring instrument 21 to obtain an accurate measurement of the viscosity of the ink flowing through, it is necessary that a fixed surface area of the first rotating body 33 of the ink viscosity measuring instrument 21 contact the ink that flows through the ink passage 10. The ink that flows through the ink passage 10 does not flow through in a state in which the entire interior of the ink passage 10 is filled with ink; and generally, some air, etc. is admixed with the ink inside the ink passage 10 so that an air layer is formed in the upper area of the interior of the ink passage 10. In order to eliminate the effects of this air layer, the ink passage 10 is bent only at the place where the ink viscosity measuring instrument 21 is installed, and the ink viscosity measuring instrument 21 is installed in a position that is lower than the side 10*a* from which the ink flows in and the side 10*b* on which the ink flows out. As a result, the first rotating body 33 is completely immersed in the ink that flows through. However, as long as a fixed area of the first rotating body 33 of the ink viscosity measuring instrument 21 is in contact with the ink that flows through, it is not absolutely necessary to bend the ink passage 10; and the first rotating body 33 may also be installed in a straight passage. Furthermore, in regard to the place where the ink viscosity measuring instrument 21 is installed, besides using a system in which the ink supply passage is bent as described above, it is also possible to use a U-shaped passage configuration, and to install the ink viscosity measuring instrument 21 in the lowest part of this U-shaped passage configuration. Furthermore, it is also possible to perform ink viscosity measurements with the ink viscosity measuring instrument 21 installed in a portion having the shape of a buffer tank, as long as this shape allows the secure flow of ink. However, it is desirable to measure the ink viscosity in a state in which the ink is constantly flowing.

Next, an ink viscosity measuring instrument based on a different configuration will be described. The ink viscosity measuring instrument of the present invention is not limited to an ink viscosity measuring instrument of the type shown in FIG. 2. As long as the viscosity of the ink flowing through can be measured by measuring the rotational driving load current value of a rotating body that rotates at a constant speed, an ink viscosity measuring instrument 60 of the configuration shown, for instance, in FIG. 15 can also be used. In the ink viscosity measuring instrument 60 disclosed in FIG. 15, ink flows through the space between an inner covering body 63 and outer covering body 68 which are installed between ink supply passages 70 and 71, and which are attached to a bracket 72. Furthermore, a rotor 64 which has flow-regulating vanes 67 and magnetic bodies 65 that measure the viscosity of the ink flowing through is mounted so that the rotor is free to rotate on a freely rotating shaft 66 which is shaft-supported between bearings 69 attached to the inner covering body 63 and outer covering body 68. Furthermore, rotating field circuits 62*a* and 62*b* are installed in positions facing the rotor 64 with the inner covering body 63 interposed. These rotating field circuits 62*a* and 62*b* are connected to a field control device 61, and the system is controlled by this field control device 61 so that a rotating field effect is generated in the rotating field circuits 62*a* and 62*b*. The rotating field circuits 62*a* and 62*b* are field windings whose magnetic field is periodically switched, and rotation is imparted to the rotating body 64 by the like-pole repulsion that occurs upon the switching of the polarity of these rotating field circuits 62*a* and 62*b*.

Specifically, when the field control device 61 operates, the rotating field circuits 62*a* and 62*b* are magnetically coupled with the magnetic bodies of the rotating body 64 as a result of being powered by the field control device 61, so that the rotating field circuits 62*a* and 62*b* are controlled by the so-called stepping motor principle in which rotation is imparted to the rotating body 64 by the switching of the magnetic field applied to the rotating field circuits 62*a* and 62*b* by the field control device 61. As a result of the action of this magnetism, the magnetic bodies 65 inside the rotating body 64 which is installed in a position facing the rotating field circuits 62*a* and 62*b* rotate, thus causing the rotating body 64 to rotate. The system is controlled by the field control device 61 so that the rotating body 64 always rotates at a constant rotational speed. The field control device 61 controls the system so that the rotating body 64 is always caused to rotate at a constant rotational speed even if variations occur in the viscosity of the ink flowing through. The rotating field circuit load current value generated inside the field control device 61 in this case is measured, and this value is converted into the viscosity of the ink by the converter 24 shown in FIG. 1. Furthermore, the ink viscosity in this case is displayed by an ink viscosity display device 25, and in cases where the ink viscosity departs from a preset appropriate range of ink viscosity values, the operator is informed of this by a warning device 54, etc. Furthermore, ink viscosity value measured by the ink viscosity measuring instrument 60 is processed by the control section 150, and the ink viscosity automatic adjustment apparatus 26 can automatically adjust the ink viscosity on the basis of the results of this processing. The automatic adjustment of the ink viscosity is as described above. Of course, the ink viscosity measuring instrument 60 of the configuration disclosed in FIG. 15 can also be applied to the embodiments disclosed in FIGS. 7 through 13, and it goes without saying that if the ink viscosity measuring instrument 60 has a size that allows accommodation inside the ink passage, this instrument can also be installed inside the ink passage as shown in FIG. 14.

Figure 15:
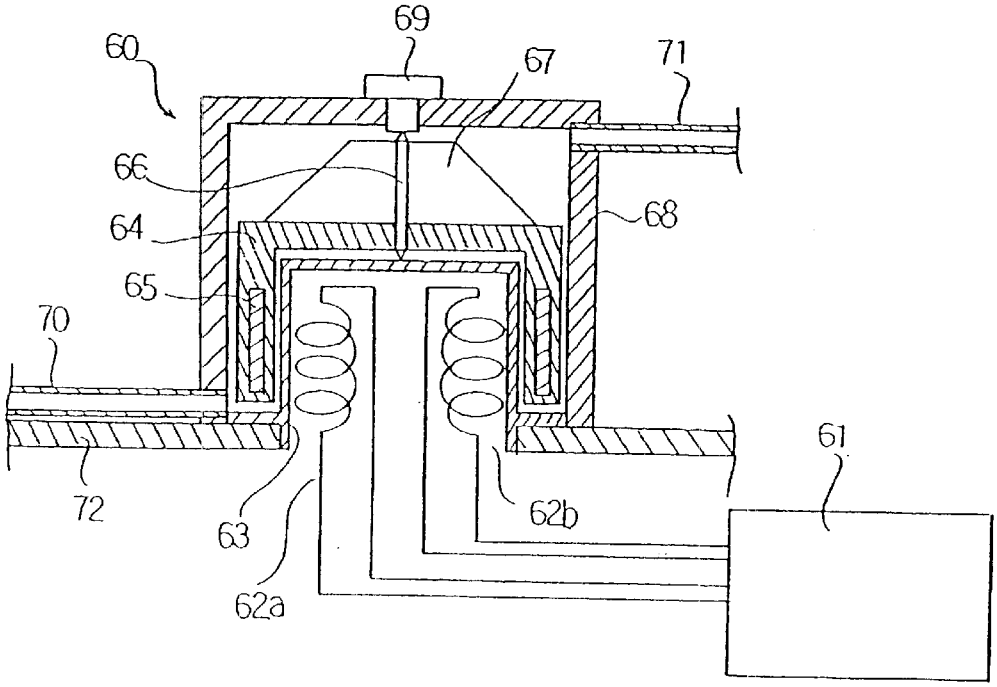
FIG. 15 is a longitudinal cross-section illustrating an embodiment of the ink viscosity measuring instrument which uses rotating field circuits.

Furthermore, FIG. 15 shows an embodiment in which the magnetic bodies 65 and rotating body 64 are caused to rotate by the action of a magnetic field using the principle of a so-called stepping motor. However, as another means, for example, it is also possible to accomplish such an operation using an embodiment in which a rotating current that corresponds to the rotating current of a so-called brushless DC motor winding is provided using the rotating current circuit shown in FIG. 16, and the magnetic bodies 165 and rotating body 164 are caused to rotate at a constant rotational speed by the action of this rotating current and the magnetic field generated by the magnetic bodies 165. More concretely, in the ink viscosity measuring instrument 160 disclosed in FIG. 16, ink flows through the space between an inner covering body 163 and outer covering body 168 which are installed between ink supply passages 170 and 171, and which are attached to a bracket 172. Furthermore, a rotating body 164 which has flow-regulating vanes 167 and magnetic bodies 165 that measure the viscosity of the ink flowing through is mounted so that the rotor is free to rotate on a freely rotating shaft 166 which is shaft-supported between bearings 169 attached to the inner covering body 163 and outer covering body 168. Furthermore, rotating current circuits 162*a* and 162*b* are installed in positions facing the rotor 164 with the inner covering body 163 interposed. These rotating current circuits 162*a* and 162*b* are connected to a current control device 161, and the system is controlled by this current control device 161 so that a rotating current effect is generated in the rotating current circuits 162*a* and 162*b* as a result of the direction of the current flowing through the rotating current circuits 162*a* and 162*b* being switched. The system is controlled by the action of the current control device 161 so that a rotating current effect is generated in the rotating current circuits 162*a* and 162*b*. The rotating current circuits 162*a* and 162*b* are current coils in which the direction of the current is periodically switched; and rotation is imparted to the rotating body 164 by the magnetic field and current effects that occur upon the switching of the direction of the current through the rotating current circuits 162*a* and 162*b*.

Specifically, when the current control device 161 operates, the rotating current circuits 162*a* and 162*b* are magnetically coupled with the magnetic bodies 165 of the rotating body 164 as a result of these rotating current circuits being powered by the current control device 161. The rotating current circuits 162*a* and 162*b* are controlled by the principle of a so-called brushless DC motor, in which rotation is imparted to the rotating body 164 as a result of the direction of the current applied to the rotating current circuits 162*a* and 162*b* being switched by the current control device 161. As a result of the action of this magnetism, the magnetic bodies 165 inside the rotating body 164 which is installed in a position facing the rotating current circuits 162*a* and 162*b* rotate, thus causing the rotating body 164 to rotate. The system is controlled by the current control device 161 so that the rotating body 164 always rotates at a constant speed; and the current control device 161 controls the system so that the rotating body 164 is always caused to rotate at a constant rotational speed even if variations occur in the viscosity of the ink flowing through. The rotating current circuit load current value generated inside the current control device 161 in this case is measured, and this value is converted into the viscosity of the ink by the converter 24 shown in FIG. 1. Furthermore, the ink viscosity in this case is displayed by an ink viscosity display device 25, and in cases where the ink viscosity departs from a preset appropriate range of ink viscosity values, the operator is informed of this by a warning device 54, etc. Furthermore, ink viscosity value measured by the ink viscosity measuring instrument 160 is processed by the control section 150, and the ink viscosity automatic adjustment apparatus 26 can automatically adjust the ink viscosity on the basis of the results of this processing. The automatic adjustment of the ink viscosity is as already described above. Of course, the ink viscosity measuring instrument 160 of the configuration disclosed in FIG. 16 can also be applied to the embodiments disclosed in FIGS. 9 through 13, and it goes without saying that if the ink viscosity measuring instrument 160 has a size that allows accommodation inside the ink passage, this instrument can also be installed inside the ink passage as shown in FIG. 14.

Figure 16:
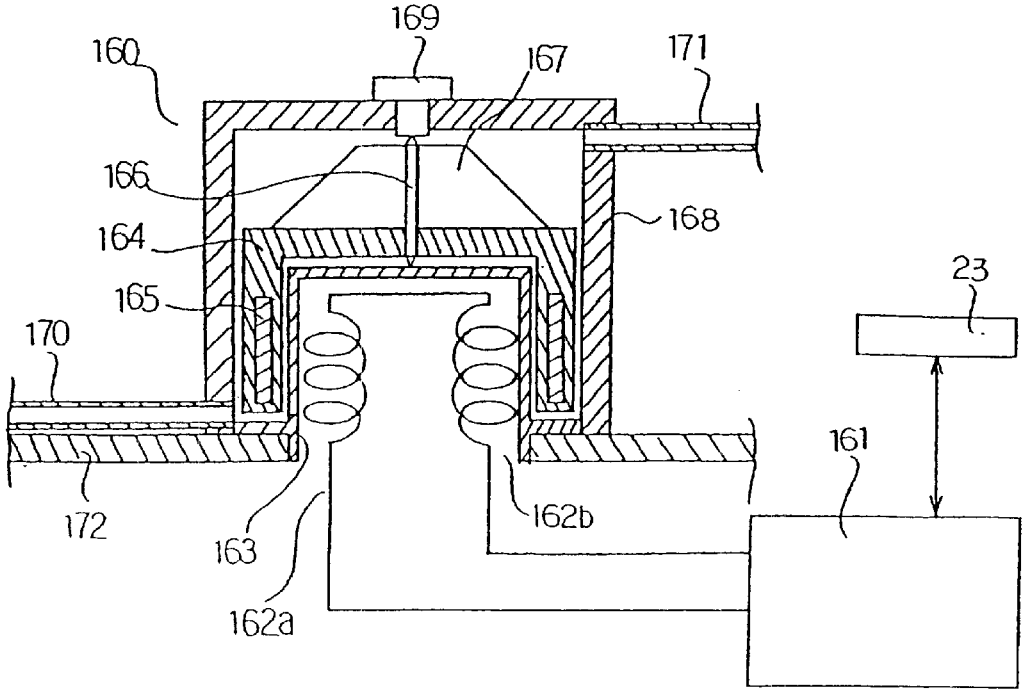
FIG. 16 is a longitudinal cross-section illustrating an embodiment of the ink viscosity measuring instrument which uses rotating current circuits.
Figure 17:
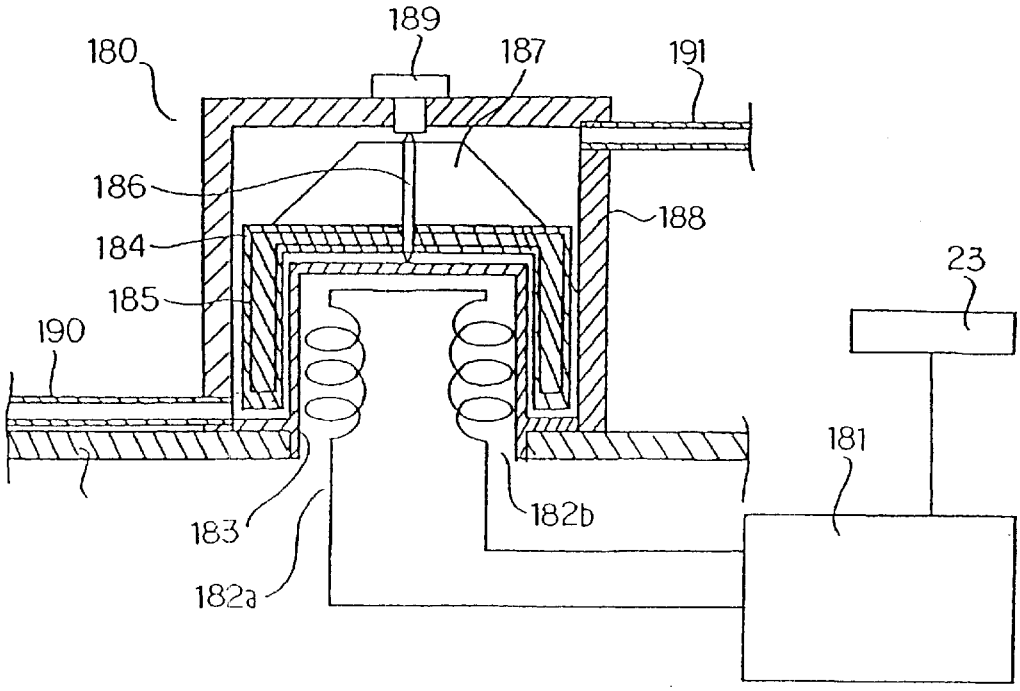
FIG. 17 is a longitudinal cross-section illustrating an embodiment of the ink viscosity measuring instrument which uses induced current circuits.

Furthermore, FIG. 15 shows an embodiment in which the magnetic bodies 65 and rotating body 64 are rotated by the action of a magnetic field using the principle of a so-called stepping motor, and FIG. 16 showed an embodiment that used the principle of a so-called brushless DC motor employing rotating current circuits. However, as still another means, there is an embodiment which uses the principle of a so-called squirrel-cage induction motor. Specifically, as shown in FIG. 17, this operation can also be accomplished by means of an embodiment in which a rotating induced current equivalent to a winding rotating induced current is applied to rotating induced current circuits 182*a* and 182*b*, and the magnetic bodies 185 and rotating body 184 are caused to rotate at a constant rotational speed by the action of this rotating induced current and the magnetic field generated by the magnetic bodies 185. More concretely, in the ink viscosity measuring instrument 180 disclosed in FIG. 17, ink flows through the space between an inner covering body 183 and an outer covering body 188 which are installed between ink supply passages 190 and 191, and which are attached to a bracket 192. Furthermore, a rotating body 184 which has flow-regulating vanes 187 and magnetic bodies 185 that measure the viscosity of the ink flowing through is mounted so that the rotor is free to rotate on a freely rotating shaft 186 which is shaft-supported between bearings 189 attached to the inner covering body 183 and outer covering body 188. Furthermore, rotating induced current circuits 182*a* and 182*b* are installed in positions facing the rotor 184 with the inner covering body 183 interposed. These rotating induced current circuits 182*a* and 182*b* are connected to an induced current control device 181, and the system is controlled by this induced current control device 181 so that a rotating induced current effect is generated in the rotating induced current circuits 182*a* and 182*b* as a result of the direction of the current flowing through the rotating induced current circuits 182*a* and 182*b* being switched. The system is controlled by the action of the induced current control device 181 so that a rotating induced current effect is generated in the rotating induced current circuits 182*a* and 182*b*. The rotating induced current circuits 182*a* and 182*b* are current coils in which the direction of the current is periodically switched; and rotation is imparted to the rotating body 184 by the magnetic field and current effects that occur upon the switching of the direction of the current through the rotating induced current circuits 182*a* and 182*b*.

When the induced current control device 181 operates, the rotating induced current circuits 182*a* and 182*b* are magnetically coupled with the magnetic bodies 185 of the rotating body 184 as a result of these rotating induced current circuits being powered by the current control device 181. The rotating induced current circuits 182*a* and 182*b* are controlled by the principle of a so-called brushless DC motor, in which rotation is imparted to the rotating body 184 as a result of the direction of the current applied to the rotating current circuits 182*a* and 182*b* being switched by the current control device 181. As a result of the action of this magnetism, the magnetic bodies 185 inside the rotating body 184 which is installed in a position facing the rotating current circuits 182*a* and 182*b* rotate, thus causing the rotating body 184 to rotate. The system is controlled by the induced current control device 181 so that the rotating body 184 always rotates at a constant speed; and the induced current control device 181 controls the system so that the rotating body 184 is always caused to rotate at a constant rotational speed even if variations occur in the viscosity of the ink flowing through. The rotating current circuit load current value generated inside the induced current control device 181 in this case is measured, and this value is converted into the viscosity of the ink by the converter 24 shown in FIG. 1. Furthermore, the ink viscosity in this case is displayed by an ink viscosity display device 25, and in cases where the ink viscosity departs from a preset appropriate range of ink viscosity values, the operator is informed of this by a warning device 54, etc. Furthermore, ink viscosity value measured by the ink viscosity measuring instrument 180 is processed by the control section 150, and the ink viscosity automatic adjustment apparatus 26 can automatically adjust the ink viscosity on the basis of the results of this processing. The automatic adjustment of the ink viscosity is as already described above. Of course, the ink viscosity measuring instrument 180 of the configuration disclosed in FIG. 17 can also be applied to the embodiments disclosed in FIGS. 9 through 13, and it goes without saying that if the ink viscosity measuring instrument 180 has a size that allows accommodation inside the ink passage, this instrument can also be installed inside the ink passage as shown in FIG. 14.

Furthermore, in the respective embodiments, the magnetic bodies 65, 165 and 185 are disposed inside the rotating bodies 64, 164 and 184. However, if the magnetic bodies 65, 165 and 185 themselves are bodies that are unaffected by the chemical action of the ink, it is also possible to use only the magnetic bodies 65, 165 and 185 instead of the rotating bodies 64, 164 and 184. Furthermore, if the magnetic bodies 65, 165 and 185 or rotating bodies 64, 164 and 184 themselves have a shape that performs a flow-regulating action with respect to the ink, the flow-regulating vanes 67, 167, 187 are not necessarily an essential construction. Furthermore, the magnetic bodies in the case of the field circuits disclosed in FIG. 15 and current circuits disclosed in FIG. 16 are usually magnets, while the magnetic bodies in the case of the induced current circuits disclosed in FIG. 17 are usually members made of a metal material which is magnetized by the flow of current through the induced current circuits.

Figure 18:
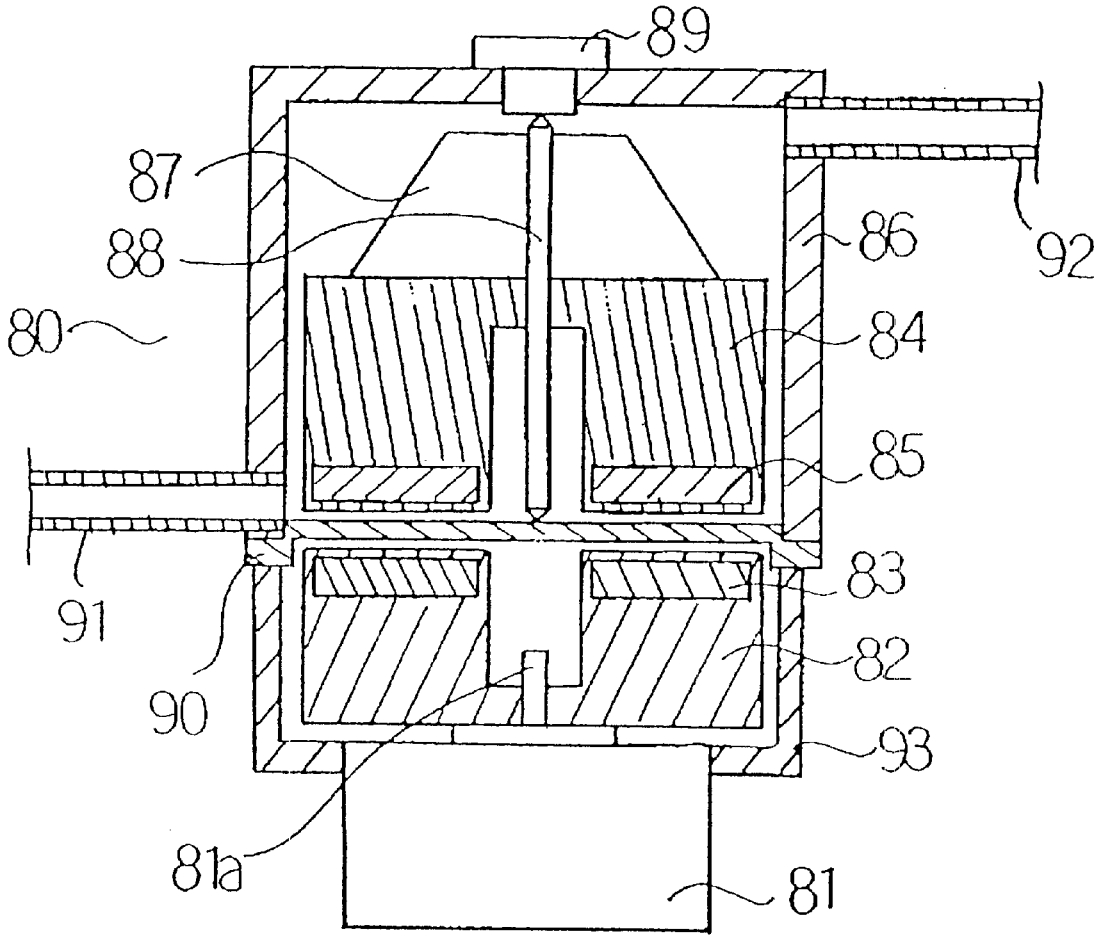
FIG. 18 is a longitudinal cross-section showing an ink viscosity measuring instrument constructed according to a different embodiment.

The ink viscosity measuring instrument may have various configurations other than the configurations shown in FIGS. 2, 15, 16 and 17. Some of these configurations will be described. FIG. 18 shows an embodiment with a construction in which rotation is accomplished by the magnetic coupling of first magnetic bodies 85 and second magnetic bodies 83 that face each other in the ink viscosity measuring instrument 80. The first rotating body 84 of the ink viscosity measuring instrument 80 (to which ink passages 91 and 92 are connected), which has the first magnetic bodies 85 and flow-regulating vanes 87, is installed inside covering bodies 86 and 90. The first rotating body 84 is installed so that it is free to rotate on a rotating shaft 88 which is shaft-supported between the covering body 86 and covering body 90. Furthermore, a second rotating body 82 is installed facing the first rotating body 84, and is attached to the rotating shaft 81*a* of a driving device 82 which is installed on the covering body 90 via a bracket 93. The first magnetic bodies 85 inside the first rotating body 84 and the second magnetic bodies 83 inside the second rotating body 82 are installed so that they face each other with the covering body 90 interposed, and thus effect magnetic coupling so that rotation is accomplished.

When the driving device 81 is driven in a state in which ink is caused to flow through so that the interior of the ink viscosity measuring instrument 80 is filled with ink, the second rotating body 82 begins to rotate at a preset rotational speed. The second magnetic bodies 83 inside the second rotating body 82 also rotate, and the first rotating body 84 also rotates along with the first magnetic bodies 85 (inside the covering bodies 86 and 90), which are magnetically coupled with the second magnetic bodies 83. When the first rotating body 84 rotates, the driving device control section 23 shown in FIG. 1 measures the rotational driving load current value that is obtained via the driving device 81. Then, the ink viscosity is measured by continuously or intermittently operating the ink viscosity measuring instrument 80, and the rotational driving load current value of the driving device that is obtained each time is sent to the converter 24, converted into an ink viscosity value and displayed by the ink viscosity display device 25. In cases where the measured ink viscosity value departs from the region bounded by the upper limit and lower limit of a preset ink viscosity value, or in cases where there is a danger that this might occur, the operator is informed of this by a warning device 54. The operator adjusts the ink viscosity by adding the diluent liquid or ink stock liquid in accordance with the display of this ink viscosity display device 25 or the warning of the warning device 54. Alternatively, the ink viscosity may also be automatically adjusted by the ink viscosity automatic adjustment apparatus 26.

Furthermore, in the embodiment shown in FIG. 18, the ink viscosity measuring instrument is constructed so that the first magnetic bodies 85 and second magnetic bodies 83 face each other, and rotation is accomplished by magnetic coupling. However, it is also possible to measure the ink viscosity by installing rotating field circuits of the type shown in FIG. 15, rotating current circuits of the type shown in FIG. 16 or induced current circuits of the type shown in FIG. 17, etc., facing the first magnetic bodies in place of the second magnetic bodies, and thus causing the first magnetic bodies 85 to rotate.

Figure 19:
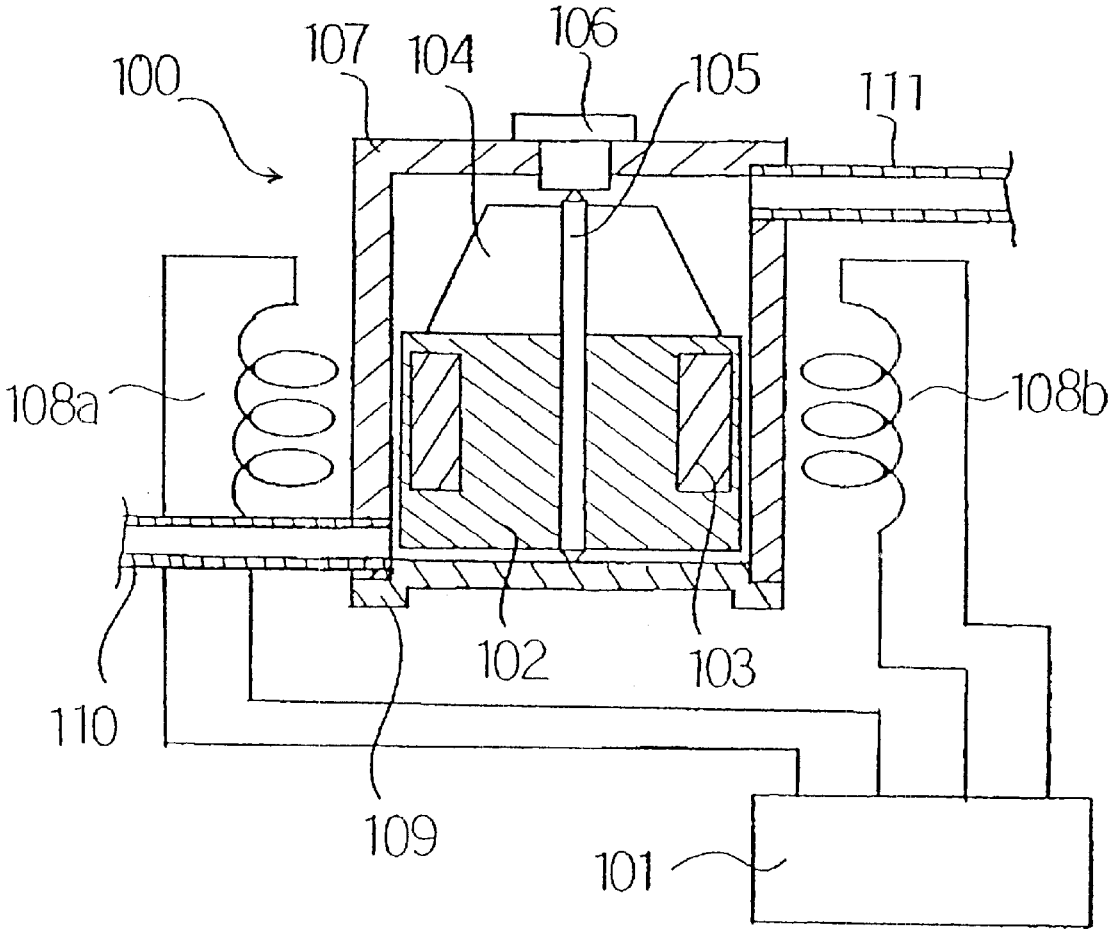
FIG. 19 is a longitudinal cross-section showing an ink viscosity measuring instrument constructed according to a different embodiment.

FIG. 19 shows an embodiment in which the magnetic bodies 103 of the ink viscosity measuring instrument 100 and a driving device 108 positioned outside the region of rotation of the magnetic bodies 103 are installed facing each other. The rotating body 102 of the ink viscosity measuring instrument 100 (to which ink passages 110 and 111 are connected), which has the magnetic bodies 103 and flow-regulating vanes 104, is installed inside the covering bodies 107 and 109. The rotating body is installed so that it is free to rotate on a rotating shaft 105 which is shaft-supported between the covering body 107 and covering body 109. Furthermore, rotating field circuits 108*a* and 108*b* are installed facing the magnetic bodies 103 outside the circumference of the rotating body 102. The rotating field circuits 108*a* and 108*b* are controlled by a field control device 101 so that a rotating magnetic field is generated. Furthermore, in the embodiment disclosed in FIG. 19, the rotating field circuits may be rotating current circuits or induced current circuits.

When the field control device 101 is operated in a state in which ink is caused to flow through so that the interior of the ink viscosity measuring instrument 100 is filled with ink, thus causing a rotating magnetic field to be generated by the rotating field circuits 108*a* and 108*b*, a rotating action is generated by the magnetic effect of the rotating magnetic field in the magnetic bodies 103 installed facing the rotating field circuits 108*a* and 108*b*, so that the rotating body 102 begins to rotate at a preset rotational speed. When the rotating body 102 rotates, the driving device control section 23 shown in FIG. 1 measures the load current value of the rotating field circuits via the field control device 101. Then, the ink viscosity is measured by continuously or intermittently operating the ink viscosity measuring instrument 100, and the rotating field circuit load current value that is obtained each time is sent to the converter 24, converted into an ink viscosity value and displayed by the ink viscosity display device 25. In cases where the measured ink viscosity value departs from the region bounded by the upper limit and lower limit of a preset ink viscosity value, the operator is informed of this by a warning device 54. The operator adjusts the ink viscosity by adding the diluent liquid or ink stock liquid in accordance with the display of this ink viscosity display device 25 or the warning of the warning device 54. Alternatively, the ink viscosity may also be automatically adjusted by the ink viscosity automatic adjustment apparatus 26.

Furthermore, the embodiment shown in FIG. 19 is constructed so that the rotating field circuits 108*a* and 108*b* are installed facing the magnetic bodies 103 outside the circumference of the rotating body 102. However, instead of these rotating field circuits, it is also possible to install magnetic bodies of the type shown in FIG. 2 so that these magnetic bodies are free to rotate, and to measure the ink viscosity by causing these magnetic bodies to rotate by means of a driving device, so that the magnetic bodies 103 are caused to rotate.

Furthermore, in the embodiments disclosed in FIGS. 18 and 19, the magnetic bodies 85, 103 are installed inside rotating bodies 84, 102. However, if the rotating bodies 85, 103 themselves are bodies that are unaffected by the chemical action of the ink flowing through, it is also possible to use a construction in which the magnetic bodies 85, 103 rotate directly.

Figure 14:
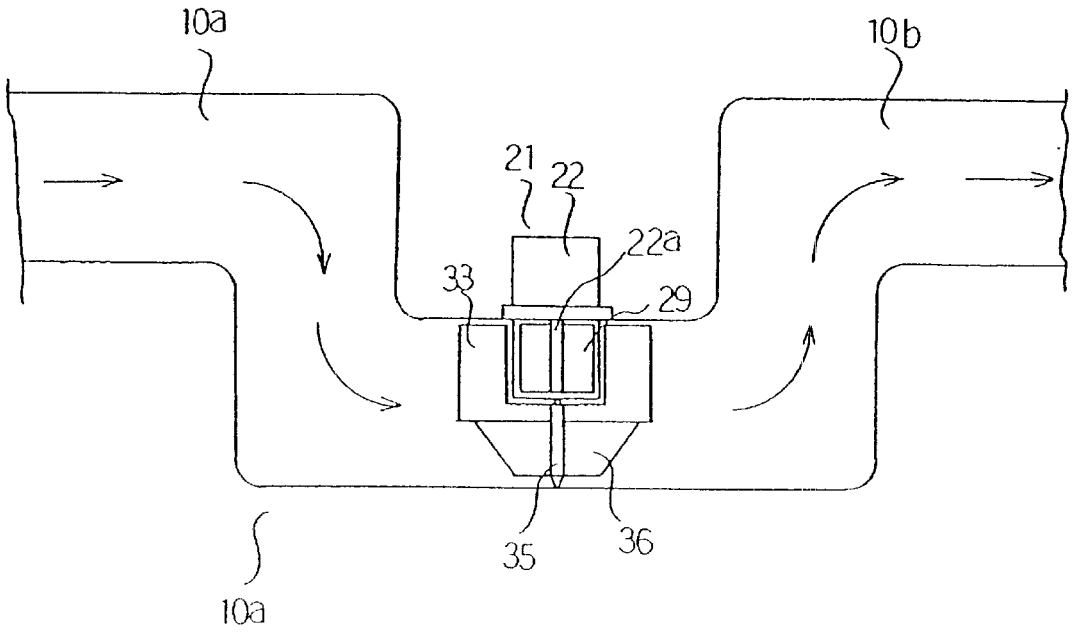
FIG. 14 is a schematic diagram illustrating an embodiment in which the ink viscosity measuring instrument of the present invention is installed inside a bent ink passage.

Furthermore, it goes without saying that the ink viscosity measuring instruments 80 and 100 of the configurations disclosed in FIGS. 18 and 19 could also be applied to the embodiments disclosed in FIGS. 8 through 13, and that the ink viscosity measuring instruments 80 and 100 could also be installed inside the ink passages as shown in FIG. 14 as devices of a size that can be accommodated inside the ink passages.

Furthermore, in order to obtain accurate ink viscosity measurement results in the various types of ink viscosity measuring instruments and ink viscosity measuring devices disclosed in FIGS. 14 through 19, the flow meter and foreign matter removal device may be installed in the ink passages, so that the accuracy of the ink viscosity measurements is heightened by obtaining the above-described actions of the flow meter and foreign matter removal device. It is desirable that the positions in which the flow meter and foreign matter removal device are installed be on the downstream side of the ink tank between the ink tank and the ink viscosity measuring instrument. However, since the object of the flow meter can be achieved as long as the flow of ink through the ink viscosity measuring instrument can be measured by the flow meter, it is also possible to install the flow meter on the downstream side of the ink viscosity measuring instrument, i.e., on the side of the ink collecting area A formed between the ink roll 4 and wringing roll 5.

In the printing apparatus in the various embodiments disclosed above in FIGS. 9 through 13, the descriptions are based on a case using a flexo ink which requires circulation. However, in cases where a low-viscosity, extremely quick-drying glycol type ink (hereafter referred to as a "glycol type printer-slotter ink") in which circulation of the ink is generally not considered to be necessary is caused to circulate through the ink supply and recovery devices of the respective embodiments disclosed in FIGS. 9 through 13, it is effective to use the above-described ink viscosity measuring instrument and ink viscosity measuring device, as well as the above-described ink viscosity adjusting device. Specifically, a glycol type printer-slotter ink is placed in the ink tank of each of the ink supply and recovery devices disclosed in the respective embodiments, and this glycol type ink is supplied by means of a pump or pressurizing-depressurizing device, etc. to the ink collecting area formed between the ink roll and wringing roll by damming both ends of the rolls with damming members, while the ink supply and recovery device is caused to move in the axial direction of the ink roll and wringing roll, i.e., in the direction of width of the machine. Furthermore, the glycol type ink is similarly recovered into the ink tank from the above-described ink collecting area using an ink pump or pressurizing-depressurizing device, etc. The supply and recovery of this glycol type ink, and the circulating action, are similar to the actions of the various ink supply and recovery devices described above. Accordingly, a detailed description is omitted here. However, as in the case of the flexo ink, the viscosity of the glycol type ink that is supplied, recovered and circulated rises as a result of frictional heat generated by the ink roll and wringing roll, and heat generated by the friction of the ink passages and ink pump, etc. Accordingly, as in the various embodiments described above, the ink viscosity measuring instrument, ink viscosity measuring device and ink viscosity adjusting device of the present invention are respectively installed in order to control the viscosity of the ink. The ink viscosity is measured, and printing is performed at a constantly stable ink viscosity. Furthermore, in cases where such a glycol type printer-slotter ink is used, a special cleaning liquid is used.

As described above, the ink viscosity measuring instrument of the present invention allows the complete elimination of ink viscosity measurements using a conventional Zahn cup. Accordingly, the working characteristics for the operator can be greatly improved, and the operator can be freed from the bothersome measurement work using a Zahn cup, and the work of performing repeated measurements or continual measurements at specified time intervals. Furthermore, since ink recovery and cleaning are also performed automatically, the work of cleaning away ink adhering to the Zahn cup that arises in cases where a Zahn cup is used is also eliminated, so that labor can be saved and the working environment can be improved.

Furthermore, since the ink viscosity measuring instrument can be installed in the ink passages, the viscosity of the ink supplied to the ink roll and wringing roll can be measured at any time, even during printing production, so that printing can be performed with the viscosity of the ink known, thus reducing the frequency of occurrence of unsatisfactory printing caused by instability of the ink viscosity.

Furthermore, the visual measurement and estimation required on the part of the operator in the case of ink viscosity measurements using a Zahn cup are eliminated by the ink viscosity measuring instrument and ink viscosity measuring device. Accordingly, erroneous measurements are eliminated, and there is no measurement error in the ink viscosity according to the individual measurement performed. Consequently, the occurrence of unsatisfactory printing caused by variations in the ink viscosity resulting from measurement error is eliminated.

Moreover, since viscosity control can be performed automatically by the ink viscosity adjusting device instead of through an operator even during production, the occurrence of unsatisfactory printing due to an unstable ink viscosity resulting from the operator being busy or simply forgetting to perform measurements can be eliminated. In addition, since the addition of water or the ink stock liquid in order to adjust the ink viscosity on the basis of the ink viscosity measurement results can also be performed automatically, work that depends on the experience of the operator is eliminated, so that printing work can easily be performed even by operators with little experience.

Furthermore, since the rotating body that is subjected to the resistance of the ink viscosity while rotating and that sends the resulting rotational driving resistance value to the control section is a structural body which is completely accommodated inside the ink passage and which uses absolutely no sealing members, etc. for attachment, and since this rotating body has a structure that is caused to rotate by an external force without any contact from the outside, there is absolutely no ink leakage even if the rotating body rotates. Moreover, since the rotating body is positioned inside the ink passages, the cleaning of the rotating body can be accomplished along with the cleaning of the ink passages, so that cleaning can be completed within the normal cleaning time. Accordingly, there is no need for the cleaning work or extra cleaning time required in the case of conventional devices or Zahn cups, etc. As a result, the cleaning time can be shortened, and the operator does not need to perform bothersome cleaning work, so that the burden on the operator is lightened. In addition, since the ink viscosity measuring instrument itself also has a simple structure and a compact construction, the ink viscosity measuring instrument can easily be removed, and maintenance can easily be performed. Furthermore, in the unlikely event of trouble, the ink viscosity measuring instrument can easily be replaced.

Furthermore, since the apparatus is simple and can be made compact, this apparatus can also be attached to existing flexo printing apparatus, and can also make a great contribution to improving the printing performance of such existing flexo printing apparatus.

What is claimed is:

1. A printing apparatus comprising a printing plate drum (2) and a pressing drum (13) that is disposed so as to face said printing plate drum, wherein cardboard sheets are passed between said printing plate drum (2) and pressing drum (13) which rotate in mutually opposite directions, thus causing specified printing to be performed on said sheets, said printing apparatus further comprising:

an ink transfer roll (4) which rotates in contact with a printing plate of said printing plate roll (2) at a time of printing;

an adjustment means (5) which makes contact with said ink transfer roll (4) during printing and adjusts an amount of ink by wringing;

a pair of regulating members (44, 44) which are disposed at both ends of said ink transfer roll and adjustment means with respect to an axial direction thereof and are used to demarcate an ink collecting area between said ink transfer roll (4) and said adjustment means (5);

an ink supply source (45) which is disposed near an upper end of said ink collecting area, a specified amount of ink being stored in said ink supply source (45);

a first tubular body (48) and second tubular body (49), opening part of one of said first tubular body (48) and second tubular body (49) is inserted into said ink supply source, and an opening part of another of said first tubular body (48) and second tubular body (49) is caused to face the ink collecting area, an ink feeding pumps (47, 50) being respectively connected to said first tubular body (48) and second tubular body (49); and an ink viscosity measuring instrument installed in said first tubular body (48) so as to measure a viscosity variation of ink that is supplied to said ink collecting area that is demarcated between said ink transfer roll (4) and adjustment means (5), said ink viscosity measuring instrument being comprised of:

a rotating body (33) which is disposed inside said first tubular body (48) so that said rotating body (33) can freely rotate;

an electrical rotation-imparting means (22) which is disposed outside said first tubular body (48), magnetically coupled to said rotating body (33), and imparts rotation to said rotating body (33);

a load current value detection means (23) which detects changes in a load current value that accompany changes in a viscosity of ink that contacts said rotating body (33) when rotation is imparted to said rotating body (33) by passing an electric current through said rotation-imparting means (22);

a memory means (151) which stores said load current values that correspond to respective changes in a viscosity value of said ink; and a calculating means (152) which compares respective load current values stored in said memory means (151) with said load current value detected by said load current value detection means (23) and calculates an ink viscosity value at a current point in time.

* * * * *